US012214242B2

(12) United States Patent
Andrei et al.

(10) Patent No.: US 12,214,242 B2
(45) Date of Patent: Feb. 4, 2025

(54) KINETIC WORKOUT STATION

(71) Applicant: AD Kinetics GmbH, Kufstein (AT)

(72) Inventors: Daniel Andrei, Kufstein (AT); Laura Andrei, Munich (DE); Serban Andrei, Kufstein (AT); Gina Andrei, Kufstein (AT)

(73) Assignee: AD Kinetics GmbH, Kufstein (AT)

( * ) Notice: Subject to any disclaimer, the term of this patent is extended or adjusted under 35 U.S.C. 154(b) by 1036 days.

(21) Appl. No.: 16/765,088

(22) PCT Filed: Nov. 16, 2018

(86) PCT No.: PCT/EP2018/081642

§ 371 (c)(1),
(2) Date: Apr. 5, 2021

(87) PCT Pub. No.: WO2019/097027

PCT Pub. Date: May 23, 2019

(65) Prior Publication Data

US 2021/0244995 A1 Aug. 12, 2021

(30) Foreign Application Priority Data

Nov. 17, 2017 (DE) ..... 10 2017 010 648.7
Feb. 14, 2018 (DE) ..... 10 2018 001 153.5

(51) Int. Cl.

| | |
|---|---|
| ***A63B 21/22*** | (2006.01) |
| ***A63B 21/00*** | (2006.01) |
| ***A63B 21/005*** | (2006.01) |
| ***A63B 21/16*** | (2006.01) |
| *A63B 71/06* | (2006.01) |

(52) U.S. Cl.

CPC ..... *A63B 21/225* (2013.01); *A63B 21/0051* (2013.01); *A63B 21/153* (2013.01);
(Continued)

(58) Field of Classification Search

CPC . A63B 21/225; A63B 21/4035; A63B 21/153; A63B 21/4043; A63B 21/015;
(Continued)

(56) References Cited

U.S. PATENT DOCUMENTS 518,967 A * 5/1894 Poole ..... A63B 21/153
242/381.6
2,866,436 A * 12/1958 Swain ..... A01K 27/004
119/797

(Continued)

FOREIGN PATENT DOCUMENTS

CN 201316497 Y * 9/2009
WO WO-2004050191 A1 * 6/2004 ..... A63B 21/023
WO WO-2019081028 A1 * 5/2019 ..... A63B 21/00069

OTHER PUBLICATIONS

Wang; Chang-Fu, "Portable Motor Cover for Running Machine", Filed Oct. 23, 2008, Published Sep. 30, 2009. English Translation. (Year: 2009).*

*Primary Examiner* — Joshua T Kennedy
(74) *Attorney, Agent, or Firm* — Law Office of Andrei D Popovici, PC

(57) ABSTRACT

A strength machine includes a housing having at least two openable or detachable housing shells, a support structure coupled to the housing, a rotatable flywheel mounted on a shaft supported by the support structure, the flywheel being situated between the two housing shells, the flywheel changing its direction of rotation while in operation, a strap- or belt-shaped flexible pulling element attached to the shaft, a hand grip which forms part of or is attached to the flexible pulling element, and an attachment module coupled to the housing, for securing the strength-training machine to an external support.

15 Claims, 68 Drawing Sheets

(52) U.S. Cl.
CPC ..... *A63B 21/1663* (2013.01); *A63B 21/169* (2015.10); *A63B 21/227* (2013.01); *A63B 21/4035* (2015.10); *A63B 2071/0625* (2013.01); *A63B 2210/50* (2013.01); *A63B 2220/833* (2013.01); *A63B 2225/20* (2013.01); *A63B 2225/685* (2013.01)

(58) Field of Classification Search
CPC ..... A63B 2022/0079; A63B 21/227; A63B 2225/685; A63B 2225/68; A63B 21/1663; A63B 21/169; A63B 21/16; F16M 13/02
See application file for complete search history.

(56) References Cited

U.S. PATENT DOCUMENTS 7,771,131 B2 * 8/2010 Scott ..... G03B 17/00 396/428
8,715,144 B1 * 5/2014 Friess ..... A63B 21/4033 482/121
9,974,993 B1 * 5/2018 Pollock ..... A63B 21/4034
11,857,830 B2 1/2024 Stegeman
2004/0043873 A1 * 3/2004 Wilkinson ..... A63B 21/00065 482/52
2009/0036276 A1 * 2/2009 Loach ..... A63B 21/0055 482/72
2009/0156362 A1 * 6/2009 Berg ..... A63B 21/0616 482/136
2014/0091192 A1 * 4/2014 Mersky ..... F16M 11/041 248/447
2016/0158603 A1 * 6/2016 Darwood ..... A63B 24/0062 482/5
2016/0287922 A1 * 10/2016 Baudhuin ..... A63B 21/012
2016/0324717 A1 * 11/2016 Burton ..... A61H 7/001
2016/0339290 A1 * 11/2016 Eisenblaetter ..... A63B 21/4035
2021/0402246 A1 * 12/2021 Stegeman ..... A63B 21/00061

* cited by examiner

Detail B
A
A
B
A-A

Figure 10:
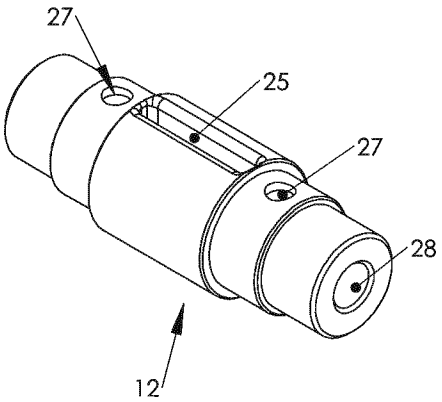

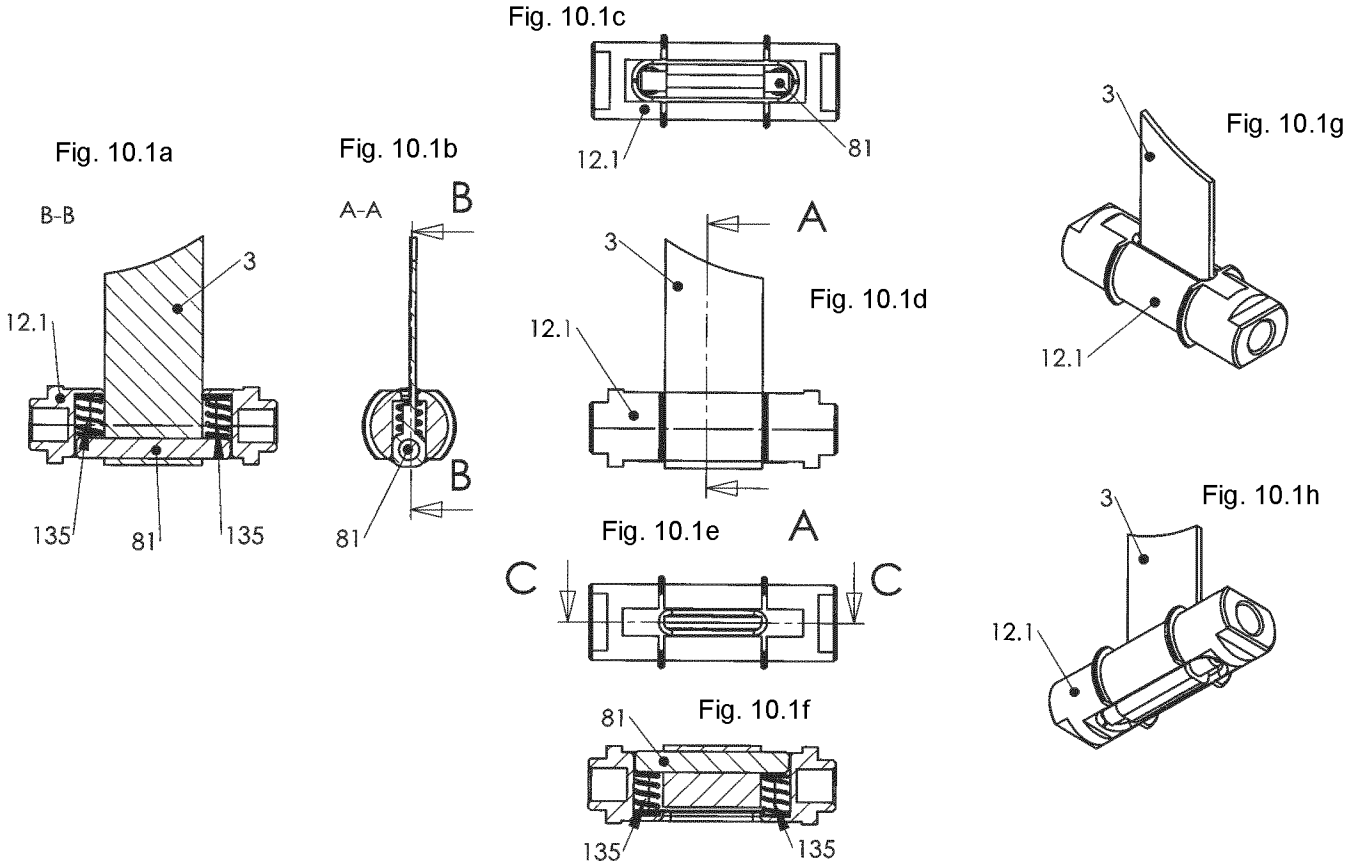
Fig. 10.1g
3
12.1
Fig. 10.1h
3
12.1
Fig. 10.1c
81
12.1
Fig. 10.1d
A
3
12.1
Fig. 10.1e
A
C
C
Fig. 10.1f
81
135
135
Fig. 10.1b
B
A-A
B
81
Fig. 10.1a
B-B
3
135
81
12.1
135

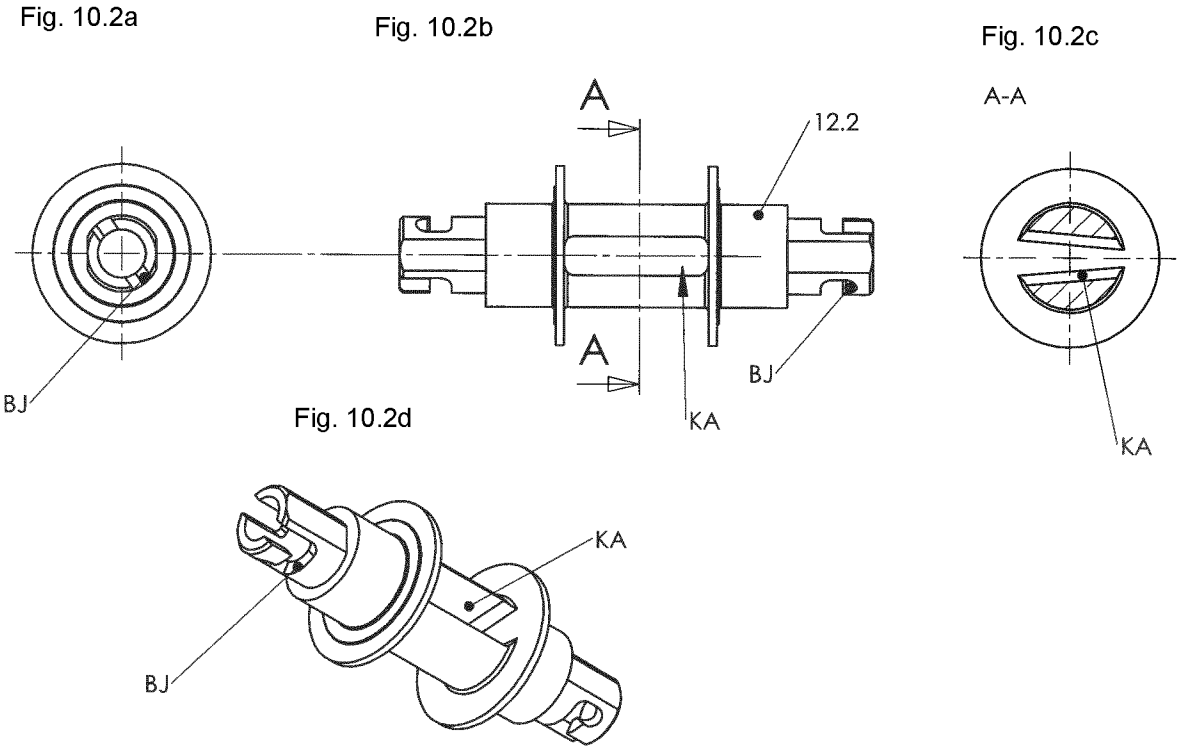
Fig. 10.2c
A-A
KA
Fig. 10.2b
12.2
BJ
KA
A
A
Fig. 10.2a
BJ
Fig. 10.2d
KA
BJ

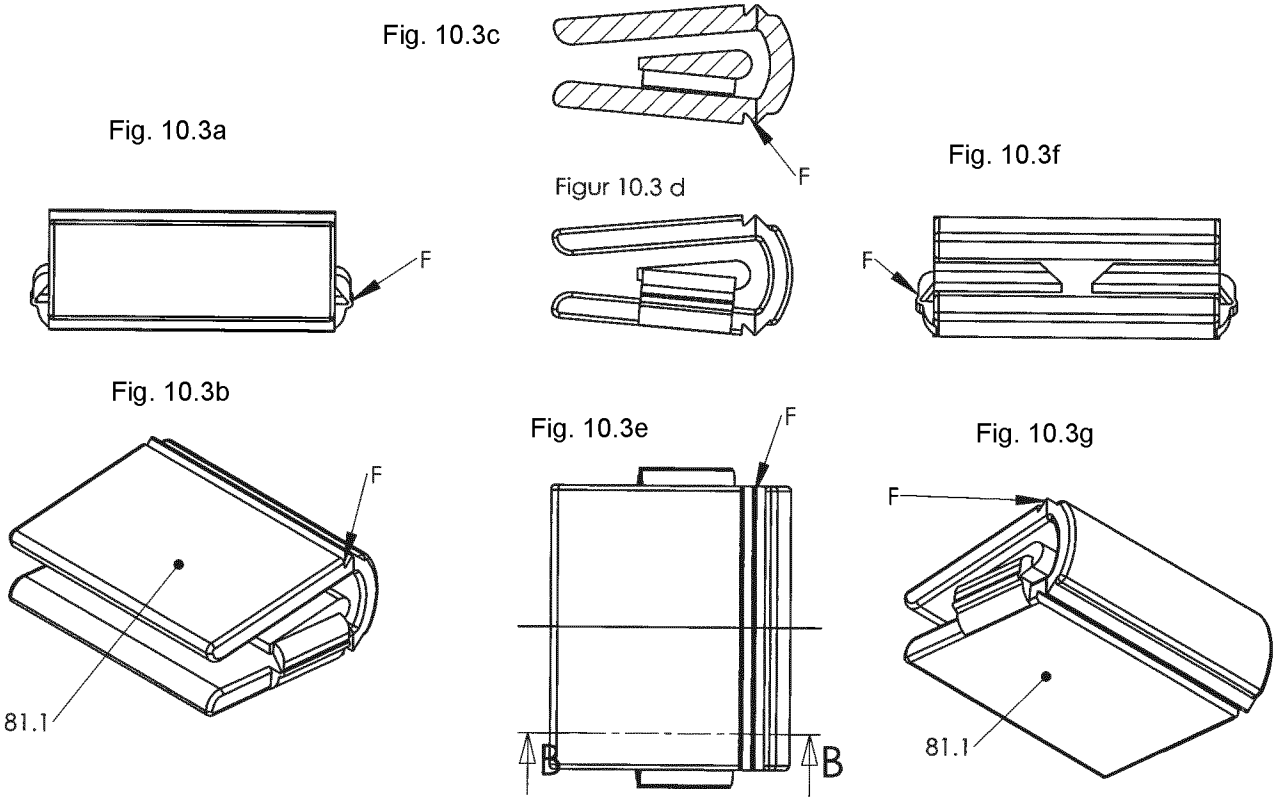
Fig. 10.3a
F
Fig. 10.3b
F
81.1
Fig. 10.3c
F
Figur 10.3 d
Fig. 10.3e
F
B
B
Fig. 10.3f
F
Fig. 10.3g
F
81.1

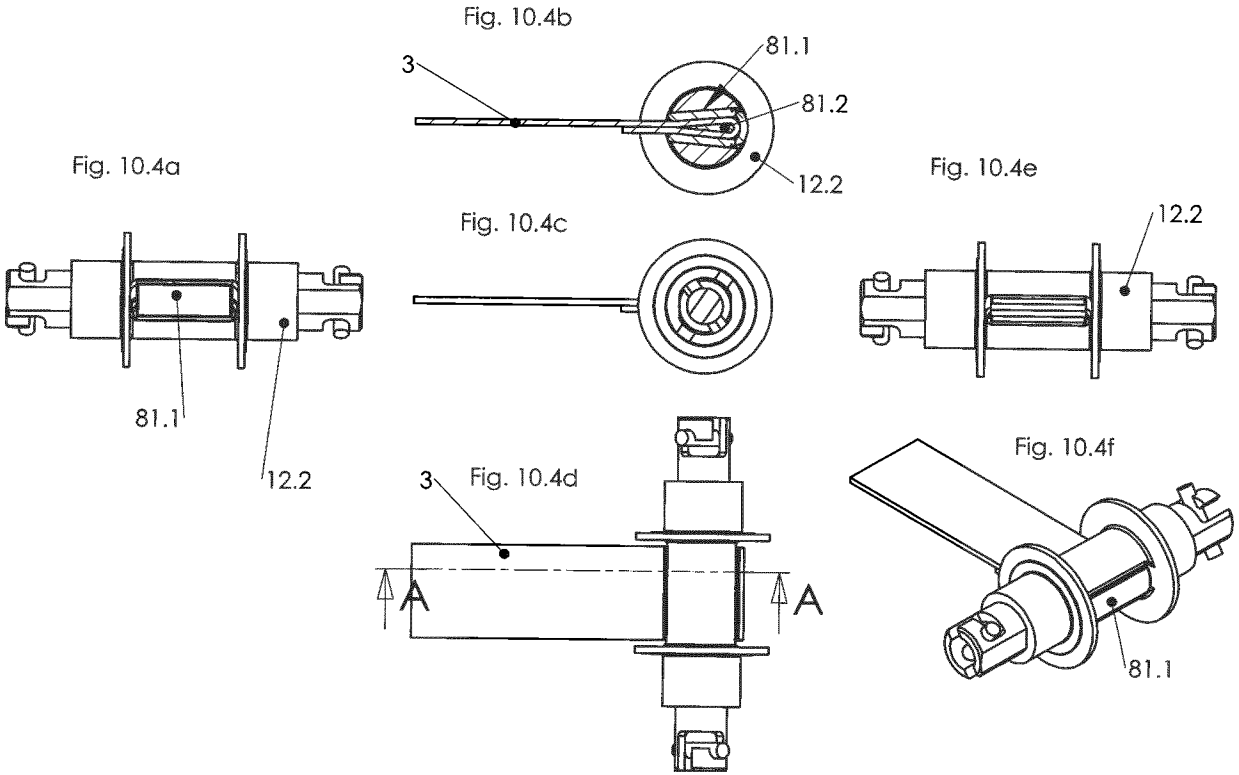
Fig. 10.4a
12.2
81.1
Fig. 10.4b
81.1
81.2
12.2
3
Fig. 10.4c
Fig. 10.4d
A
A
3
Fig. 10.4e
12.2
Fig. 10.4f
81.1

A
A
9
30
31
32
33
34
35
36
58

9

58
9.1
58
30
9.1

AK
33
AK
31

9
9
58
9.1
58

AK
AK
30
AK
AK

30
AK
9
9.1
9
31
58
58

Figure 23:
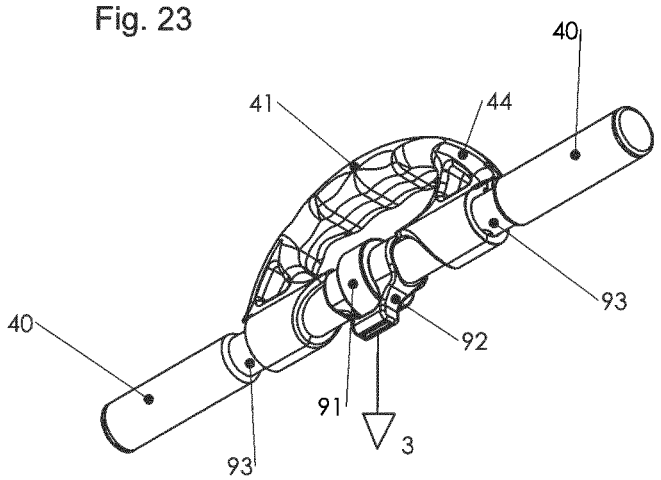

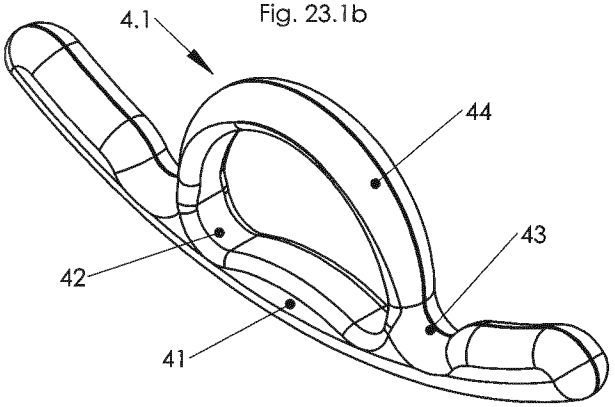
Fig. 23.1b
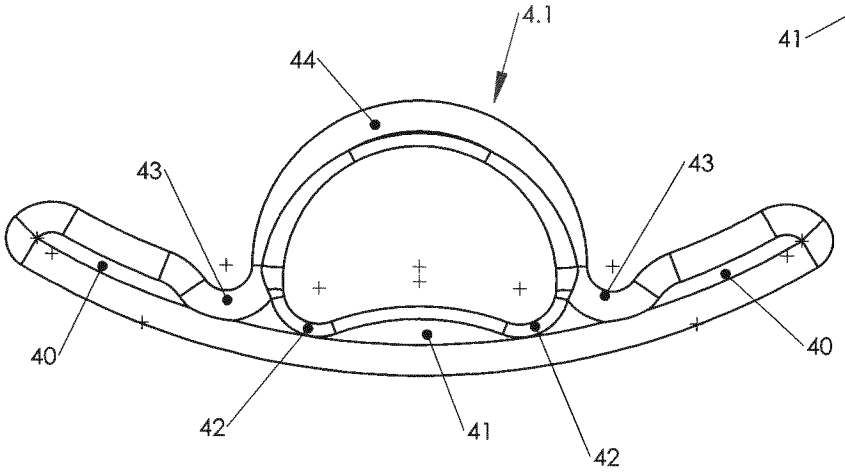
Fig. 23.1a

Fig. 29
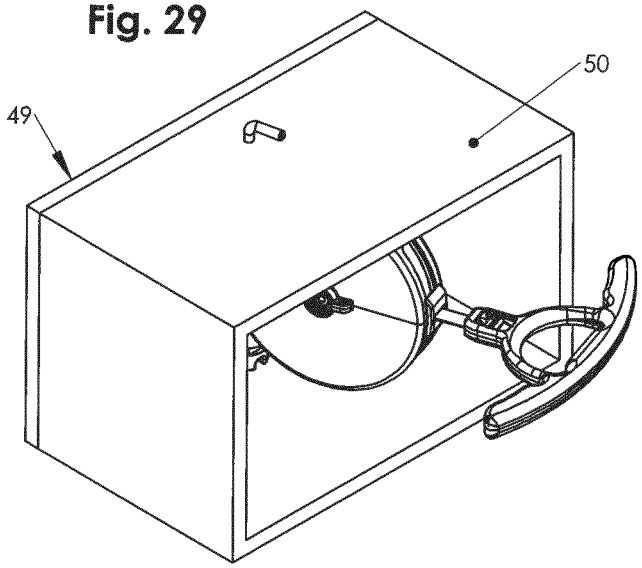
Fig. 29.a
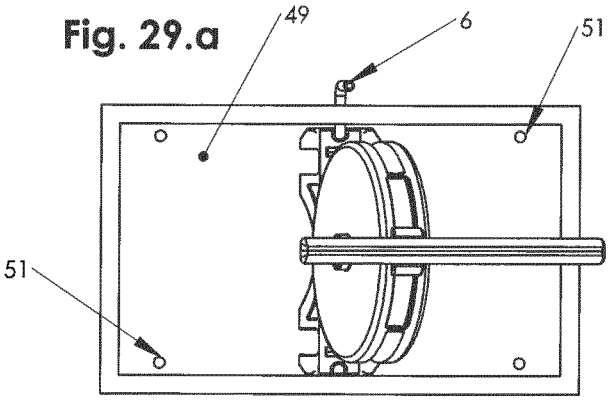

B-B
212
1
212

A
62a
61
211
62b
A
213
211
B
B
212
1
212

6
212
1
212
A-A
61
213
102c
62

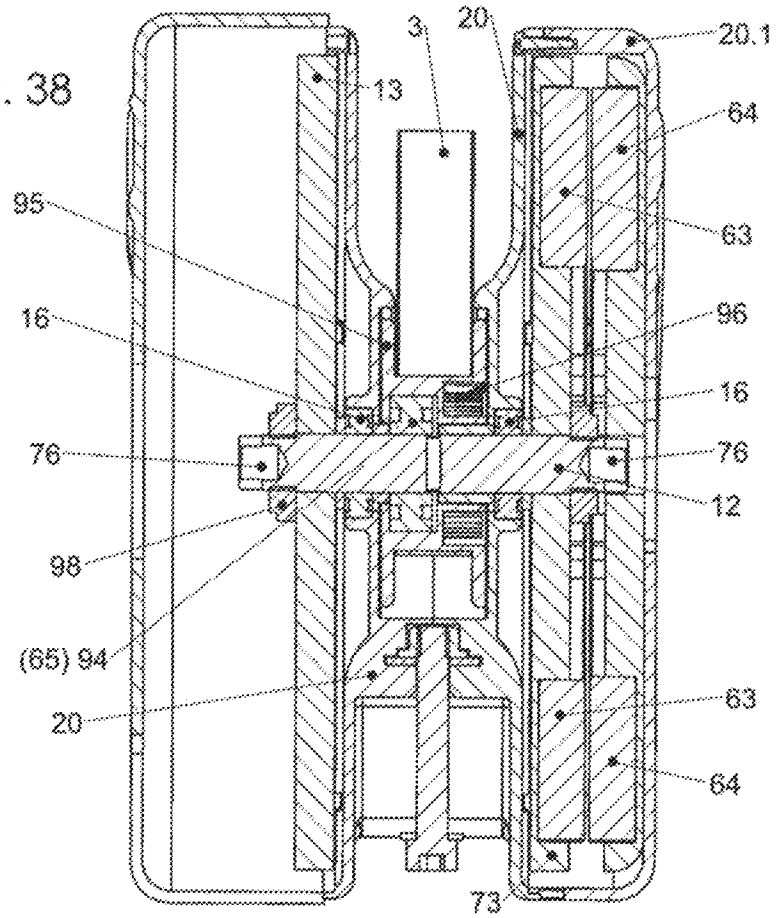
Fig. 38
Fig. 38b
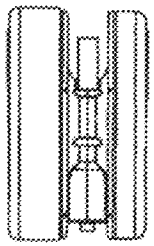
Fig. 38a
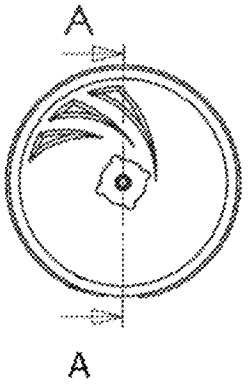

(18)
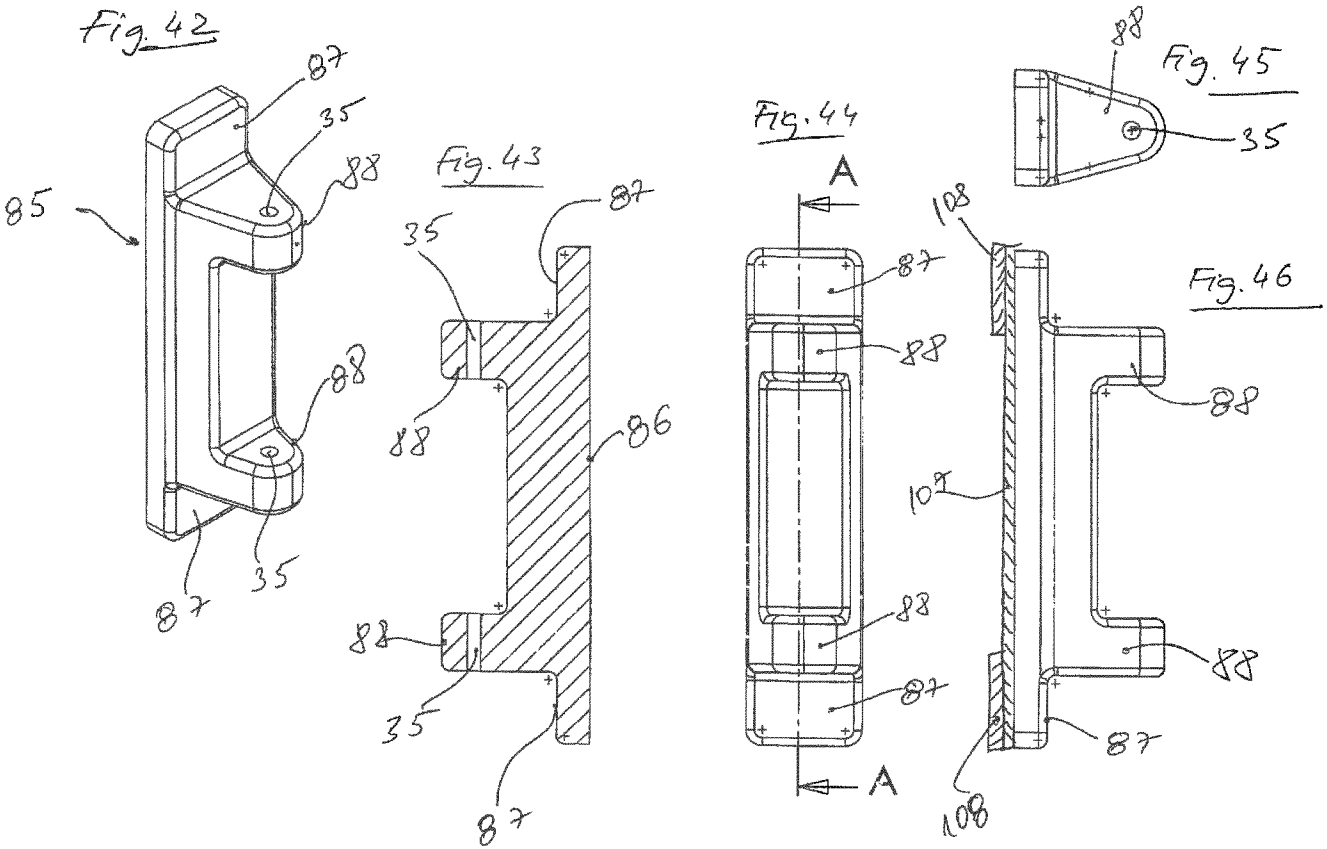

Figure 50:
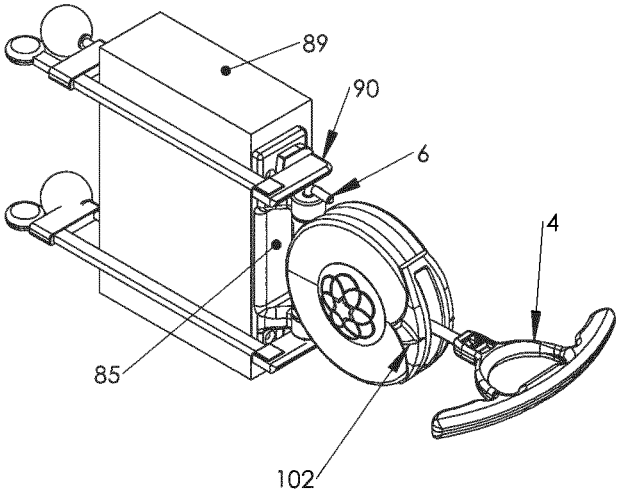
Figures 51, 52, 53, 54, 55:
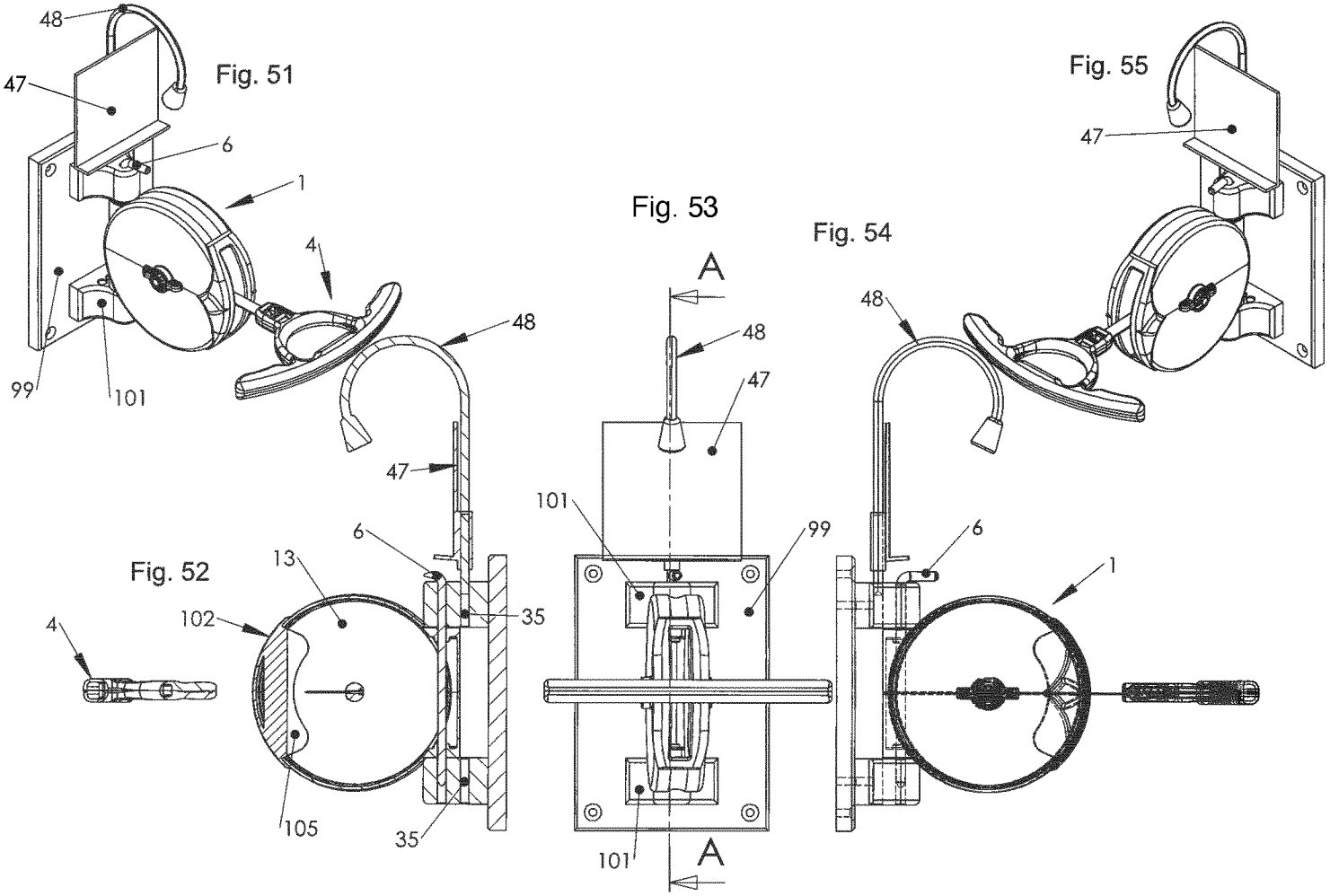
Figure 61:
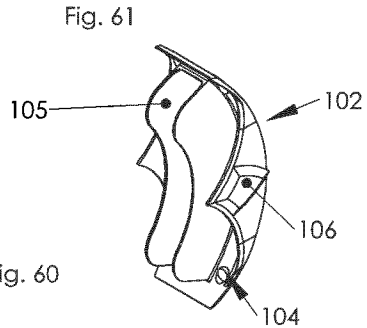
Figure 60:
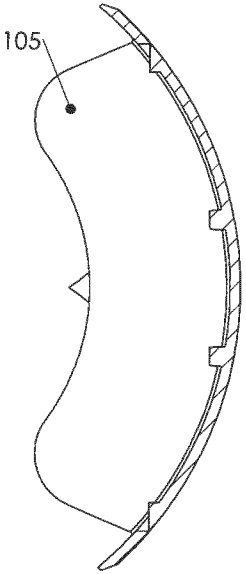
Figure 59:
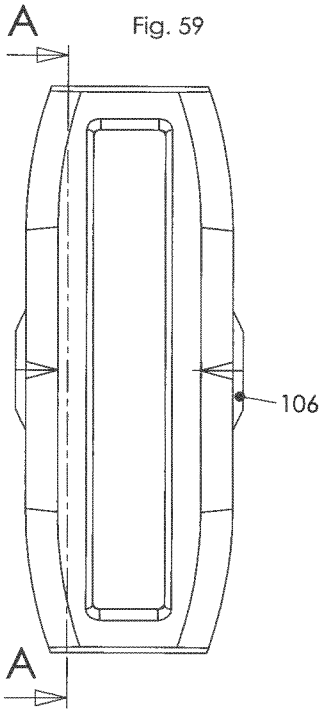
Figure 58:
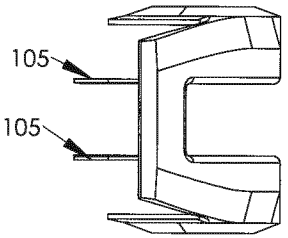
Figure 57:
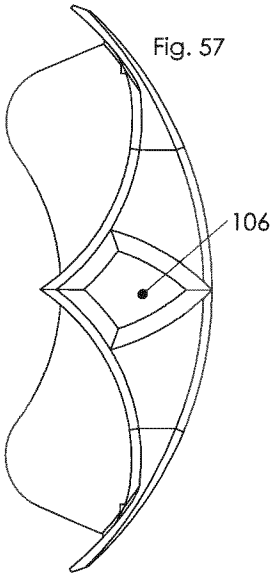
Figure 56:
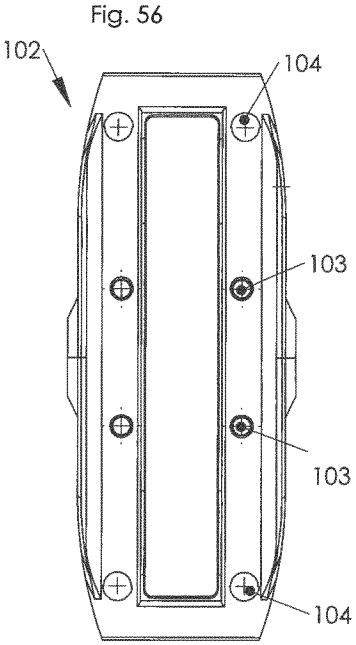
Figure 66:
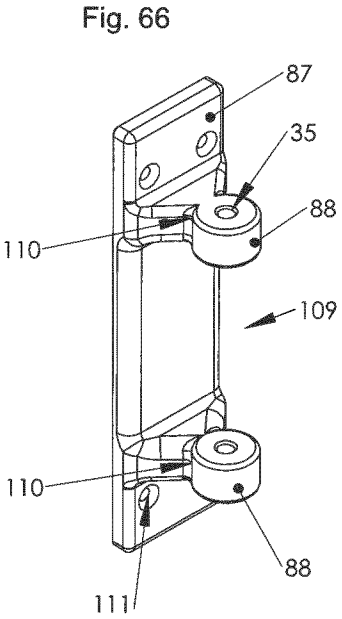
Figure 64:
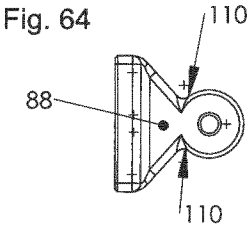
Figure 65:
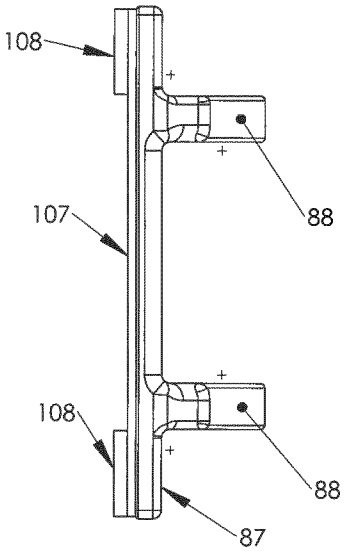
Figure 63:
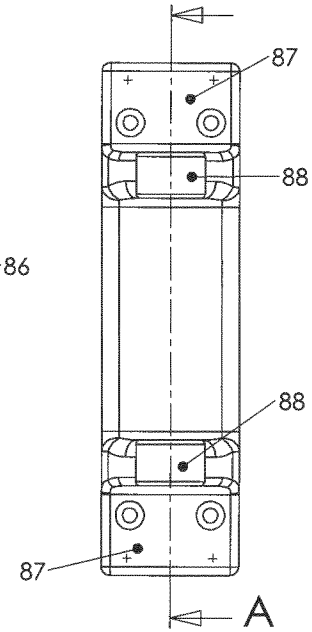
Figure 62:
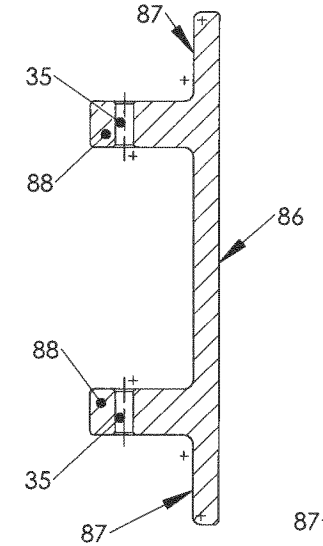

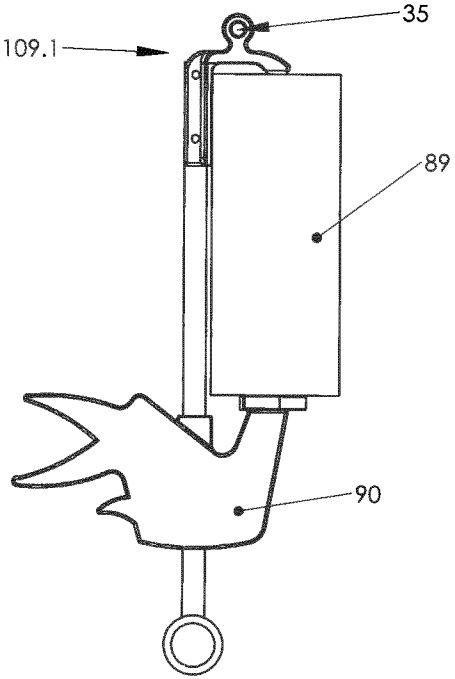
Fig. 50.1b
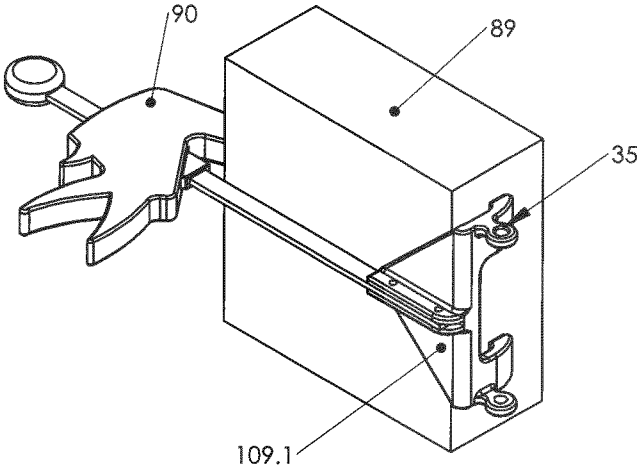
Fig. 50.1a

A
A
1
4
6
13
35
47
48
99
101
102
105

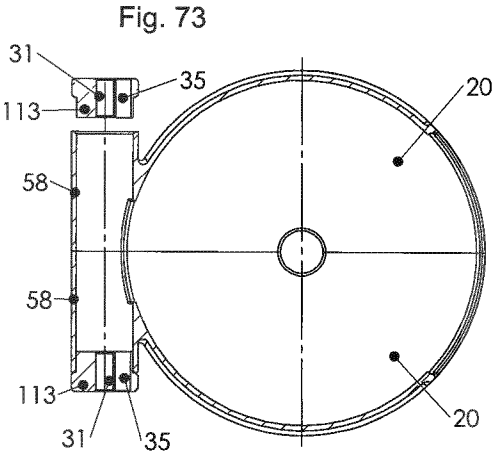
Fig. 73
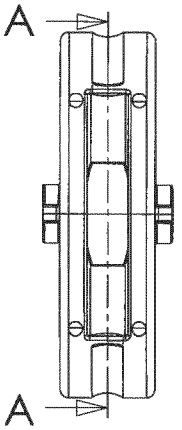
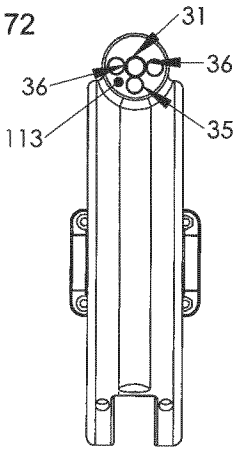
Fig. 72
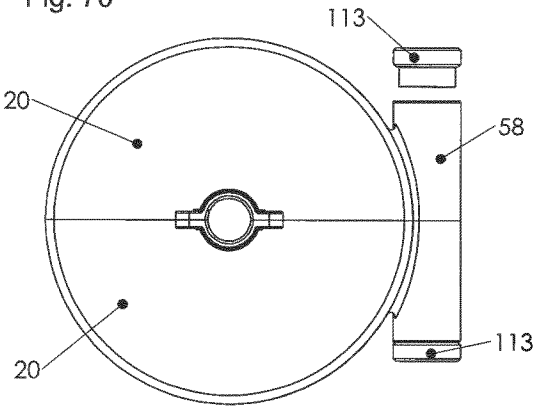
Fig. 70
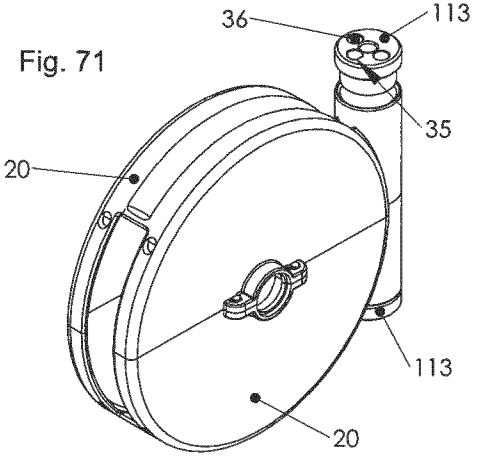
Fig. 71

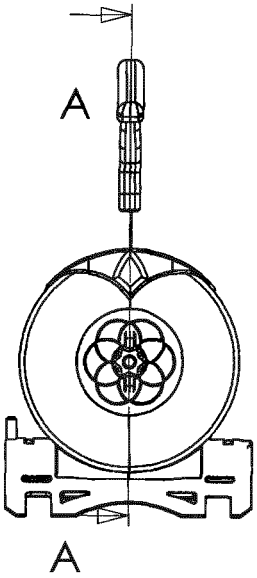
Fig. 75a
Fig. 75
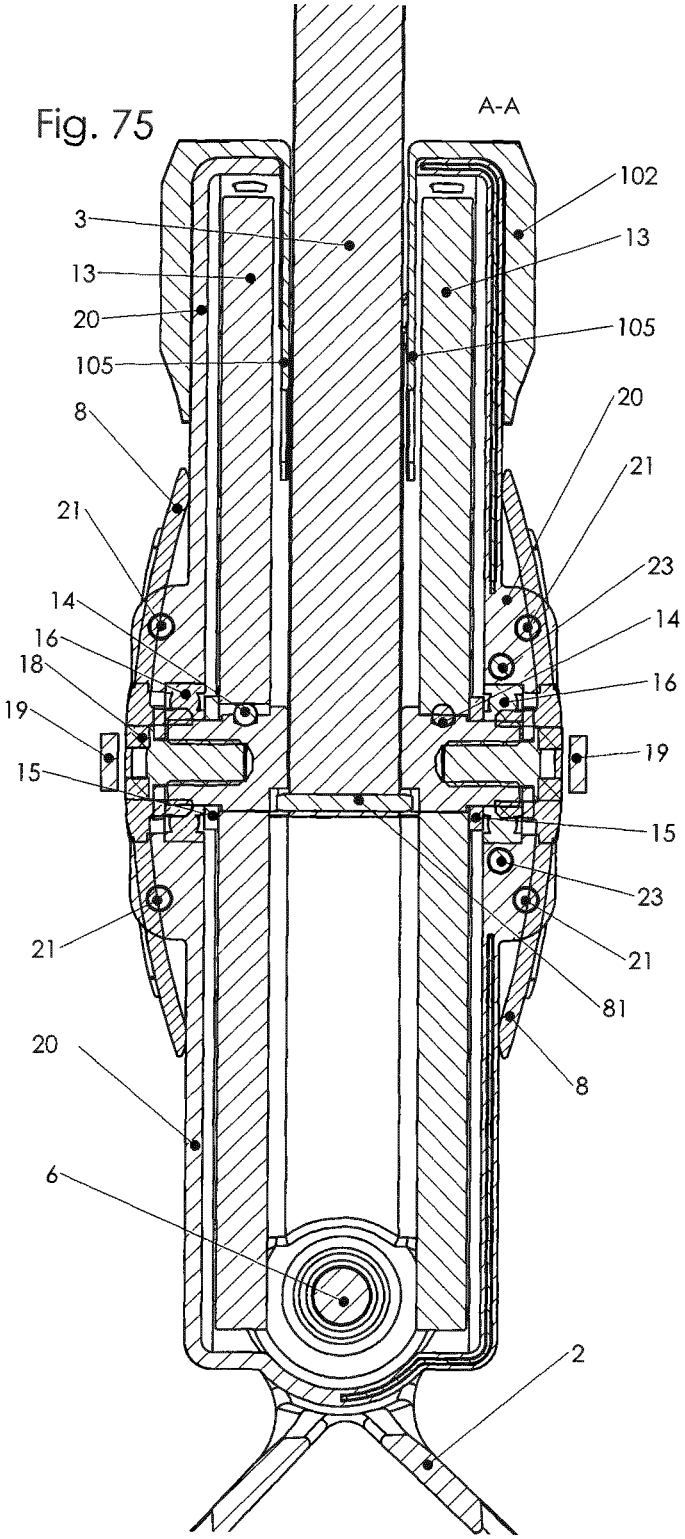

117
117
120

117
117

116
A
A
117
117

116
119
119
117

118
118
118
118

117
116

120
2
117

117
2
116

116
2
117

2
120
117

118
116
117
120
117
2

125
123a
124
124a
122

121
125
123
6

123b
123a
124
122

125
122

123
125
123
124
127

123
125

123a
123b
127
124

127
123b
123b 124
124a
127

127
125
123

128
4

128
129
3
4

128
132
133
133
3
131
130
132
129

132
128
A
132
3
44
43
40
42
4
A

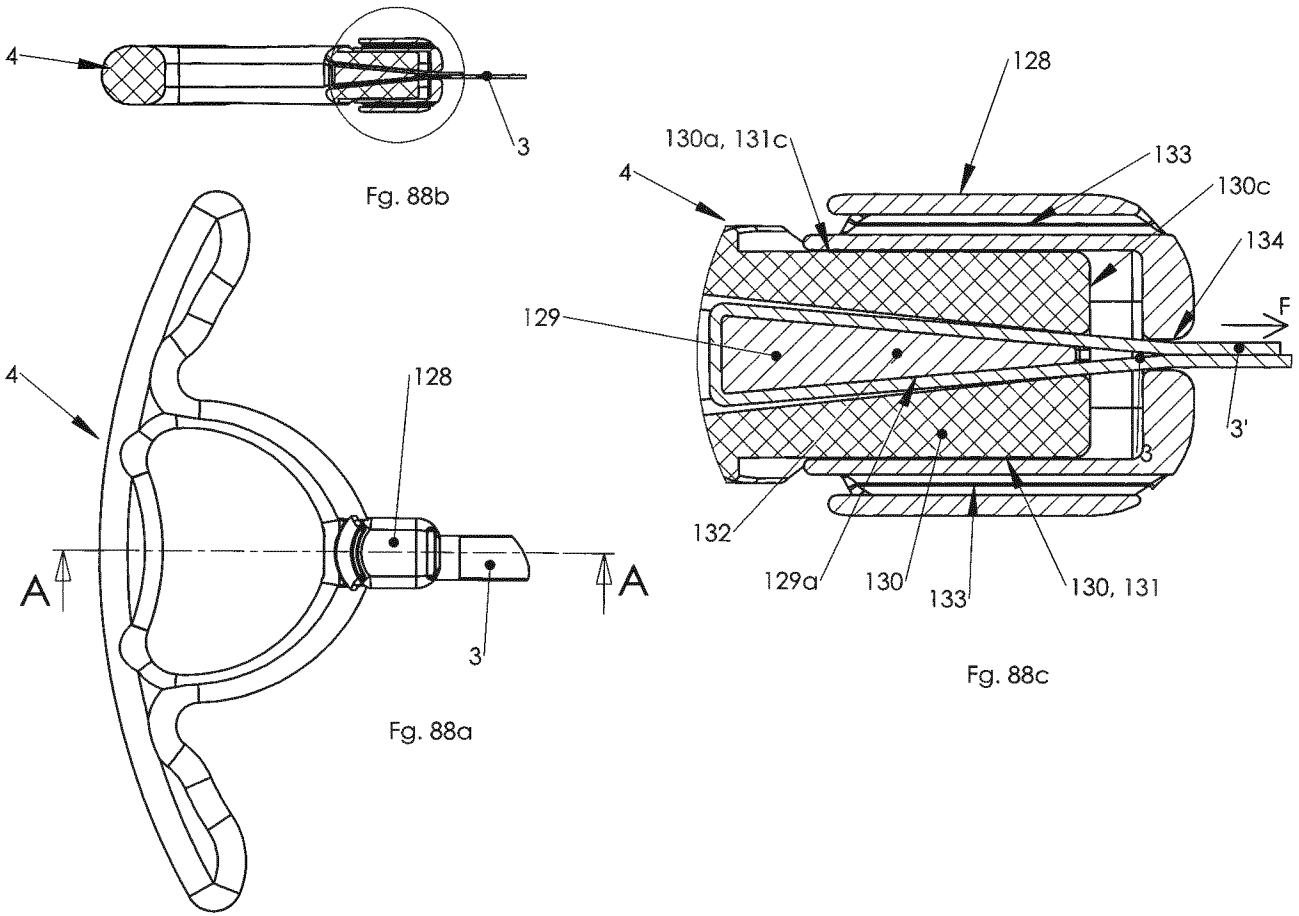
Fg. 88c
Fg. 88b
Fg. 88a

Fig. 93a
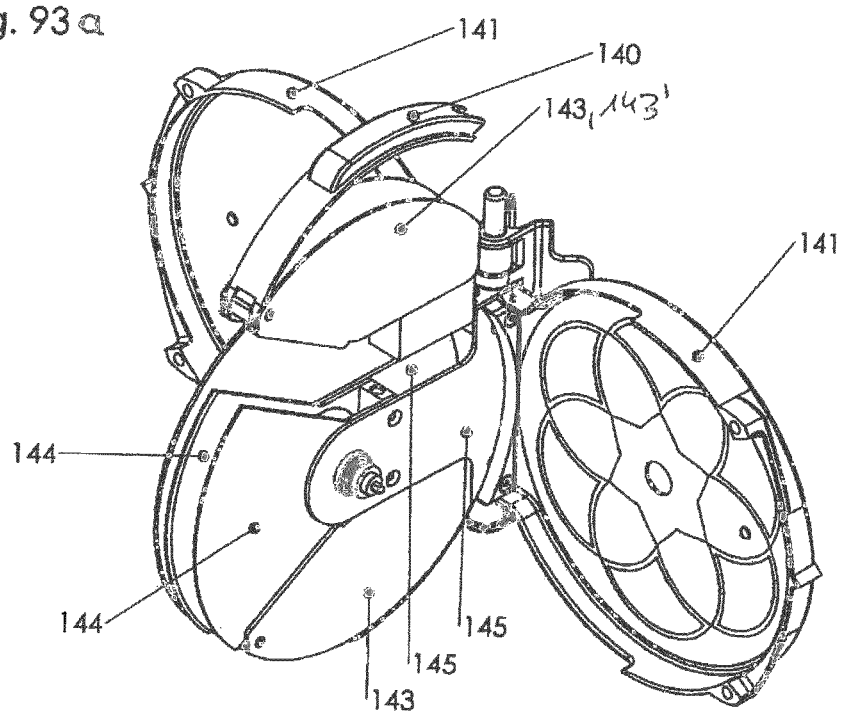
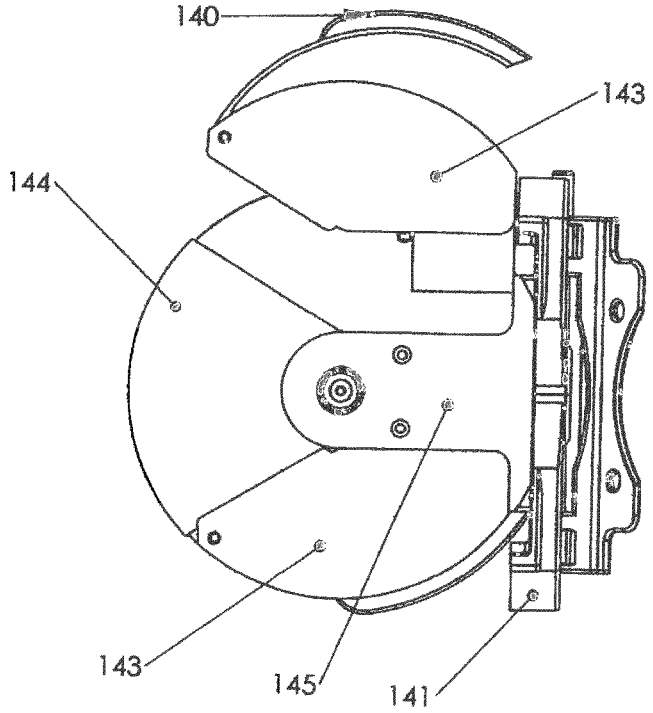
Fig. 93b 148
210
208

A
A
210a
210
208

149

149
210

208

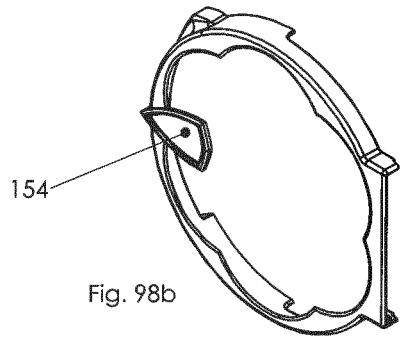
Fig. 98b
Fig. 98a
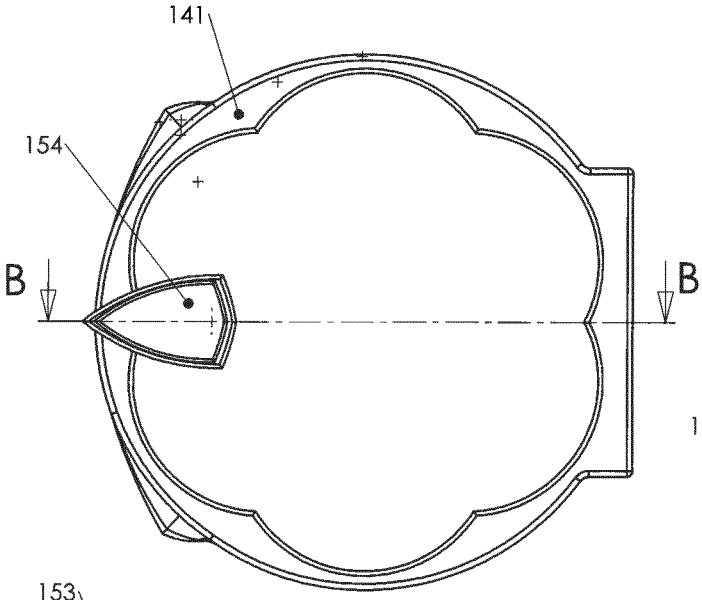
Fig. 98d
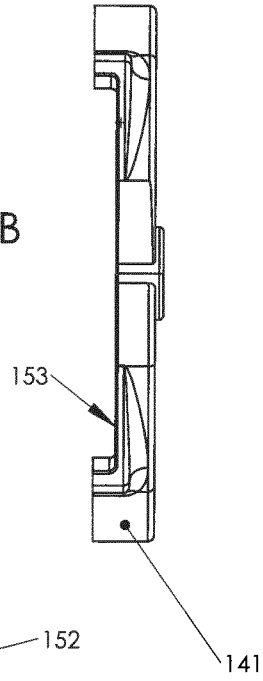
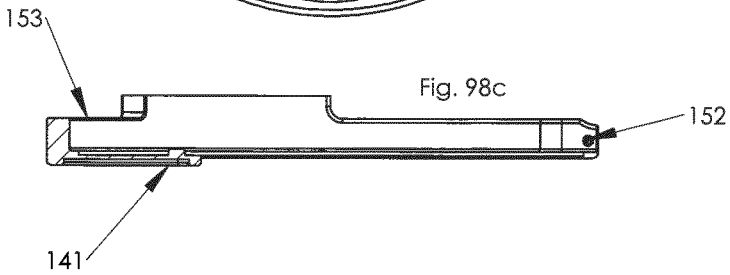
Fig. 98c 35
3
9.2
358
2, 21
9.2

2, 21
358
9.2

2, 21
37
3

37
AG
358

363
358
AG

37
AG
AG 358
37
AG
12'
368

Figures 103A, 103B, 103C, 103D:
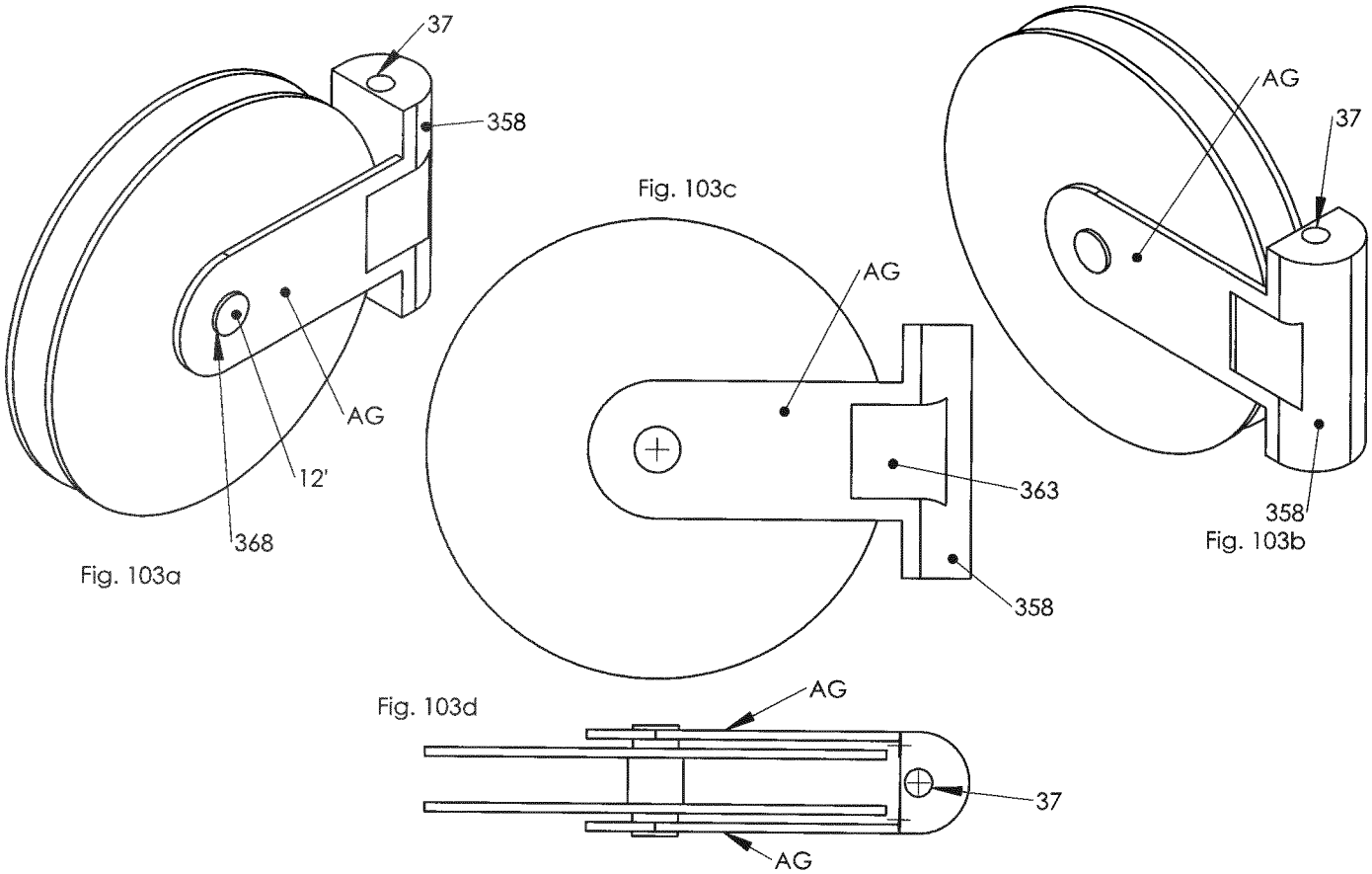
Figures 105A, 105B, 105C, 105D, 105E, 105F, 105G:
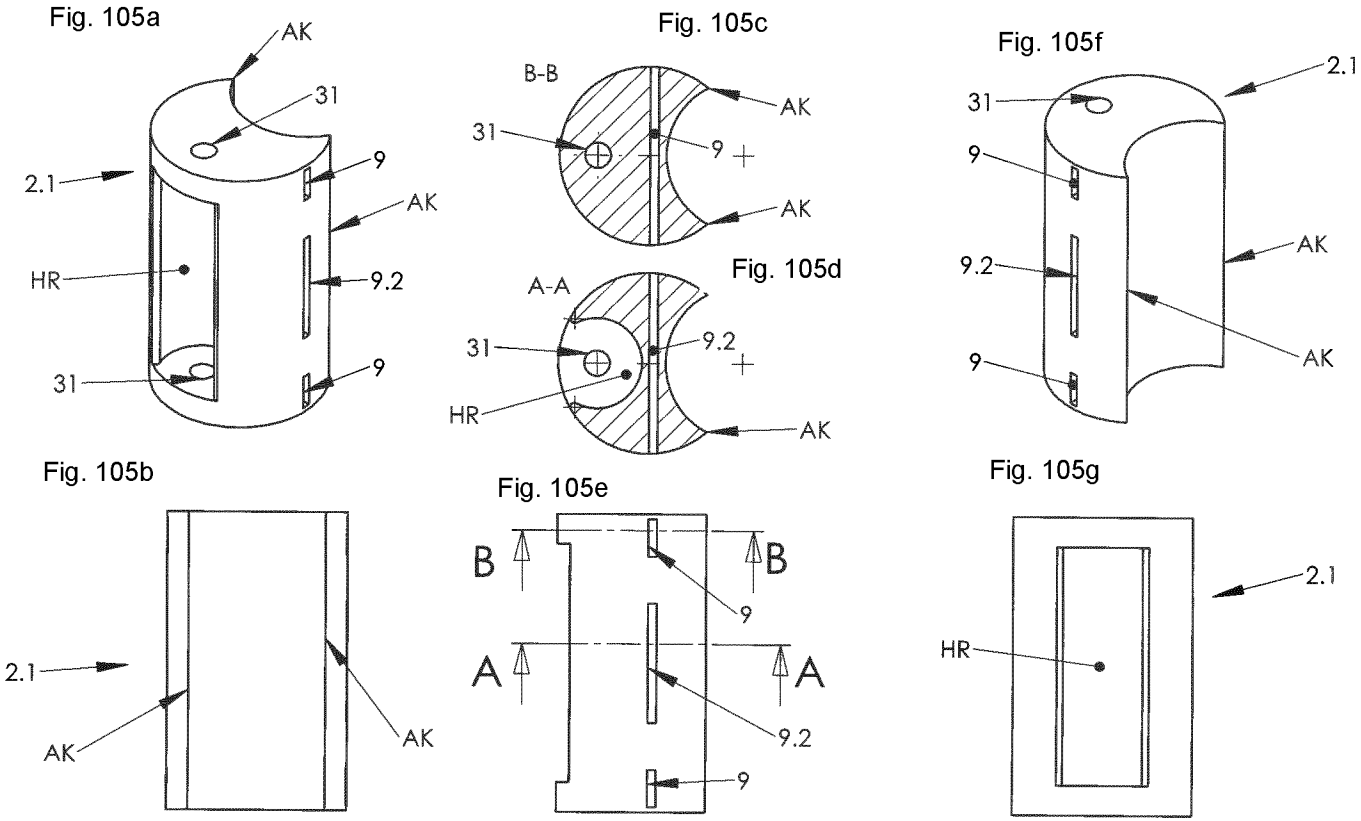
Figures 106A, 106B, 106C, 106D, 106E, 106F, 106G:
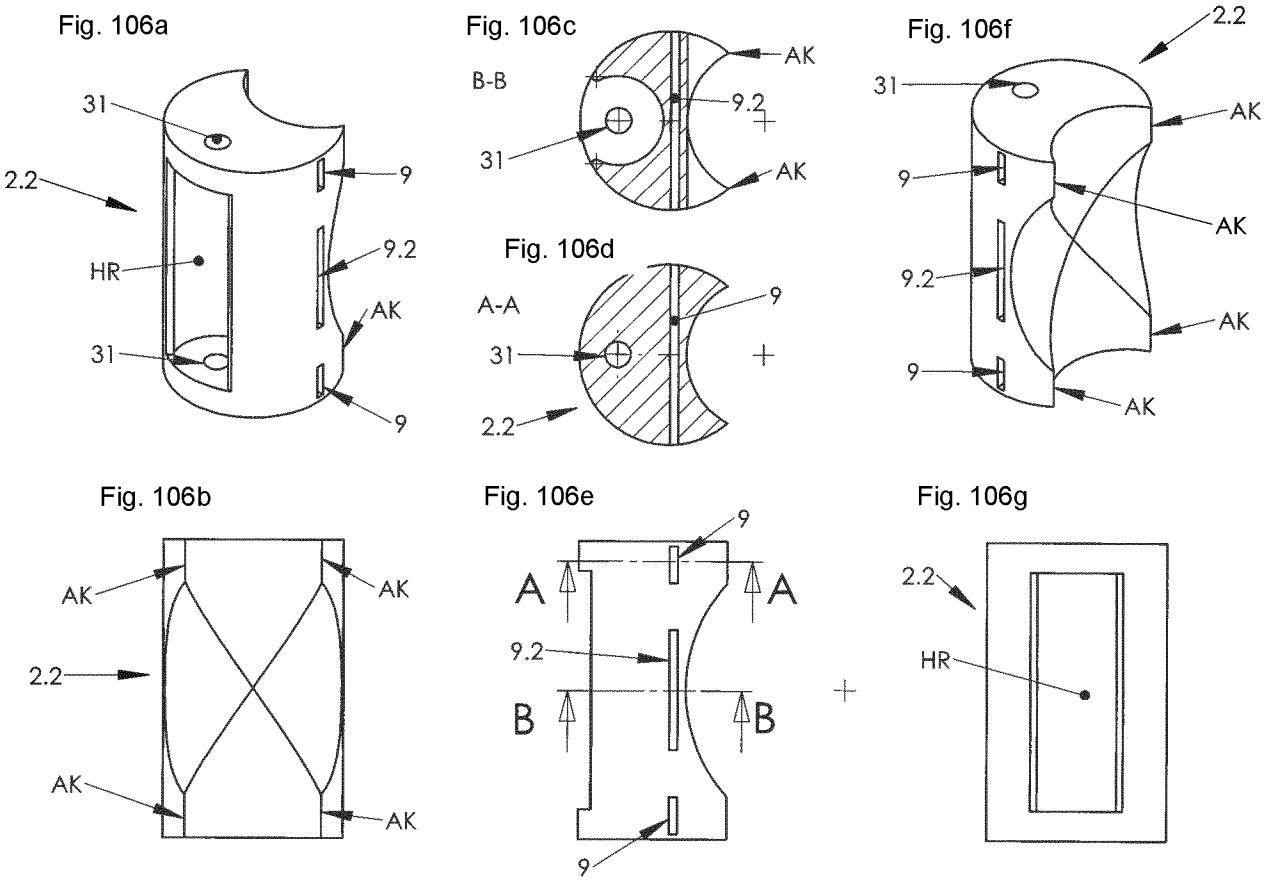
Figures 107A, 107B, 107C, 107D, 107E, 107F:
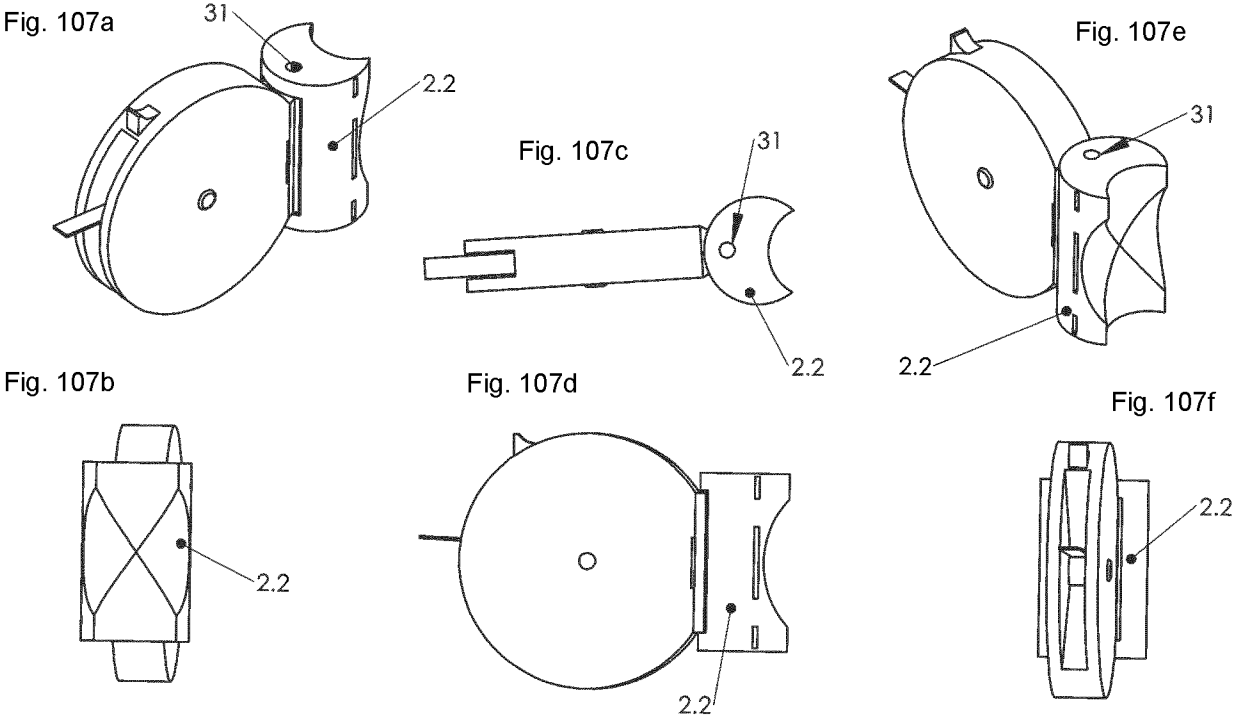

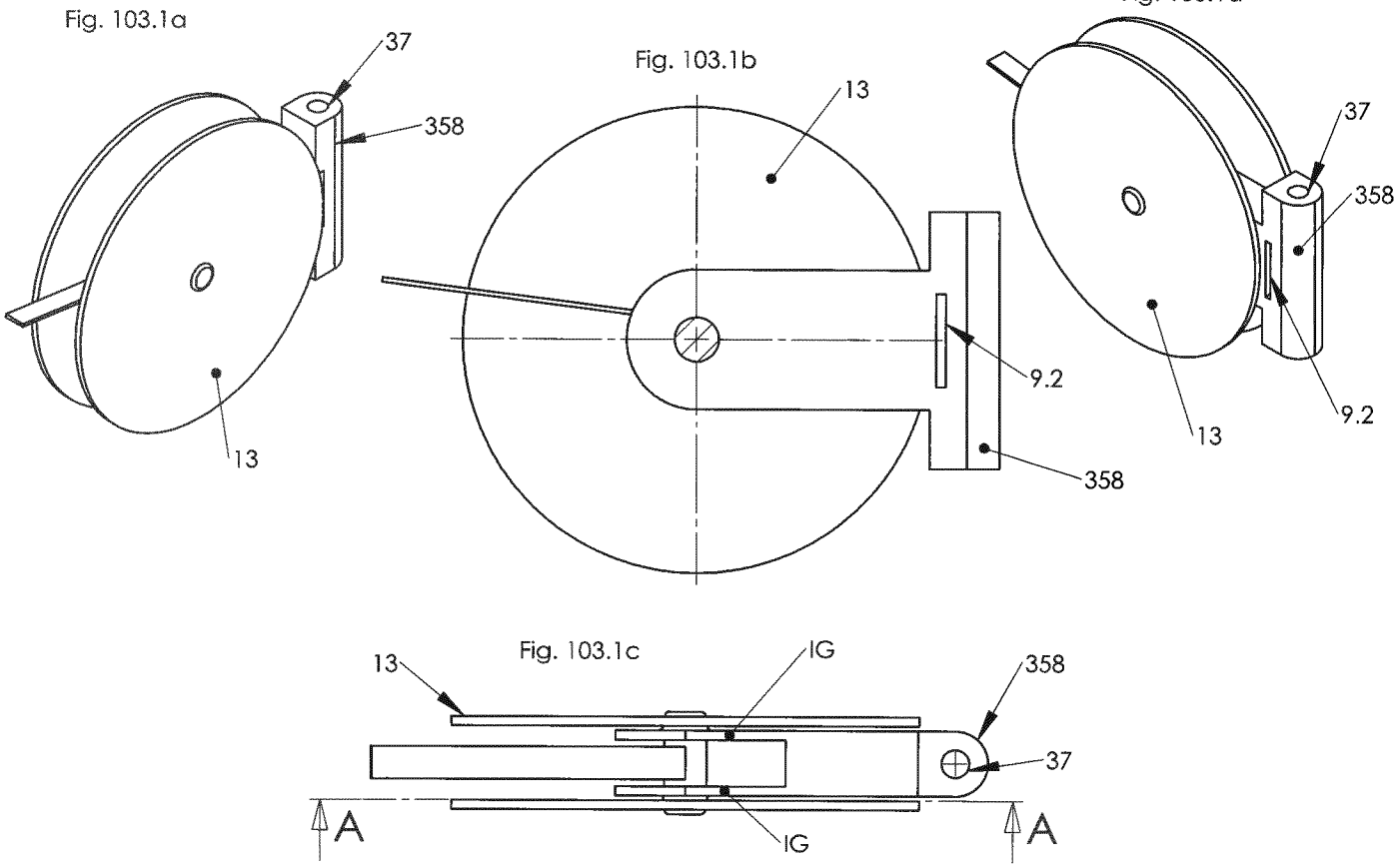
37
358
9.2
13
Fig. 103.1d
358
9.2
13
Fig. 103.1b
358
37
13
Fig. 103.1a
358
37
A
IG
IG
13
A
Fig. 103.1c

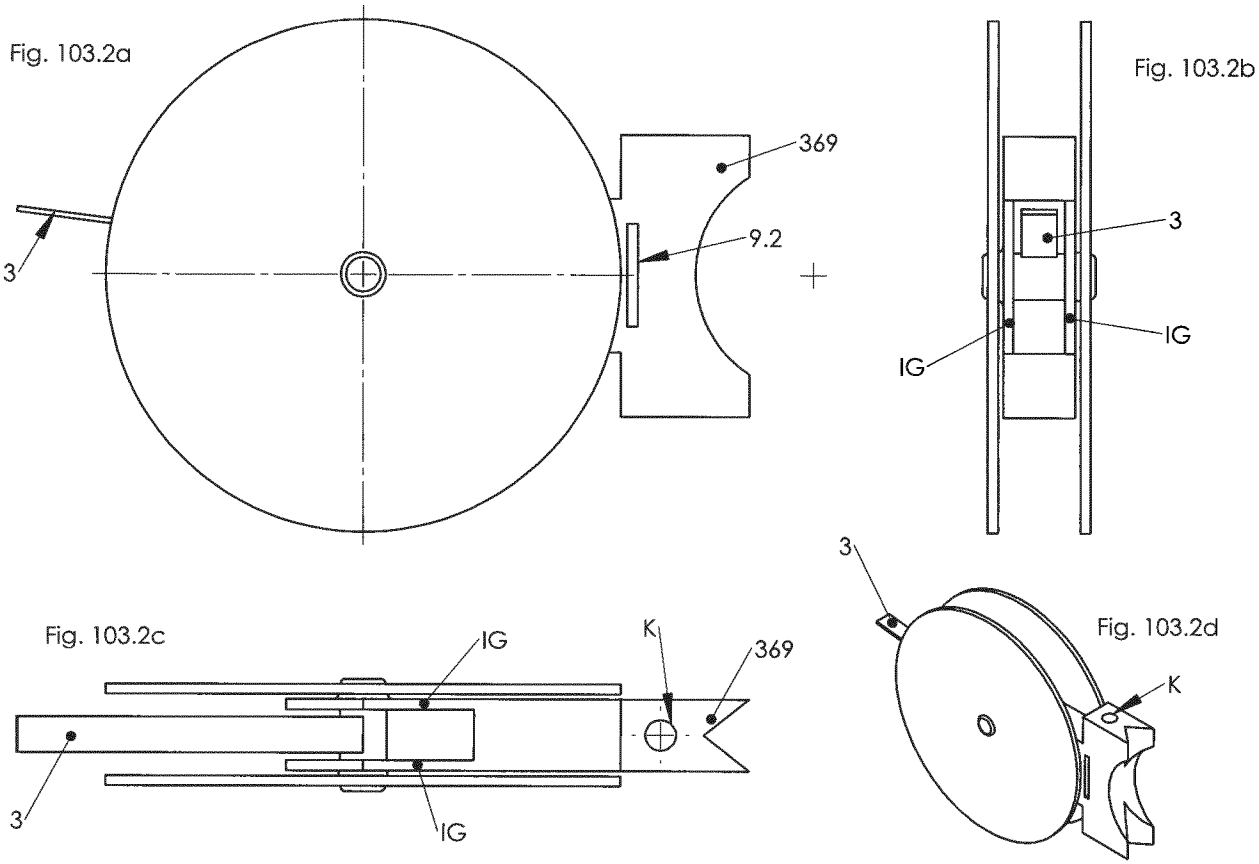
Fig. 103.2b
3
IG
IG
Fig. 103.2d
K
3
369
9.2
Fig. 103.2a
3
369
K
IG
IG
Fig. 103.2c
3

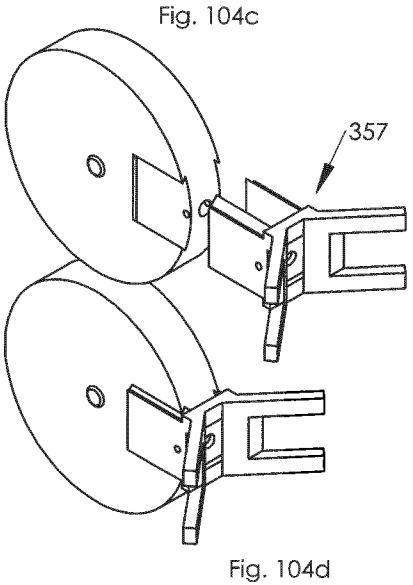
Fig. 104c
Fig. 104d
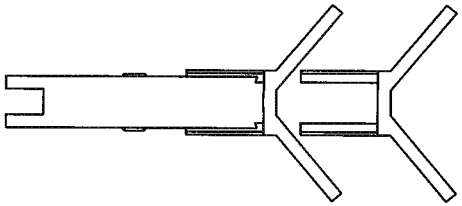
Fig. 104e
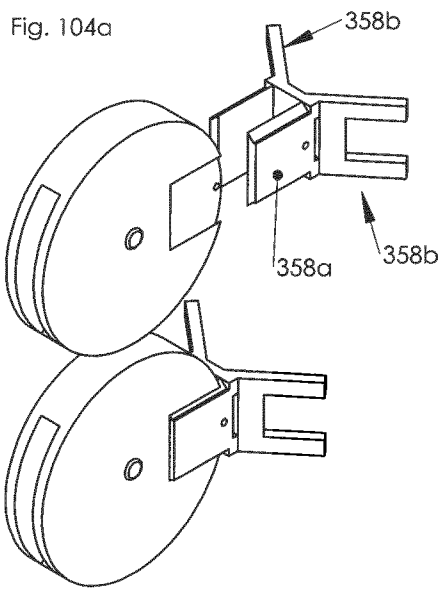
Fig. 104a
Fig. 104b

AK
31
9
AK
9.2
9
2.1
HR
31

AK
2.1
AK

AK
AK
9
B-B
31

AK
9.2
A-A
31
HR

B
B
9
A
9.2
9
A 2.1
AK
AK
31
9
9.2
9

2.1
HR 31
2.2
HR
31
9
9.2
AK
9

AK
AK
2.2
AK
AK

B-B
31
9.2
AK
AK

A-A
31
2.2
9

A
A
9.2
B
B
9
9

31
9
9.2
9
AK
AK
AK
AK
2.2

2.2
HR

KINETIC WORKOUT STATION

I. BACKGROUND OF THE PRESENT INVENTION: CONTEXT OF THE INVENTION AND PROBLEMS

Current fitness machines are constructed to train muscles by subjecting them to loads. To do so, weights are used in the following manner:

- Static weights which are raised or displaced, based on gravitational force, and
- Rotating weights in the form of plates, which are moved in a rotational motion by means of muscle power, wherein gravity no longer plays a role here.

During training with static weights, loading the muscles is constant and monotonous, e.g., because when lifting a 10-kg dumbbell, the muscles are subjected to a load of 10 kg during the entire workout period, regardless whether one moves the arm holding the weight up or down, or one only lets the arm hang passively. This load does not allow for any rest during training. One must continuously take training breaks and place the weight down to rest the muscles and tendons, to then start with the loading process again and again.

In addition, prior publications are known which describe a fitness device that operates using a flywheel. One shall refer to the prior publications U.S. Pat. No. 4,632,392 as well as U.S. Pat. No. 5,242,351.

In the mentioned prior publications, a cylindrical plate, as used for fitness training, is fitted on a supported shaft. The shaft is made to rotate by the tangential exertion of a tensile force on a flexible belt that is initially wound up. Due to the stored kinetic energy, the shaft continues to rotate along with the plate, even after the belt has been entirely unwound. Consequently, the belt is wound up in the other direction without influence of muscle force (as with a "yo-yo"). A training double-cycle is thereby created. In the first phase, the muscle exerts a pulling force to accelerate the plate. In the second phase, the muscle is needed to decelerate a tensile force caused by the rotating plate and initiated on the pulling element. Between the two phases, the muscle could rest for a brief period, as the training individual desires.

The problems of known flywheel devices:

A series of problems are known regarding the known devices, namely

- the devices are very heavy because they are assembled with a fixed and heavy base and can therefore in most cases not be taken along and used in locations other than the fixed location specially selected for them,
- adjusting the length of the belt is usually very time-consuming,
- they have a large volume, are very massive and statically oversized, are very heavy, and can only be shipped at high shipping costs,
- they require a large storage area and a large amount of space for training, which is done almost exclusively indoors,
- they are very expensive and for this reason as well, only top athletes or professional sports clubs can afford them.

II. OBJECT OF THE PRESENT INVENTION

In view of this, it is the object of the present invention to create an improved training device and/or improved training device components and/or add-on parts.

The object is achieved according to the invention pursuant to the independent claims. Advantageous embodiments of the invention are provided in the dependent claims.

By means of the present invention, a series of improvements is created, including for example:

- a lightweight, portable, compact, affordable training device is proposed within the scope of the invention;
- the device according to the invention is constructed in a modular manner, wherein the solid, heavy foundation or base has been entirely eliminated and replaced by multiple, partially universal connection adapters, which allow attachment to a sturdy or stationary base;
- the training device according to the invention offers the possibility to be secured anywhere as needed, indoors or outdoors, to enable training with the device;
- training with the training device according to the invention is done using a novel hand grip, by means of which one can choose to train with one or both hands;
- preferably, it is possible within the scope of the invention to perform infinitely variable adjustment of the length of the pulling element using novel couplings between the hand grip and the pulling element (preferably a pull strap) in a simple, convenient manner;
- on the training device according to the invention, the training force can be exerted not only with the hand, but also with other body parts using special body wraps;
- in addition, if required, mechanical and/or electrical or electronic accessories may be mounted on the strength training machine, i.e., preferably built in, to improve and measure user-friendliness, such as the fun factor for example, and to train together by connecting to social media;
- lastly, in a variation and/or development of the invention, electricity can also be generated within the scope of the training session.

III. ACHIEVING THE PRESENT INVENTION

Figure 1:
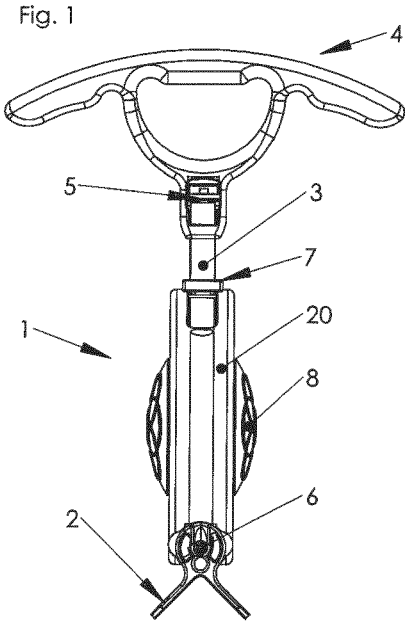
Figure 2:
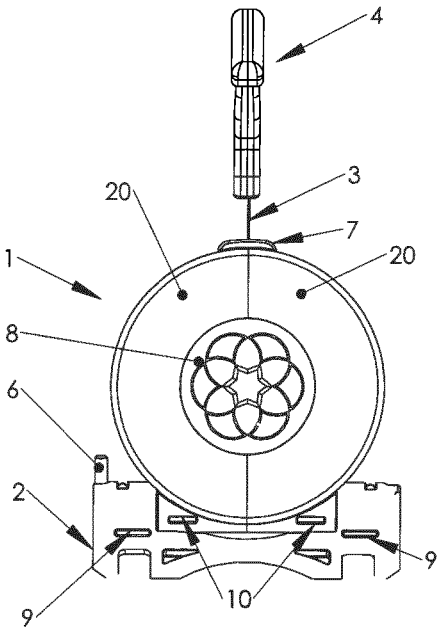
Figure 3:
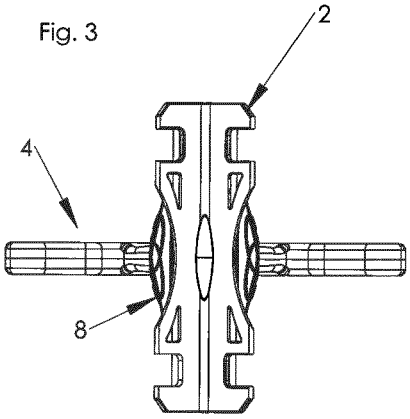
Figure 4:
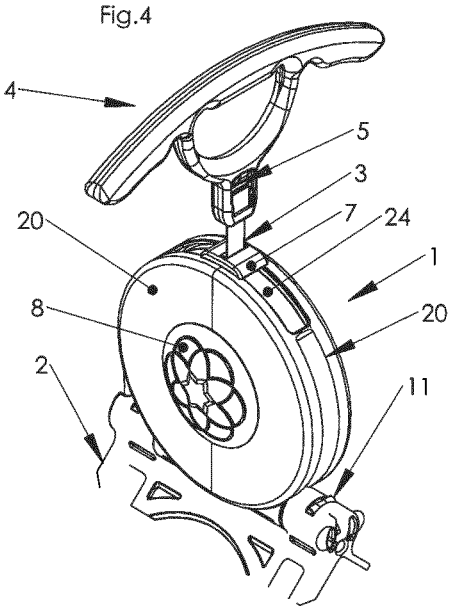
Figures 5, 6, 7:
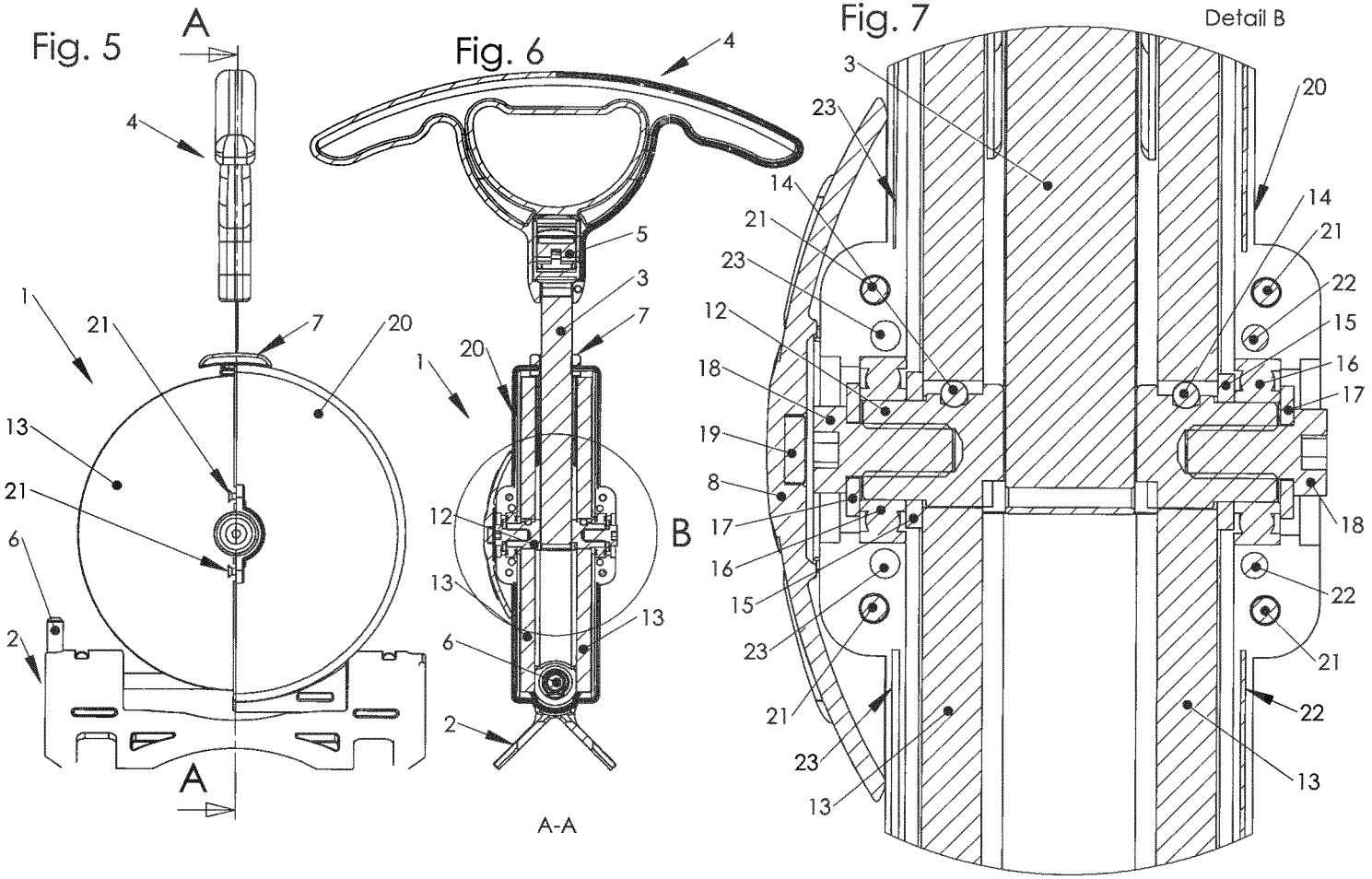
Figure 9:
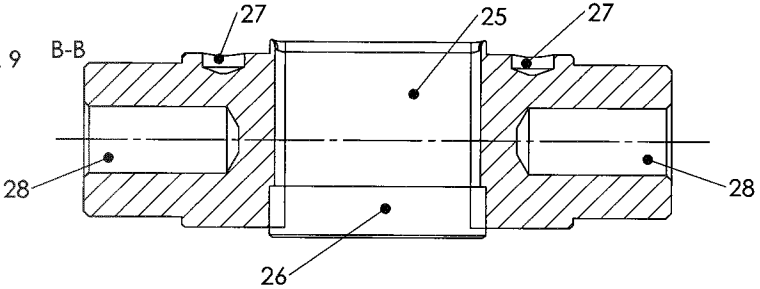
Figure 8:
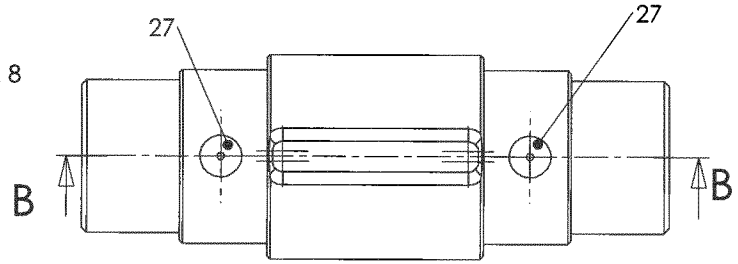
Figure 11B:
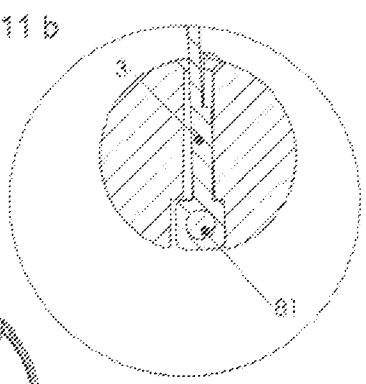
Figure 11D:
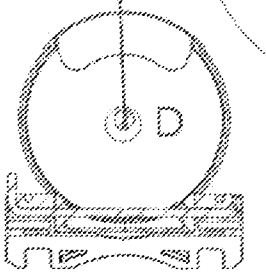
Figure 11C:
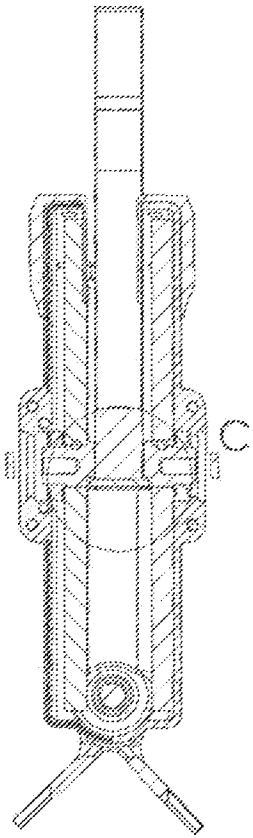
Figure 11A:
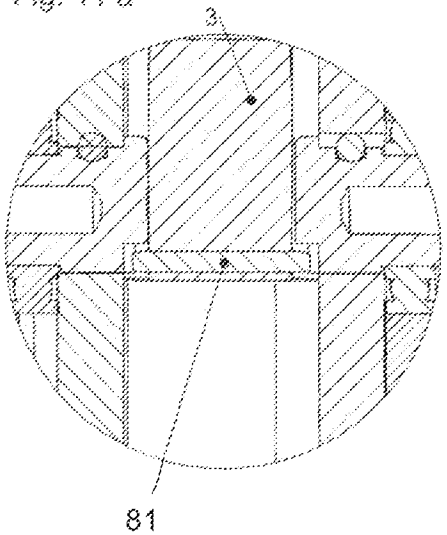

The solution according to the invention is based on using a flywheel weight in the sense of the invention as an energy source for training purposes. Additional advantages, details and features of the invention are found in the exemplary embodiments described below by means of drawings:

FIG. 1: shows the training device according to the invention in an overhead view;

FIG. 2: shows a side view of the training device according to the invention;

FIG. 3: shows a rear view of the training device according to the invention;

FIG. 4: shows a perspective view of the training device according to the invention;

FIG. 5: shows the training device shown by the figures represented above, with half the housing omitted;

FIG. 6: shows the training device according to the invention in a cross-sectional view;

FIG. 7: shows a detailed view of FIG. 6;

FIG. 8: shows a shaft in an overhead view;

FIG. 9: shows the shaft shown in FIG. 8 in a cross-sectional view;

FIG. 10: shows the shaft shown in FIGS. 8 and 9 in a perspective view;

FIGS. 10.1*a* to 10.1*h*: show a shaft for installing a special "shock-damping system" to damp the shock at the "dead point"

Figures 12, 13, 14, 15, 16:
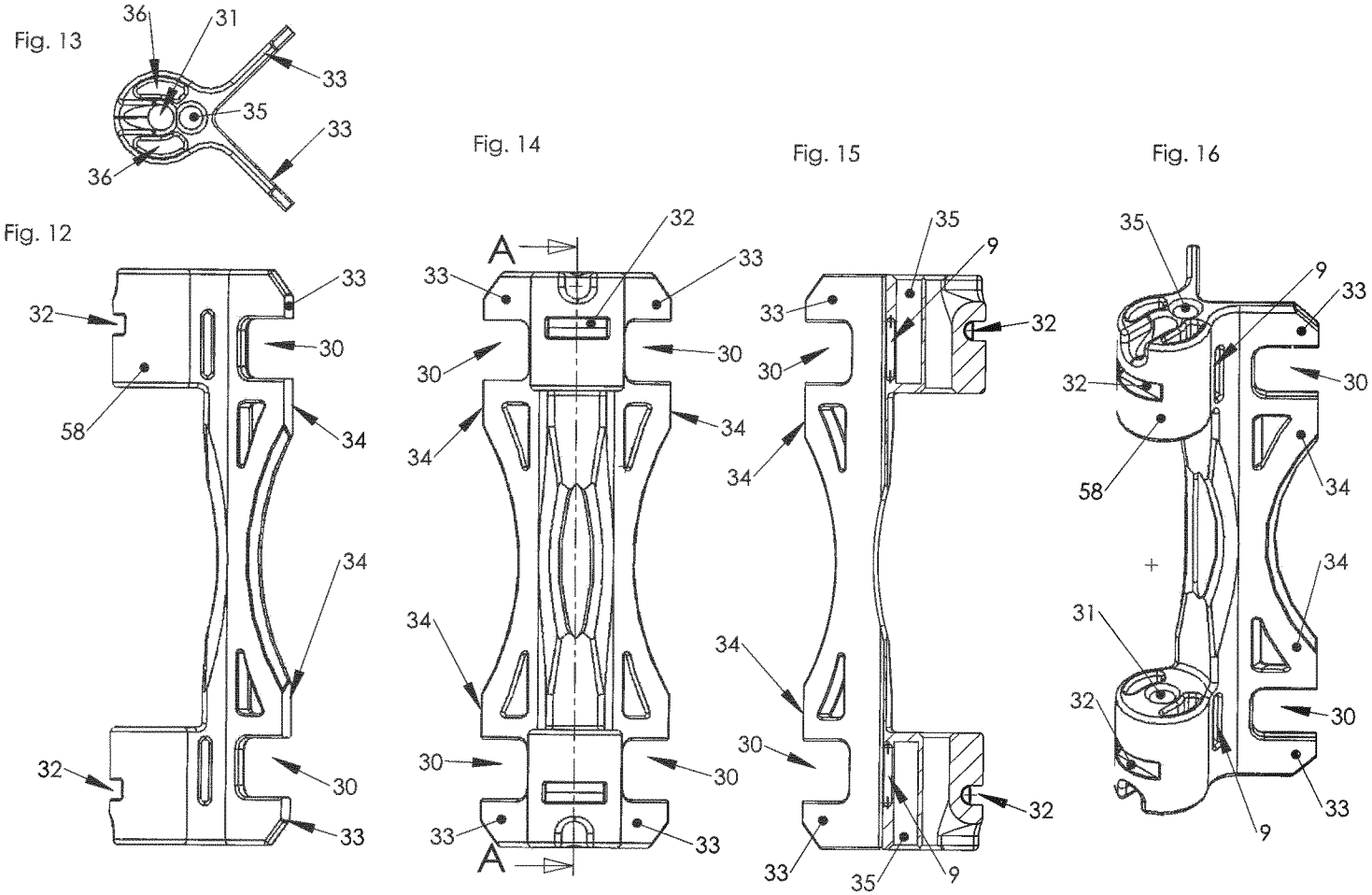
Figure 18:
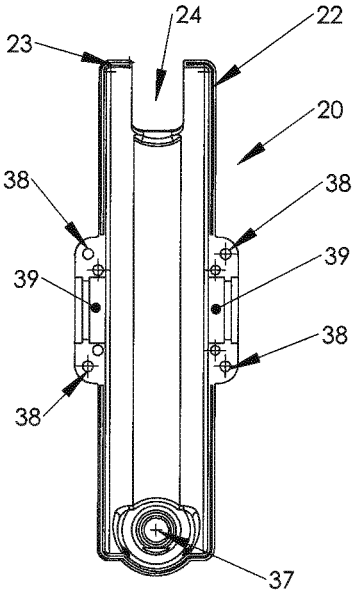
Figure 19:
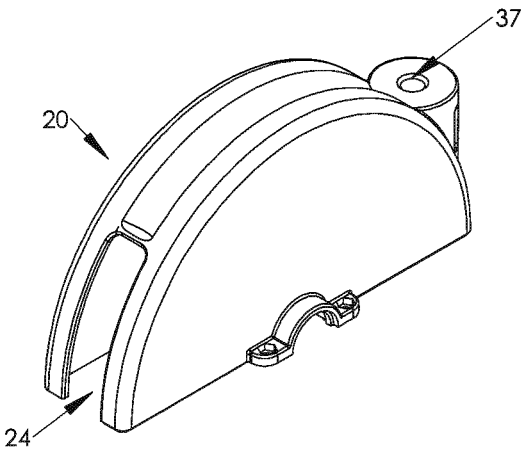
Figure 17:
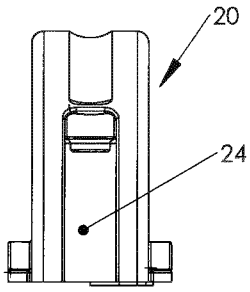
Figure 20:
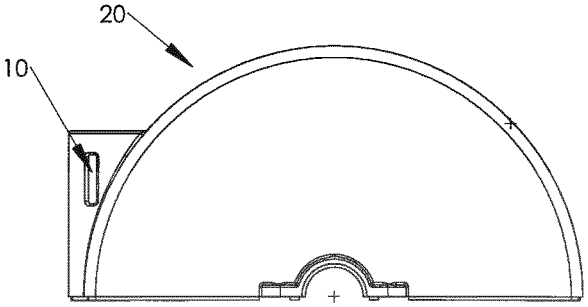
Figure 21:
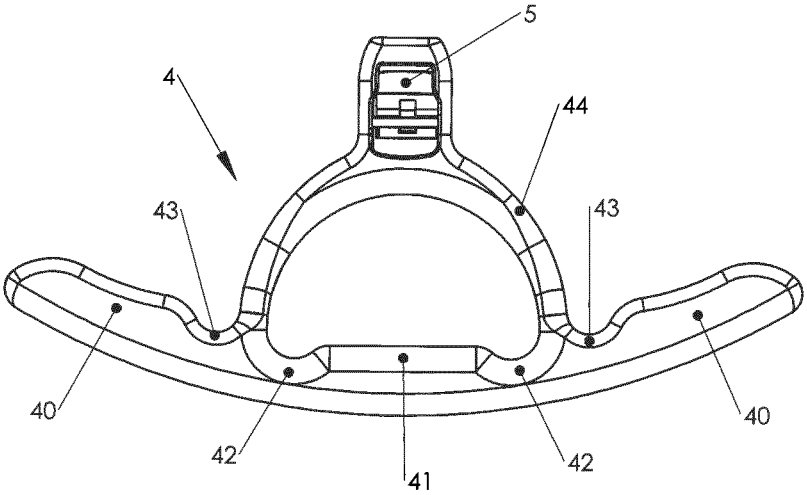
Figure 21A:
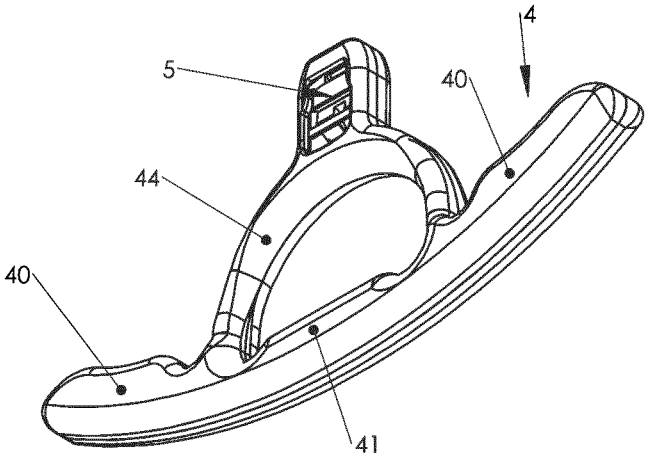
Figure 22C:
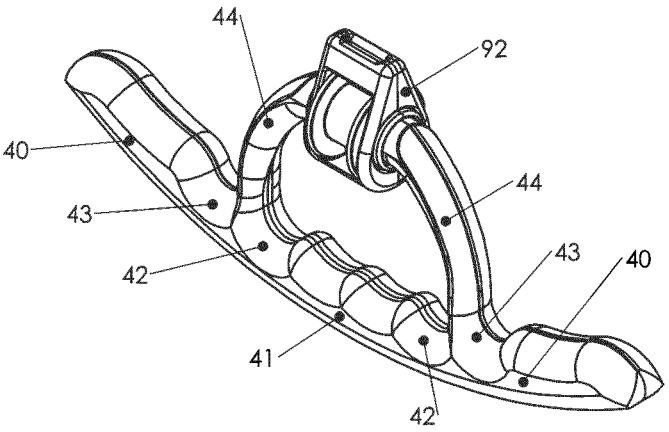
Figure 22A:
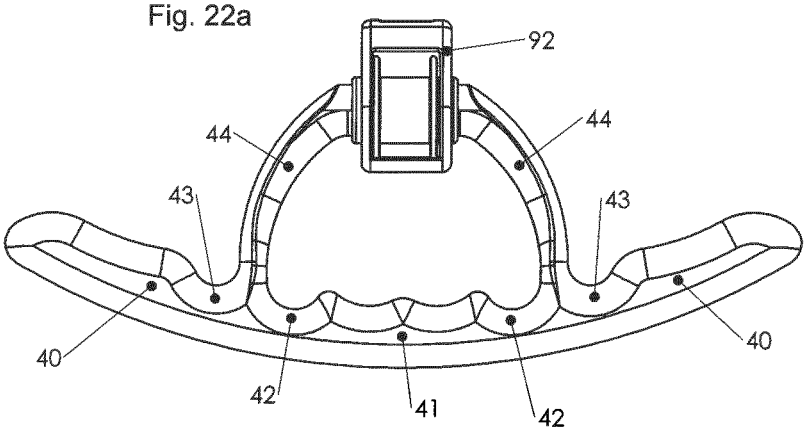
Figure 22D:
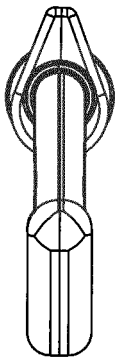
Figure 22B:
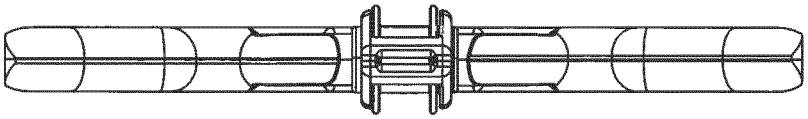
Figure 23A:
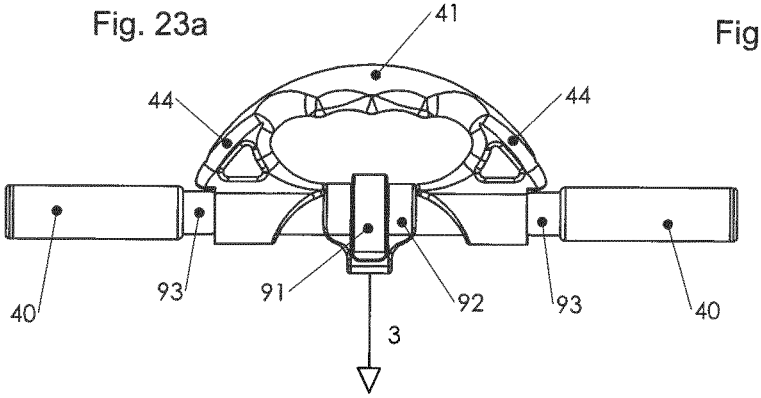
Figure 23C:
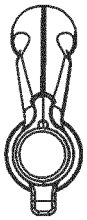
Figure 23B:
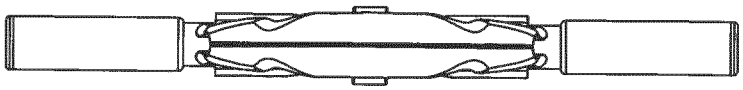

FIGS. 10.2*a* to 10.2*d*: show a shaft with a wedge-shaped recess for attaching the pulling element and possibly bayonet-like couplings on the end;

FIGS. 10.3*a* to 10.3*g*: show a foldable wedge for attaching the end of the pulling element and its mounting in the shaft;

FIGS. 10.4*a* to 10.4*f*: show placement of the end of the pulling element in the foldable wedge and installing it in the wedge-shaped recess on the shaft;

FIGS. 11*a* to 11*d*: show representation of mounting options for a pulling element on a shaft;

FIG. 12: shows an attachment module in a side view;

FIG. 13: shows the attachment module shown in FIG. 12 in an overhead view;

FIG. 14: shows the attachment module shown in FIGS. 12 and 13 in a frontal view;

FIG. 15: shows the attachment module shown in FIGS. 12 to 14 in a cross-sectional view;

FIG. 16: shows the attachment module shown in FIGS. 12 to 15 in a perspective view;

FIGS. 16*a* to 16*f*: show an exemplary embodiment, slightly modified in relation to FIGS. 12 to 16, for a larger adapter;

FIGS. 16*g* to 16*j*: show an additional modified exemplary embodiment in which the strength module can be immovably mounted by using a mounting rail and is thereby held and/or securable if necessary in a longitudinally displaceable manner by means of corresponding retaining adapters on the rail or mounting rail;

FIG. 17: shows a half-housing variant in a frontal view;

FIG. 18: shows the half-housing variant shown in FIG. 17 as seen from below;

FIG. 19: shows the half-housing shown in FIGS. 17 and 18 in a perspective view;

FIG. 20: shows the half-housing shown in FIGS. 17 to 19 in a side view;

FIG. 21: shows a hand grip fabricated in one piece having a coupling for a pulling element as seen from above;

FIG. 21*a*: shows an illustration as represented in FIG. 21, but in a perspective view;

FIGS. 22*a* to 22*d*: show an exemplary embodiment, slightly modified in relation to FIGS. 21 and 21*a*, having a different grip design and an additionally provided reel for winding up the pull strap;

FIG. 23: shows a hand grip constructed in a modular manner, in a perspective view;

FIGS. 23*a* to 23*c*: show additional illustrations of the hand grip shown in FIG. 23;

FIGS. 23.1*a* and 23.1*b*: show a novel, ergonomic hand grip which offers the possibility of connecting the hand grip in the region of the middle arc/central arc using a "ring-shaped coupling" (such as a ring, carabiner and so on—not depicted) to a pulling element in a fixed or detachable manner.

Figure 24C:
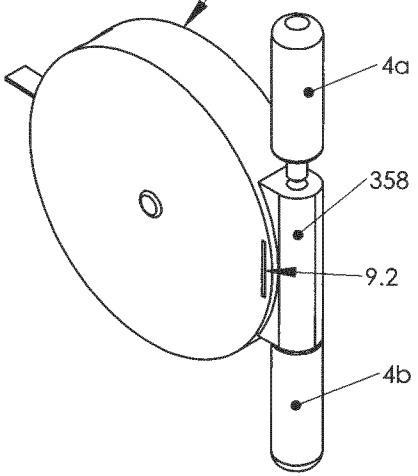
Figure 24A:
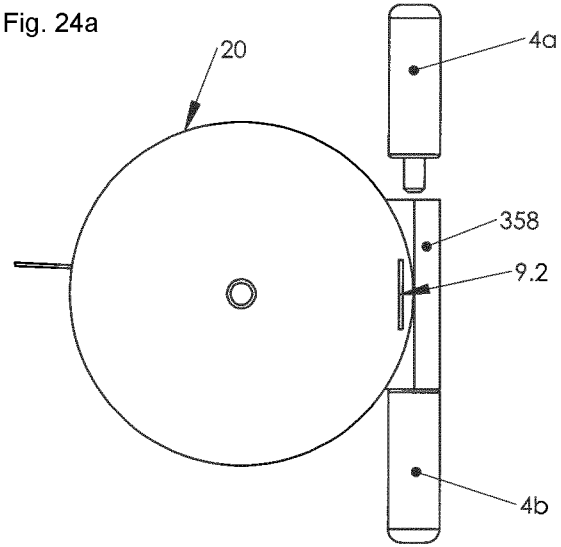
Figure 24B:
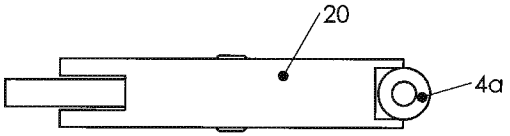
Figure 27:
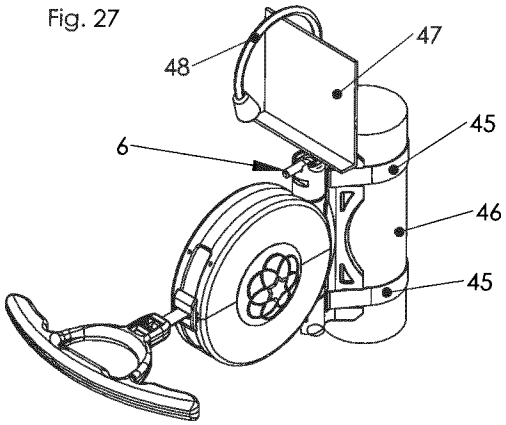
Figure 28:
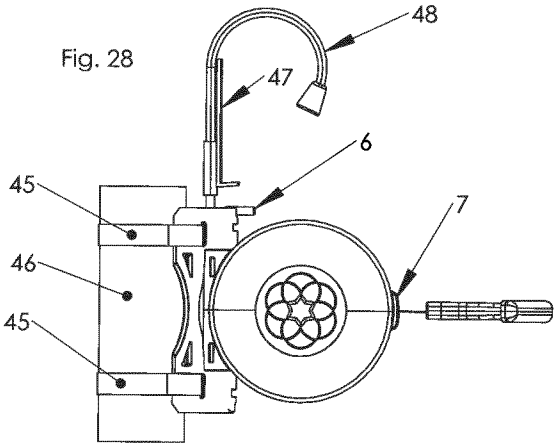
Figure 25:
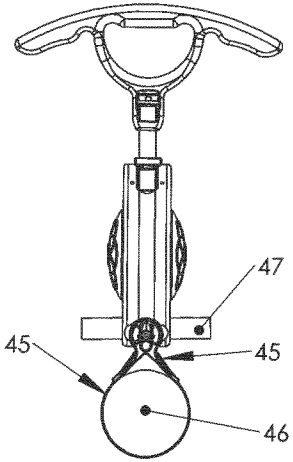
Figure 26:
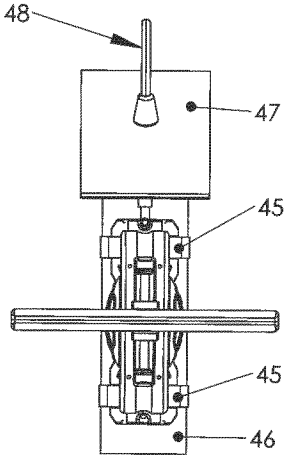
Figure 30:
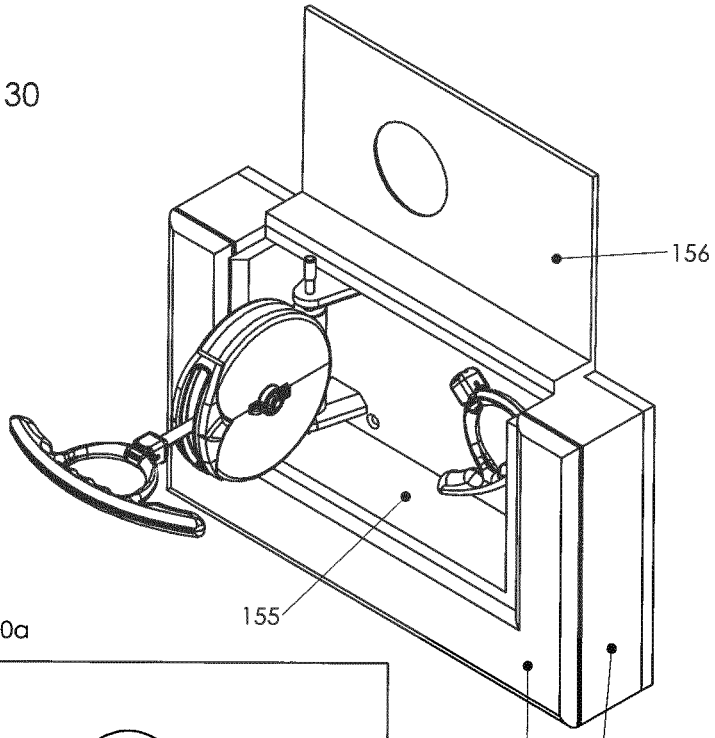
Figure 30A:
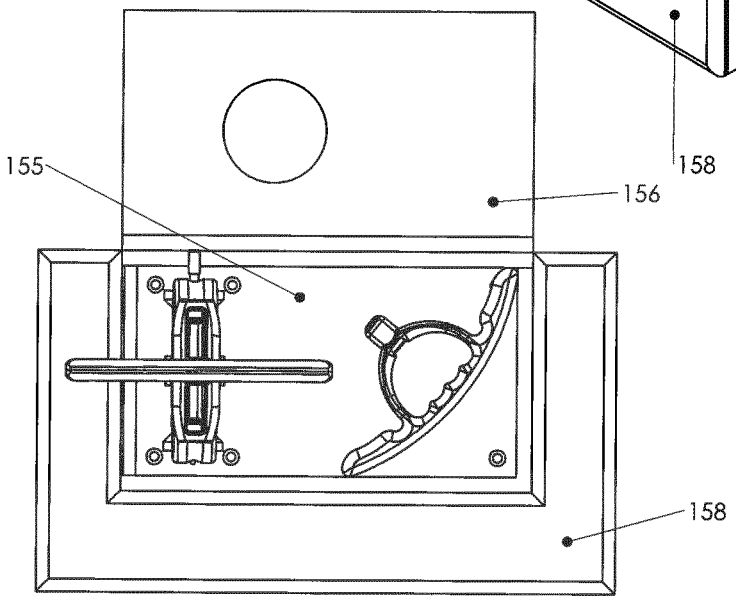
Figure 31:
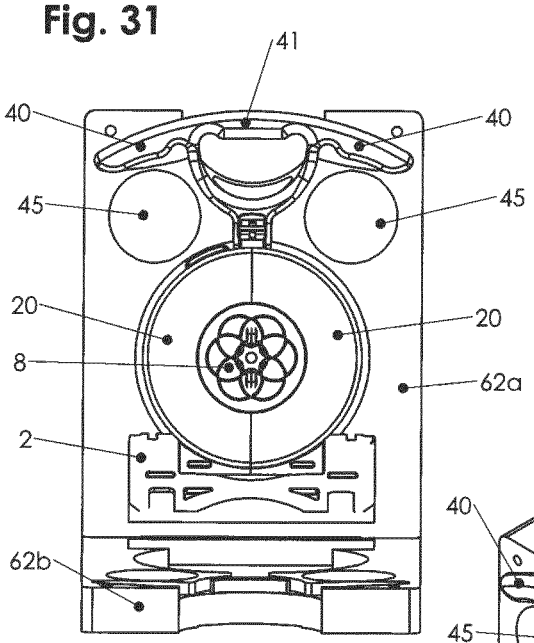
Figure 32:
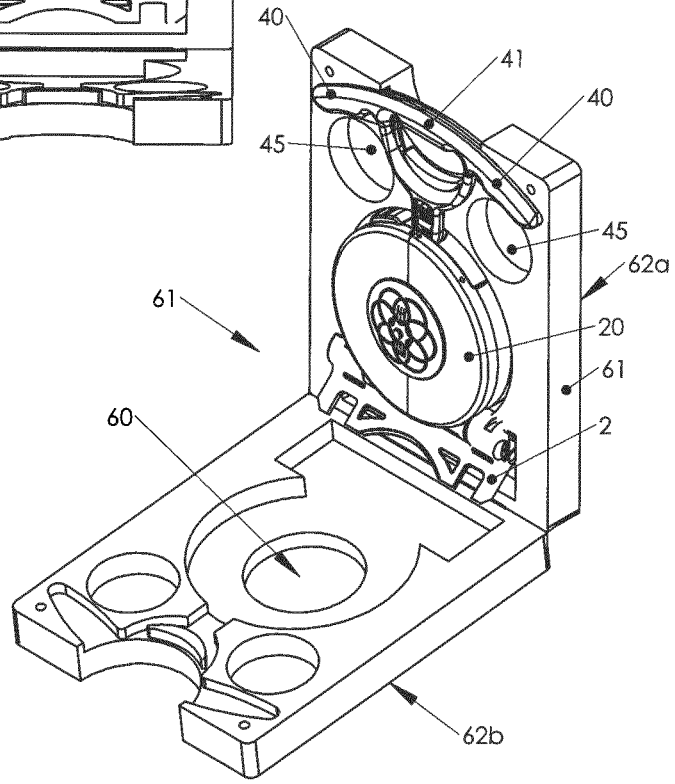
Figure 32A:
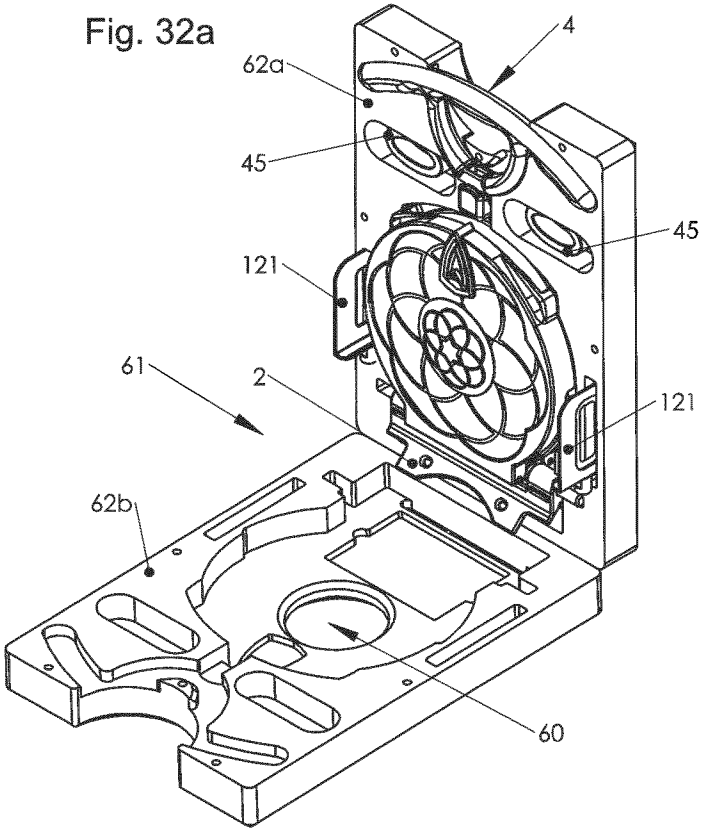
Figure 31A:
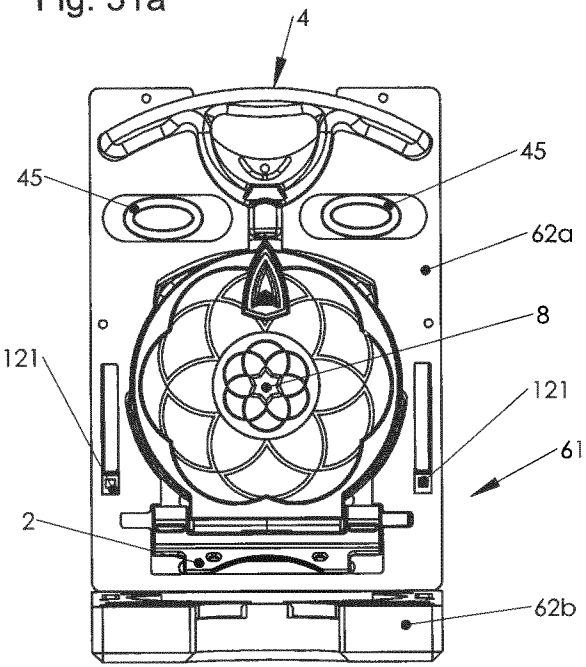
Figure 33:
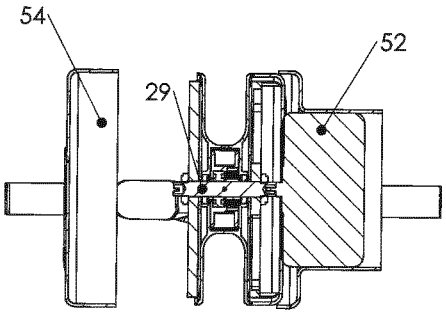
Figure 35:
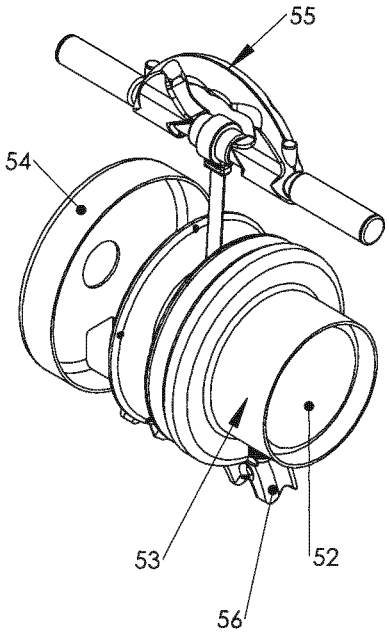
Figure 34:
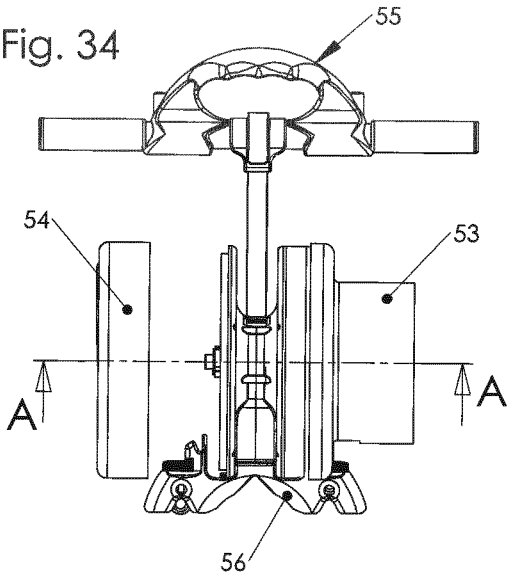
Figure 37:
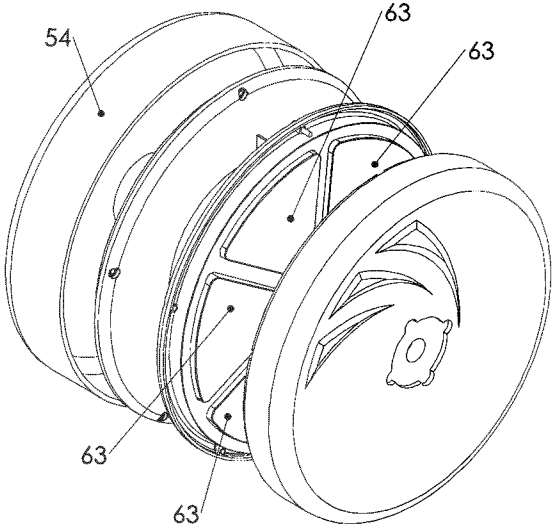
Figure 37A:
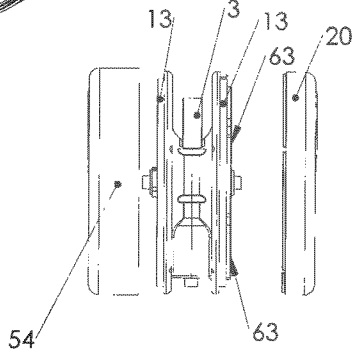
Figure 36:
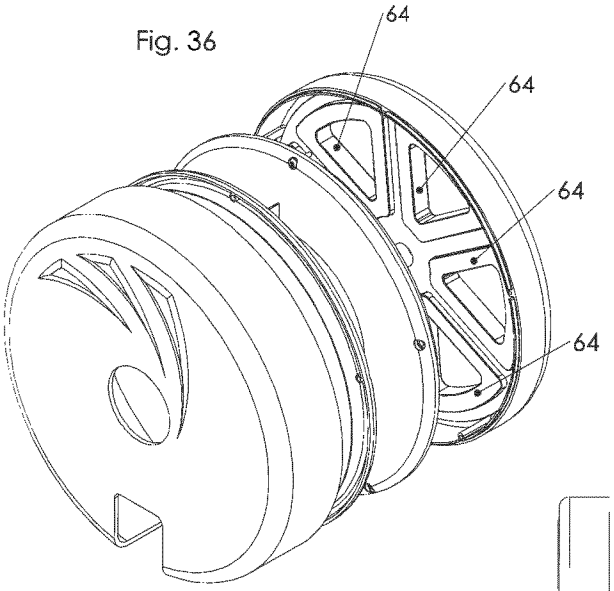
Figure 39:
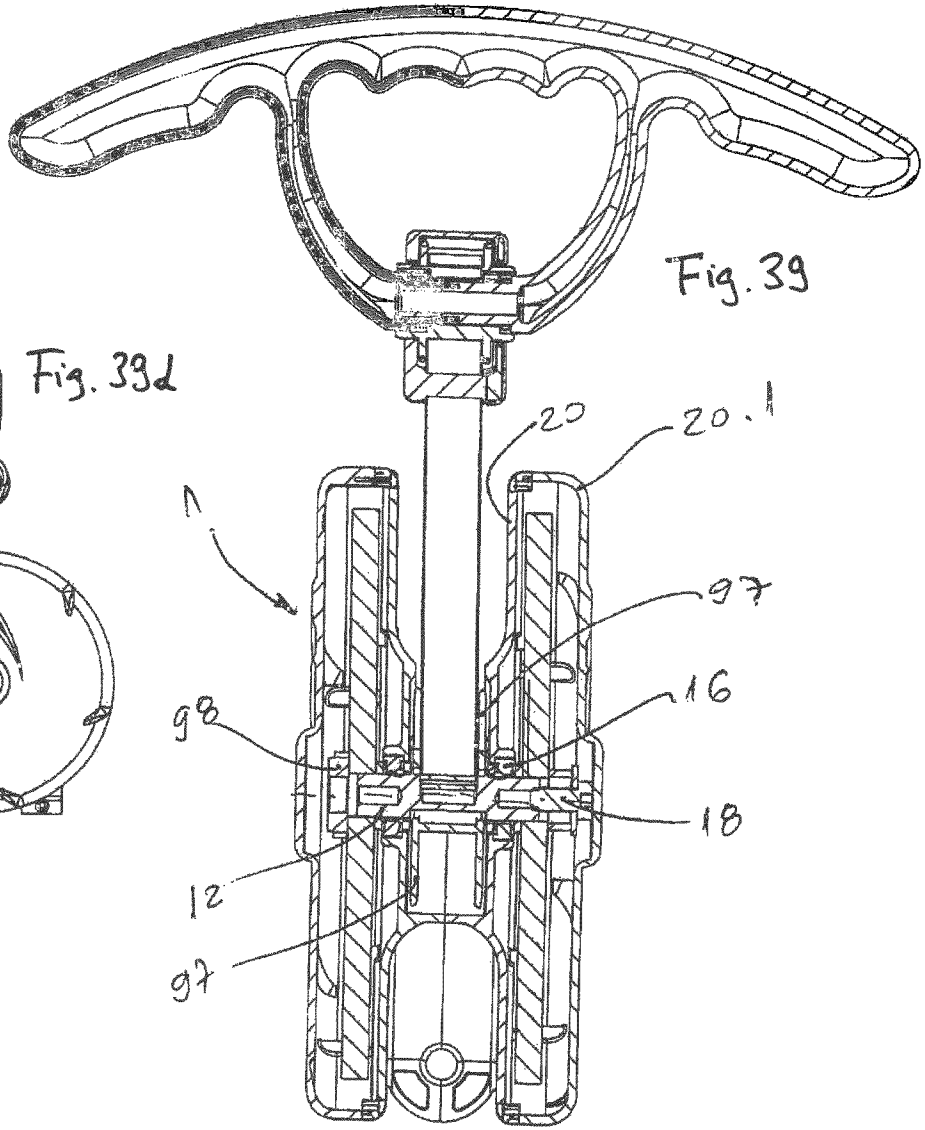
Figure 39D:
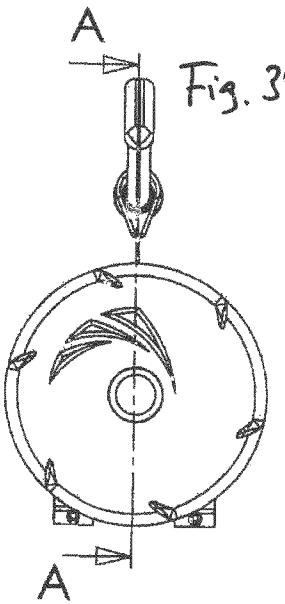
Figure 39A:
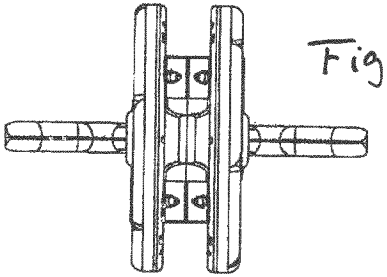
Figure 39B:
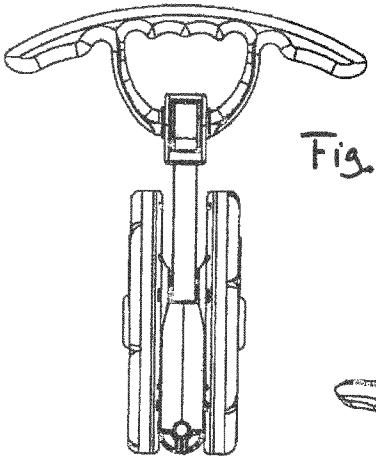
Figure 39C:
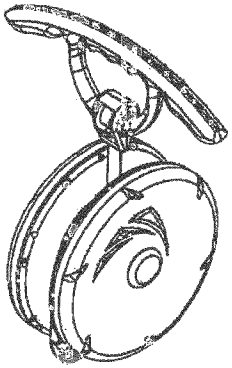
Figure 41:
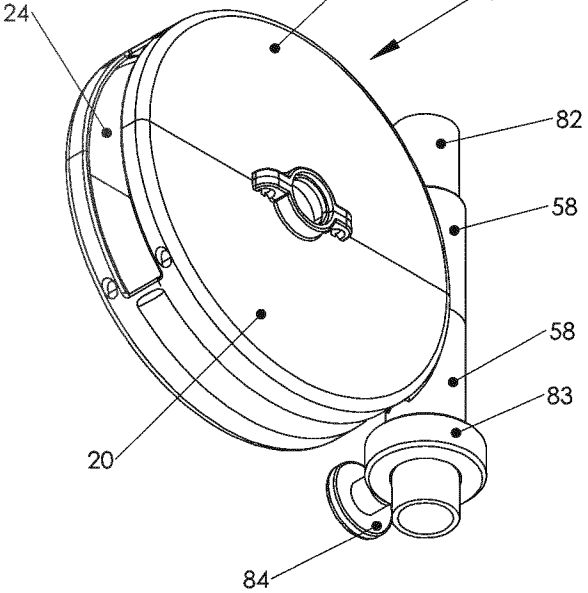
Figure 40:
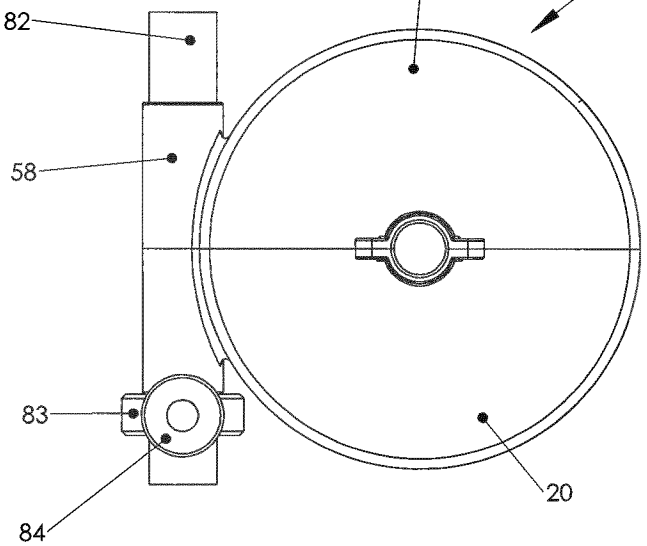
Figure 47:
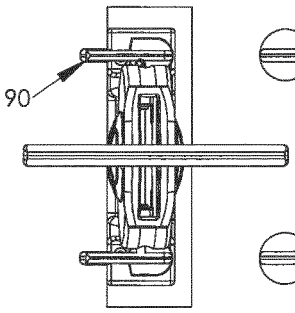
Figure 48:
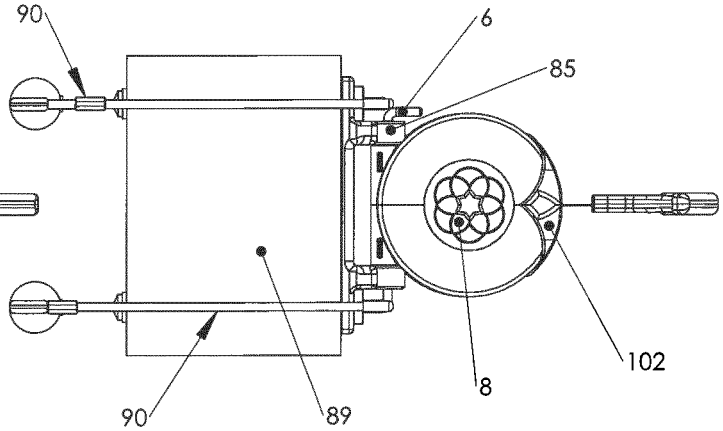
Figure 49:
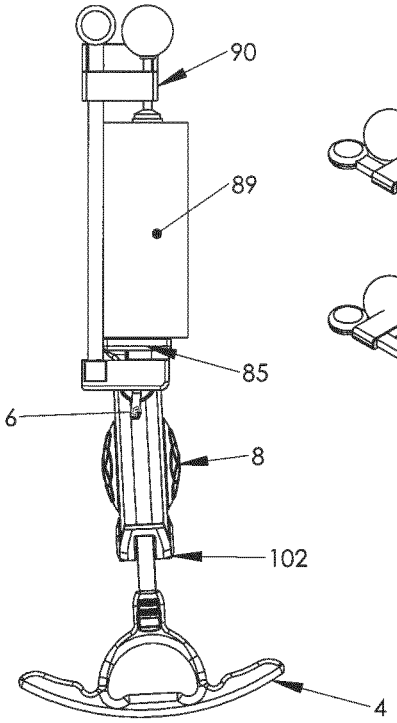
Figure 69:
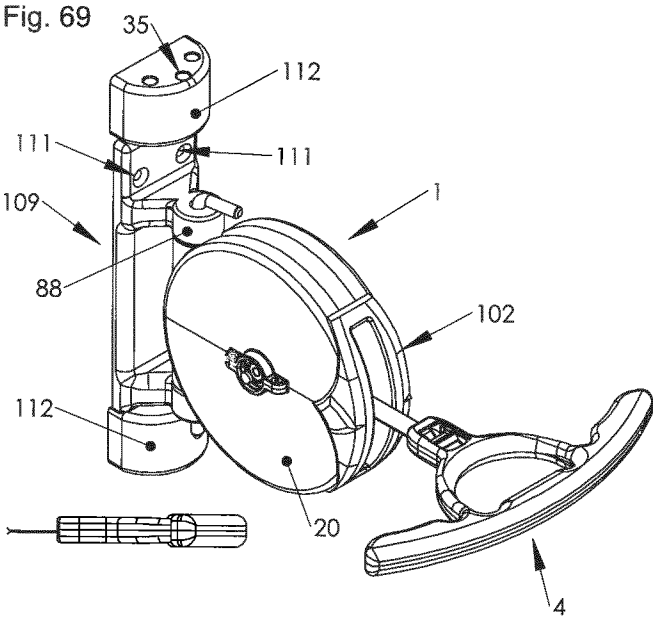
Figure 68:
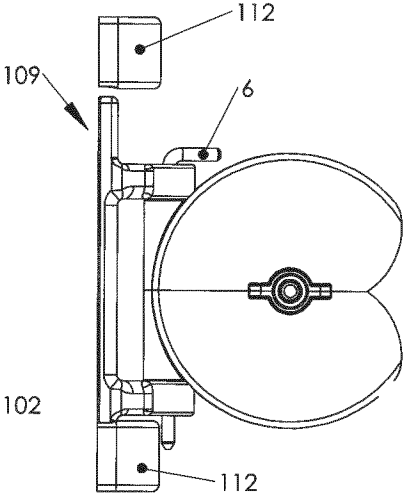
Figure 67:
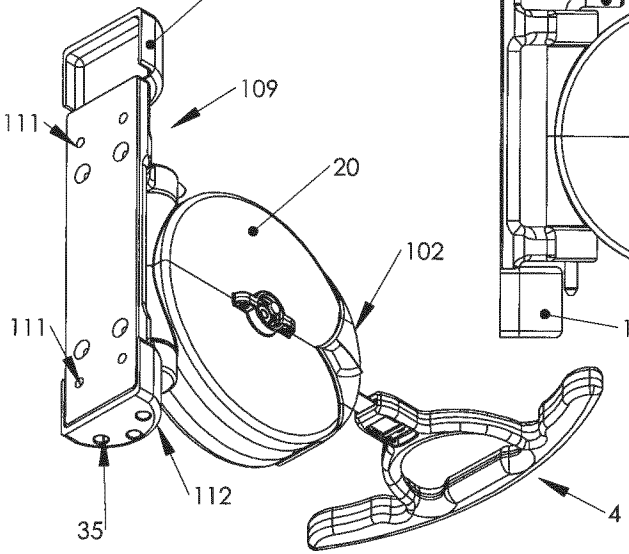
Figure 74:
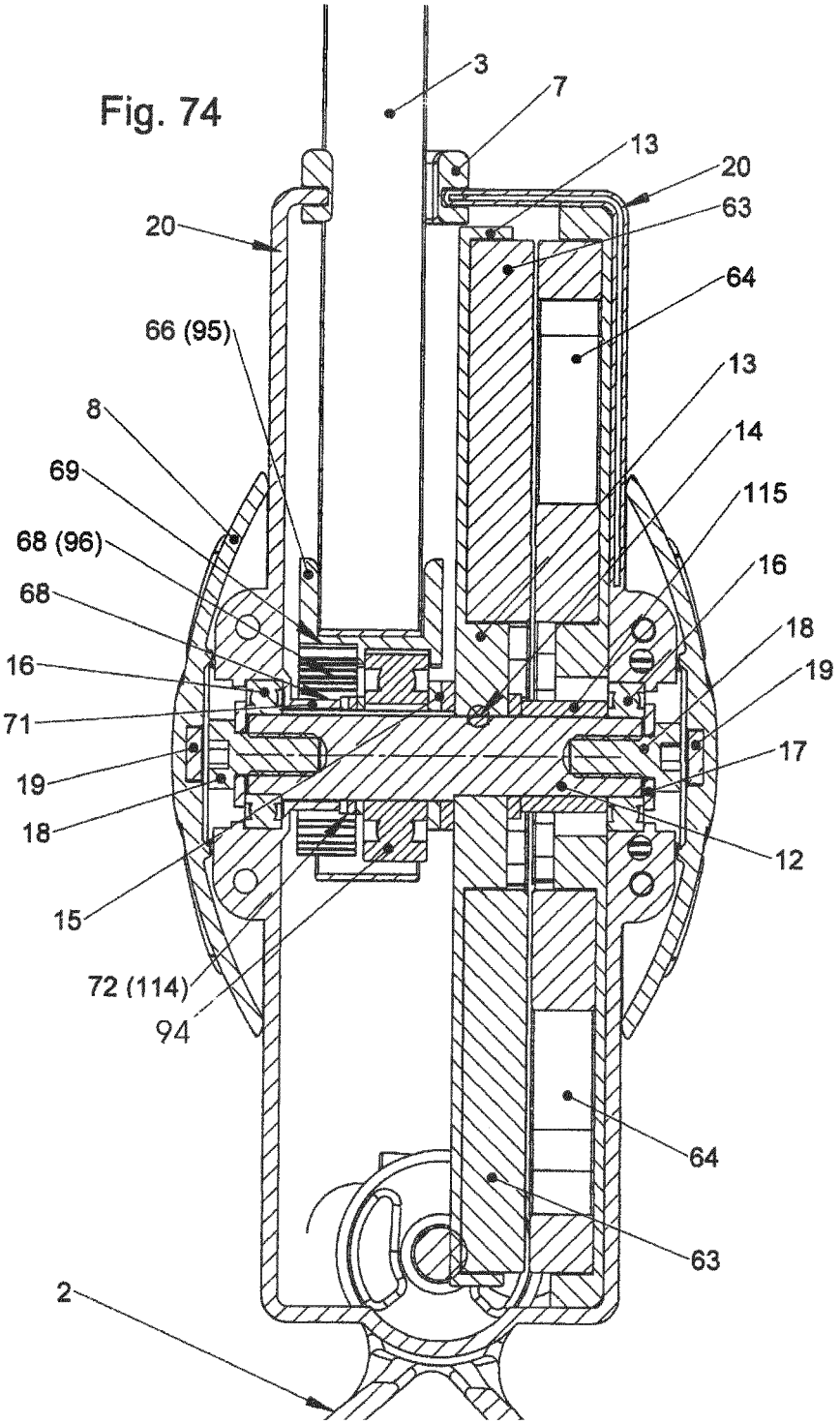
Figure 76:
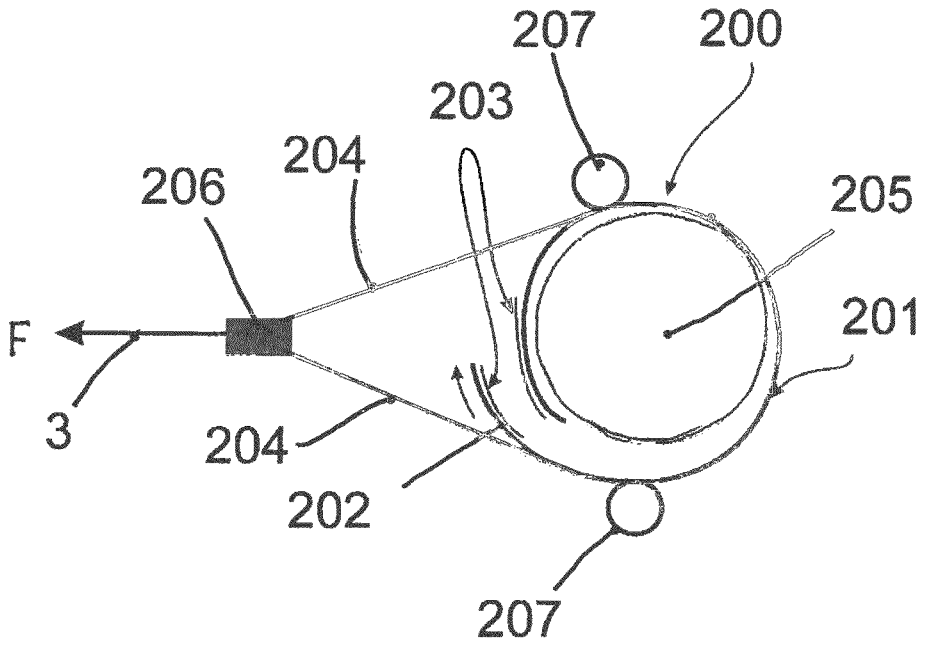
Figure 77:
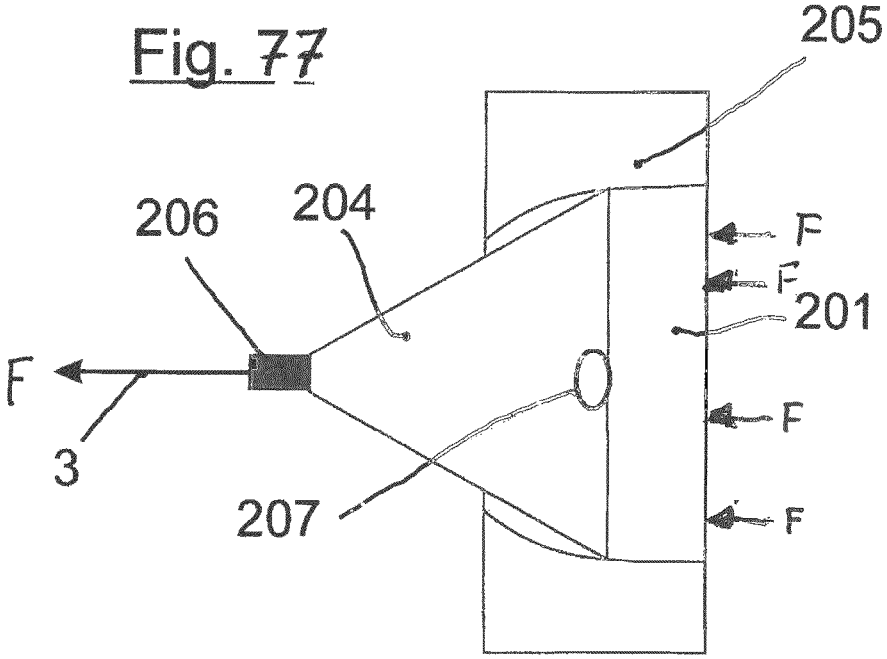
Figure 78:
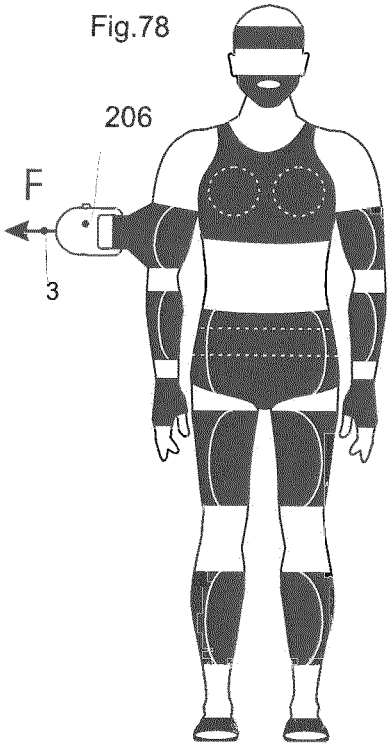
Figure 79:
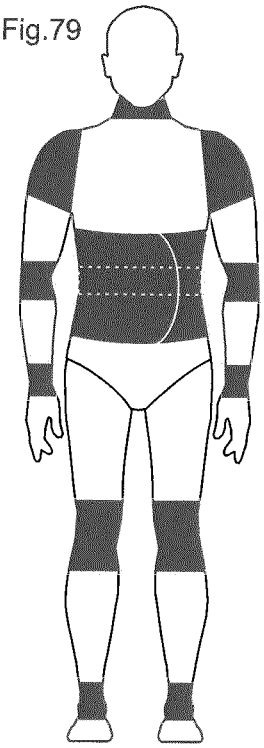
Figures 86A, 86B, 86C:
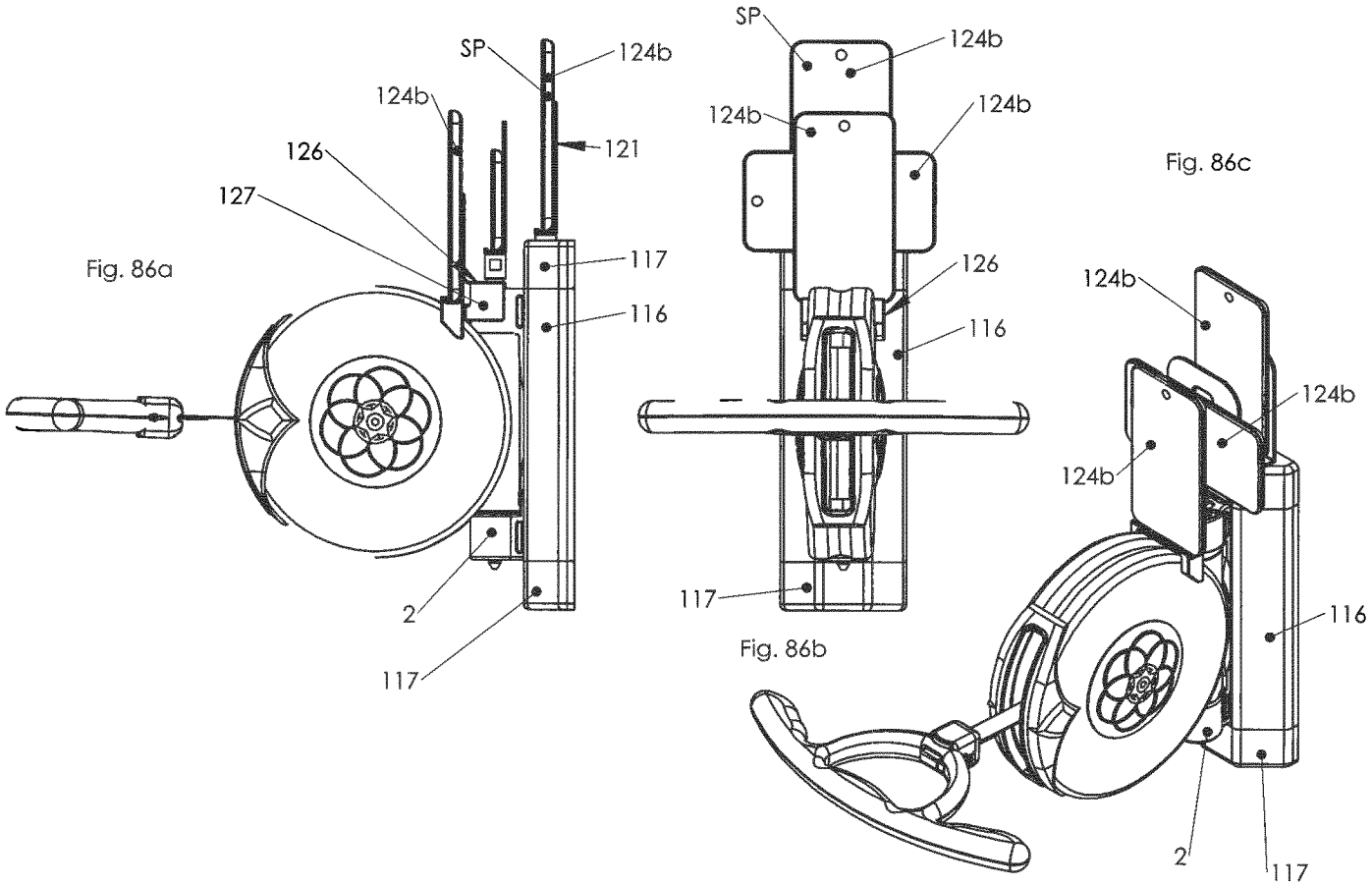
Figures 89A, 89B, 89C:
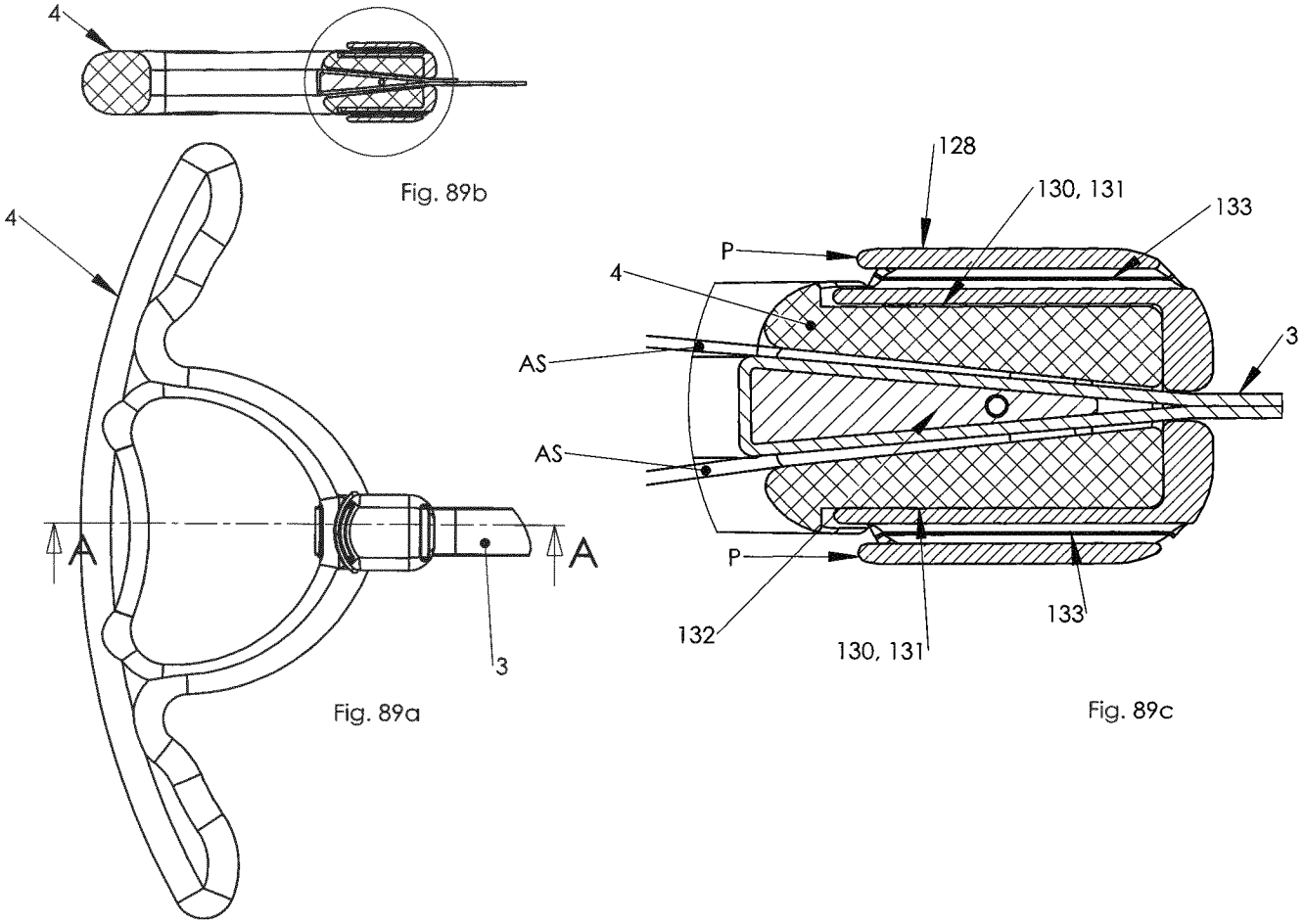
Figure 90B:
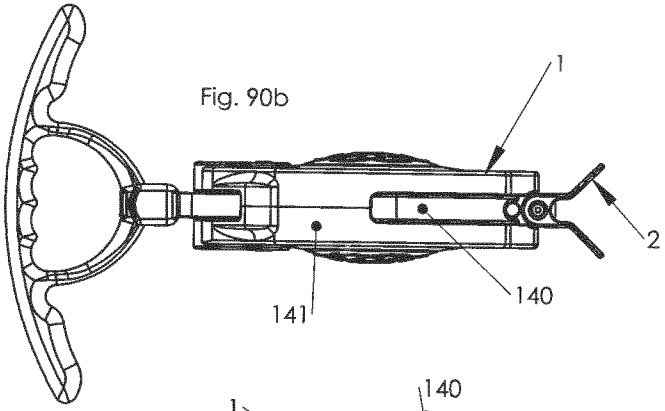
Figure 90C:
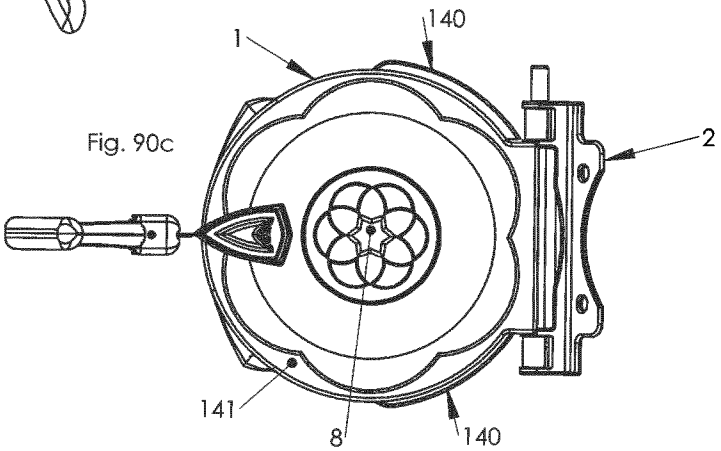
Figure 90A:
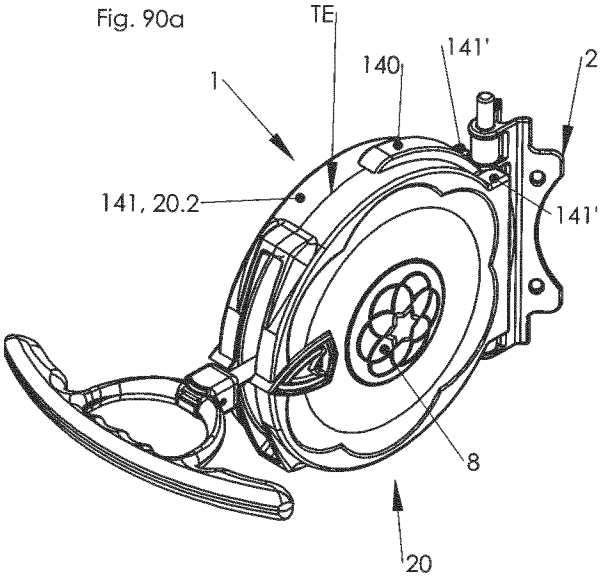
Figure 91A:
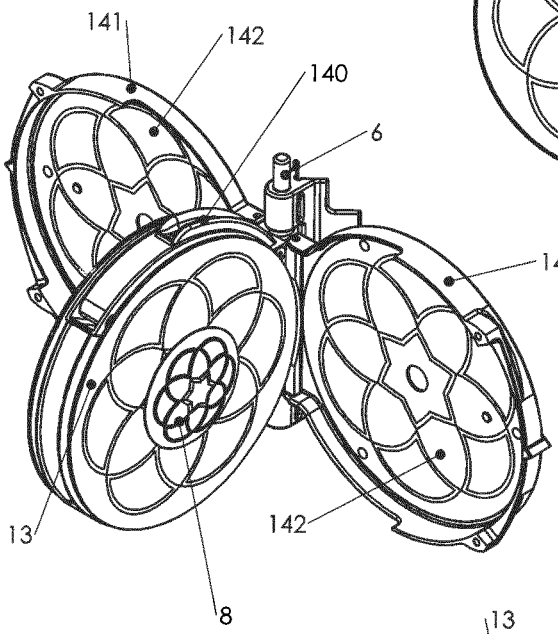
Figure 91B:
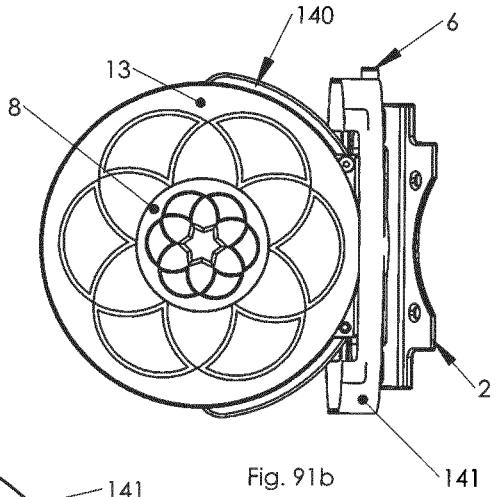
Figure 91C:
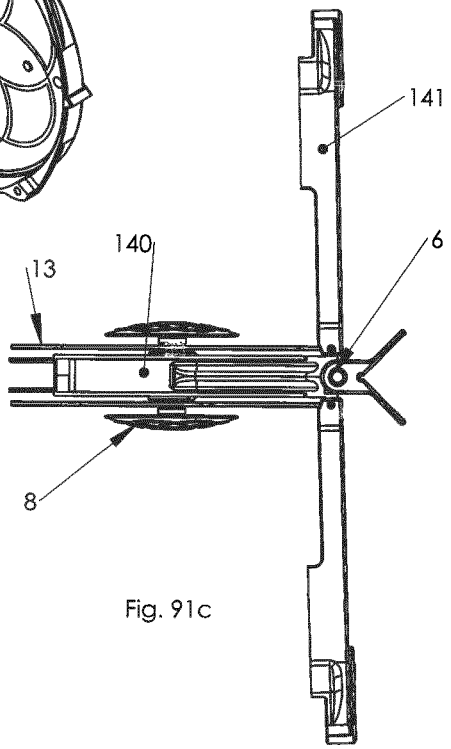
Figure 92A:
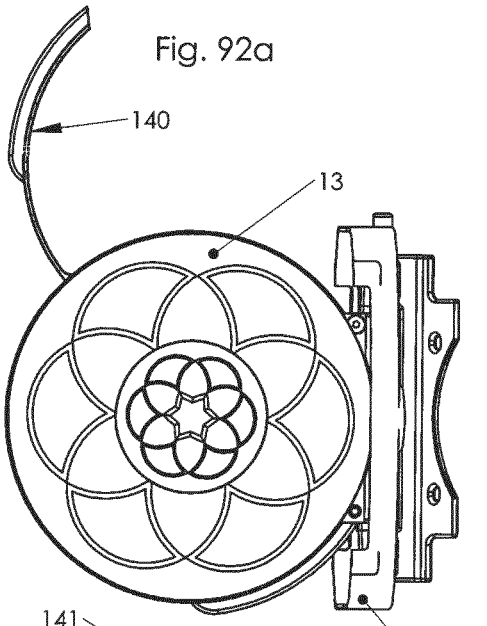
Figure 92B:
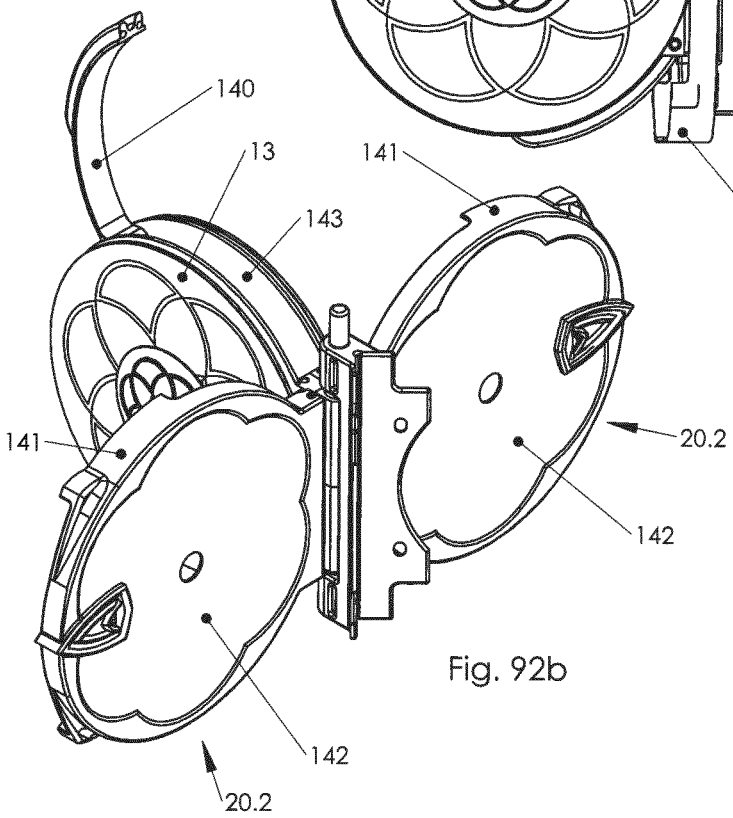
Figure 94A:
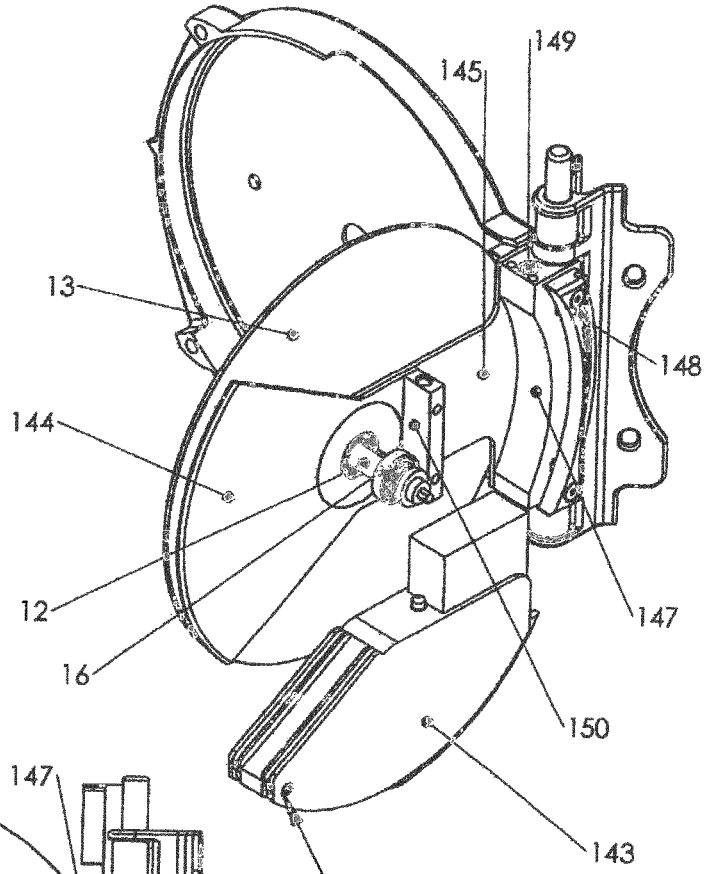
Figure 94B:
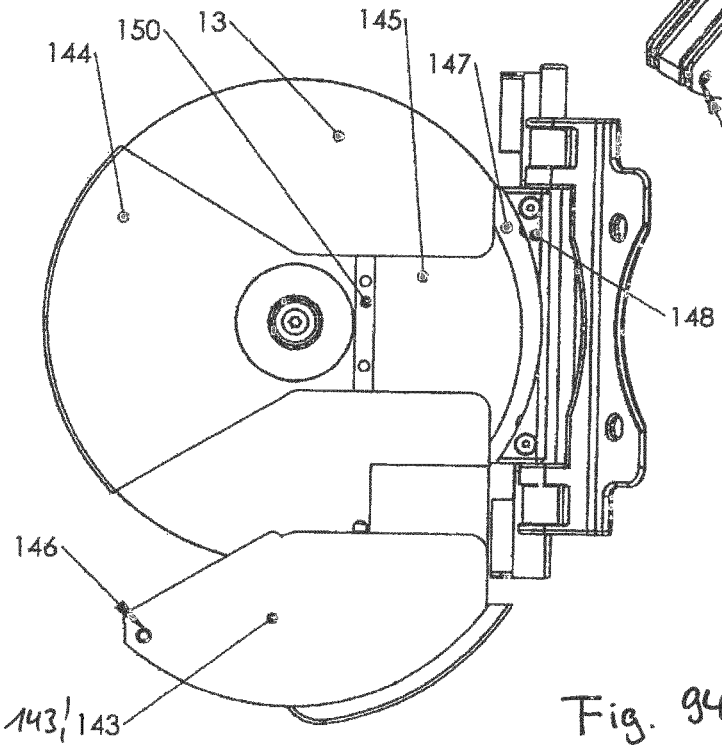
Figure 95:
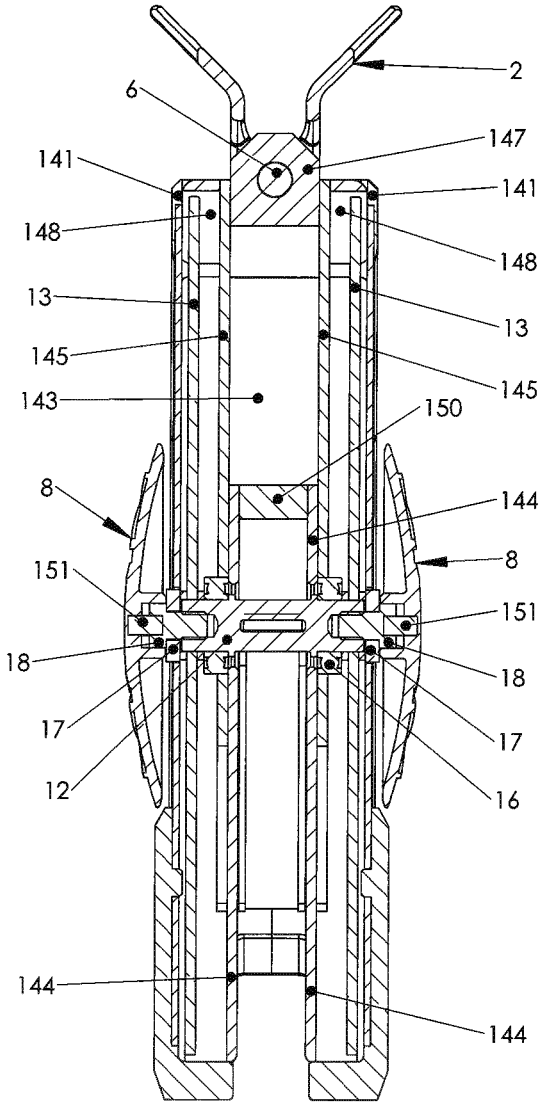
Figures 97A, 97B:
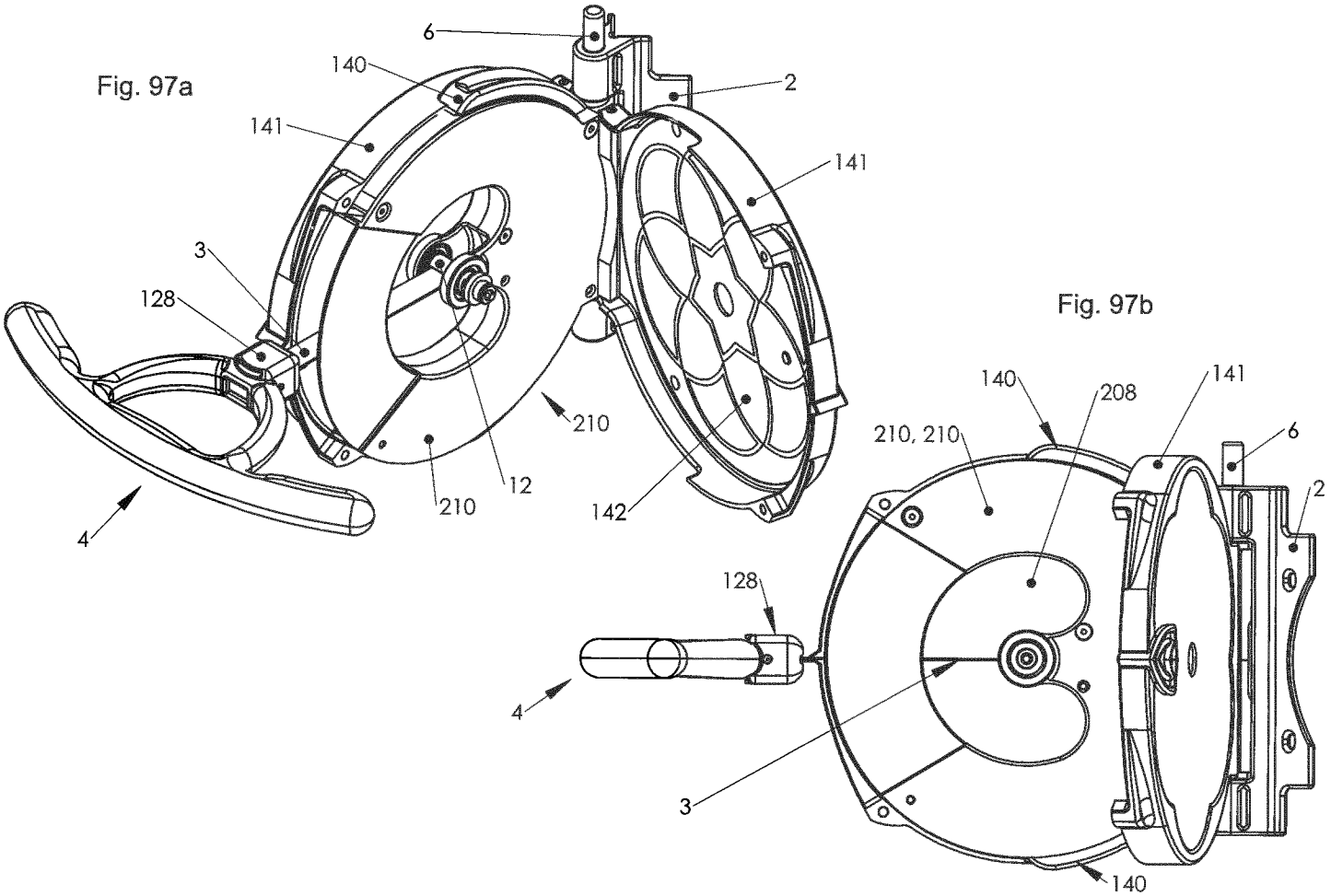
Figure 99B:
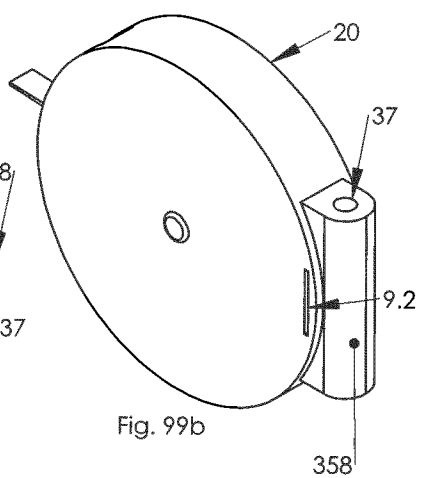
Figure 99C:
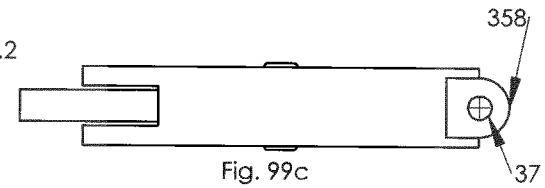
Figure 99D:
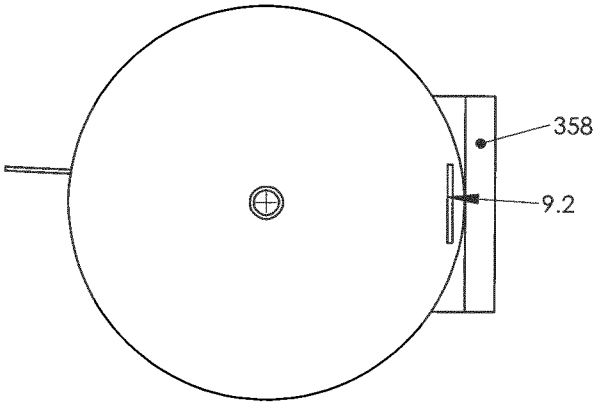
Figure 99A:
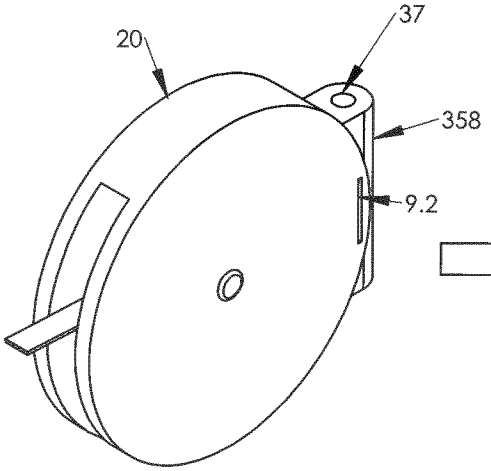
Figure 100B:
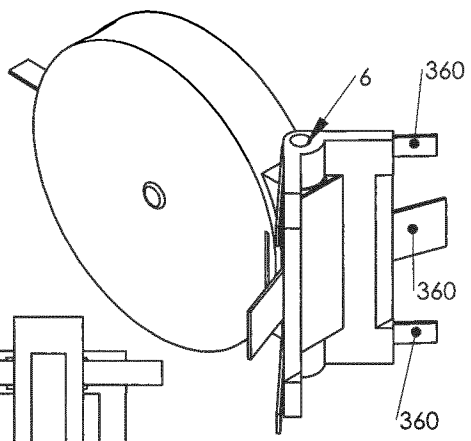
Figure 100D:
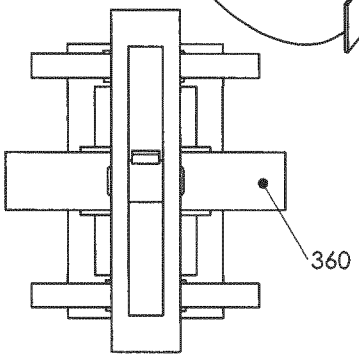
Figure 100A:
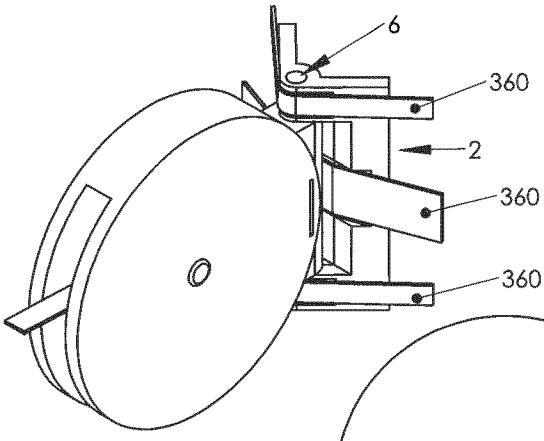
Figure 100C:
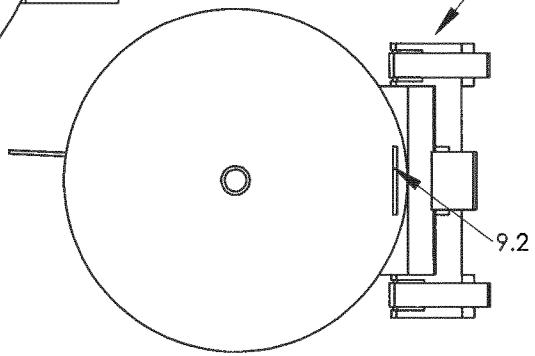
Figure 100E:
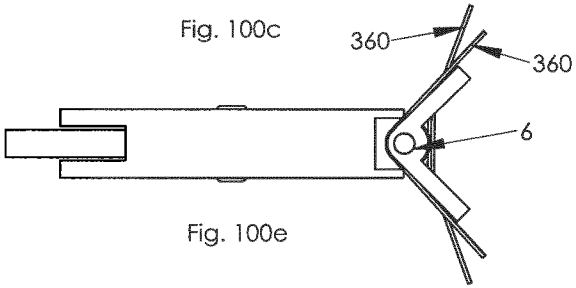
Figures 101A, 101B, 101C, 101D:
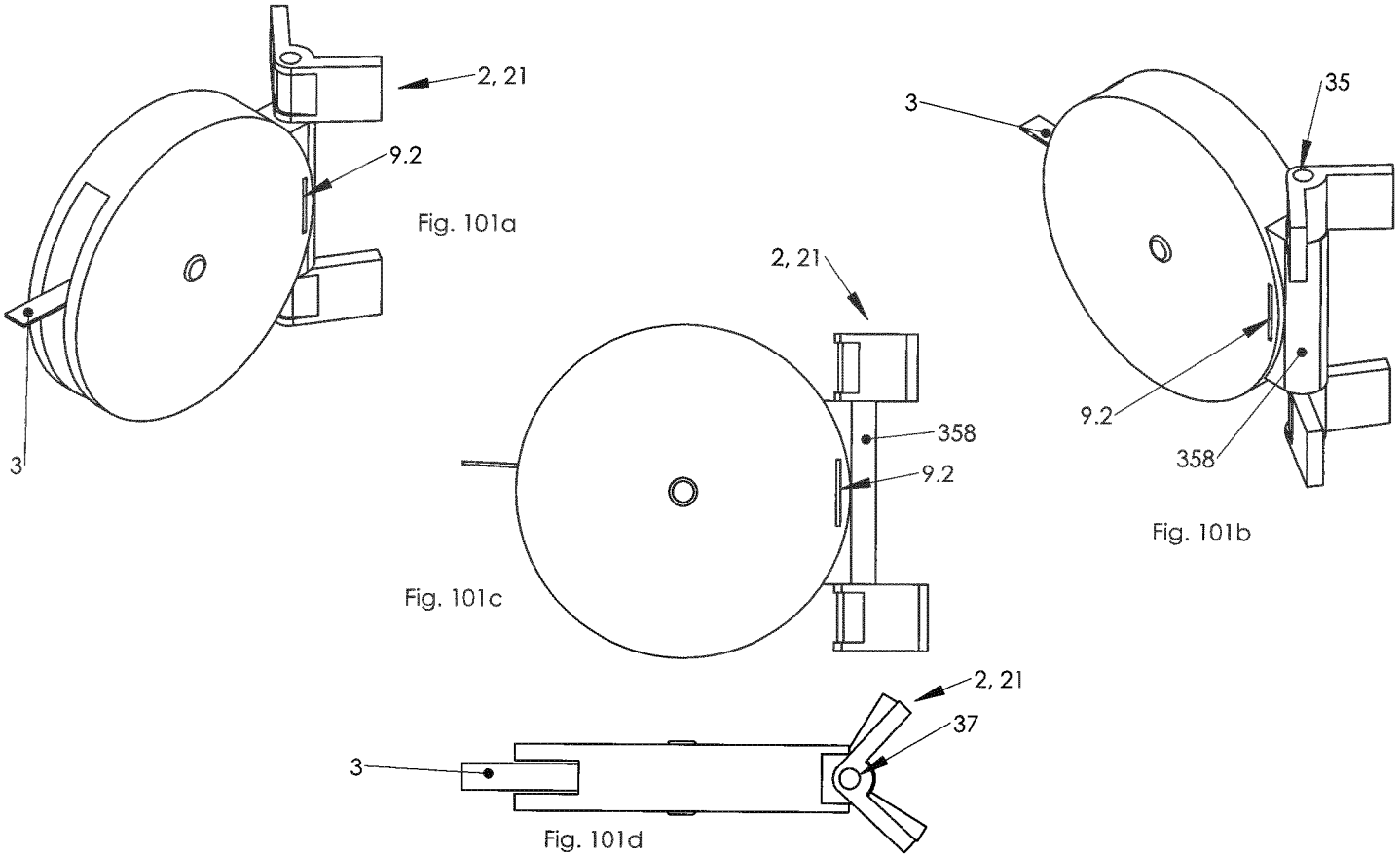
Figure 102A:
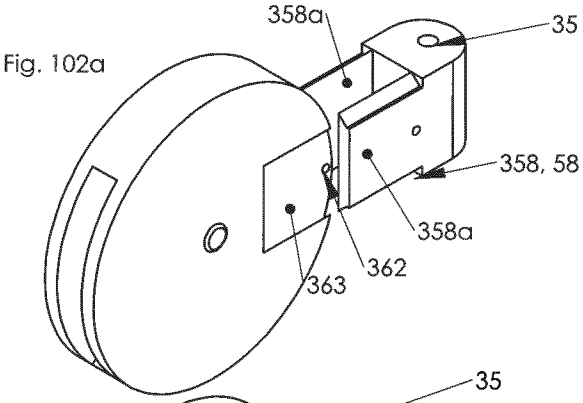
Figure 102C:
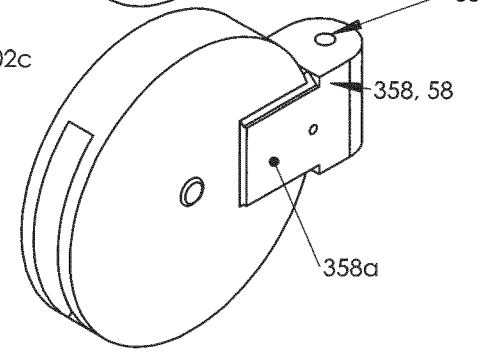
Figure 102B:
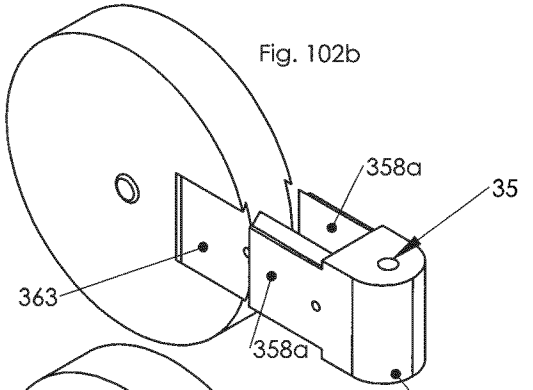
Figure 102D:
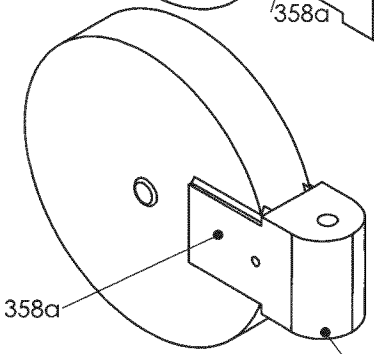

FIGS. 24*a* to 24*c*: show three different illustrations to clarify that additional hand grips may be provided opposite a hand grip (at the end of the pull cable or the pull strap), said additional hand grips being connected to the strength module, by means of which two individuals are ultimately able to work out on the strength machine simultaneously;

FIG. 25: shows an example regarding the assembly of the training device on a vertical support (pole, tree, etc.) as seen from above;

FIG. 26: shows a representation of the installation in a frontal view;

FIG. 27: shows the illustration of an installation in a perspective view;

FIG. 28: shows an installation in a side view;

FIG. 29: shows an installation in a box/cabinet in a perspective view;

FIG. 29*a*: shows an illustration of an installation in a frontal view;

FIGS. 30 and 30*a*: show an additional exemplary embodiment with the option of housing the strength machine in a cabinet-like structure, in which for example other additional elements such as loudspeakers, amplifiers and so on may also be housed; the construction is preferably "modular," wherein the elements 157 and 158 may be "coupled/detached" to the elements 155 and 156;

FIGS. 31 and 32: show a representation of a case or a box for holding the training device, once in an overhead view and once in a perspective view;

FIGS. 31*a* and 32*a*: show a case or box, both slightly modified in relation to the exemplary embodiments mentioned above, for holding the training device;

FIGS. 32*b* to 32*e*: show a view from the bottom, an overhead view as well as a cross-sectional illustration and a detailed illustration of a folded-open case or box with a strength module attached to it for performing a workout, standing with the feet on the outer side of the folded-open case;

FIG. 33: shows the device with a radial electric generator connected to it, specifically in a cross-sectional view;

FIG. 34: shows the device shown in FIG. 33 with a connected electric generator in an overhead view;

FIG. 35: shows the device shown in FIGS. 33 and 34, but in a perspective view;

FIG. 36: shows the device shown previously, functioning like a "pancake" generator;

FIG. 37: shows the device shown in FIGS. 33 to 36, but in a different perspective view;

FIG. 37*a*: shows the device shown in FIGS. 36 and 37, in a frontal view;

FIG. 38: shows the assembled device in a cross-sectional illustration, as it is represented in FIGS. 36 and 37 in a "disassembled" illustration;

FIGS. 38*a* and 38*b*: show a side and transverse view perpendicular to the axis of rotation on the strength module equipped with a generator;

FIG. 39: shows the strength module according to the invention having a different housing type;

FIGS. 39*a* to 39*d*: show bottom, rear, perspective, and side views, respectively, of the exemplary embodiment according to FIG. 39;

FIG. 40: shows an illustration to clarify the installation of the strength machine on a pole in a side view;

FIG. 41: shows an illustration to clarify the installation of the strength machine according to the invention on a pole in a perspective view;

FIGS. 42 to 46: shows an attachment adapter for door frames or wall ends in various views;

FIGS. 47 to 50: show examples to clarify the attachment of a strength module according to the invention on a door frame or a free wall end;

FIGS. 50.1*a* to 50.1*b*: show a novel attachment possibility for door frames or on wall ends, consisting of an attachment clamp preferably bent at approx. 90°, provided with one or more support feet;

FIGS. 51 to 55: show illustrations to clarify the attachment of an exemplary embodiment of the strength module according to the invention to a wall using assembly 99 and 101;

FIGS. 56 to 61: show an example of a guide cover;

FIGS. 62 to 66: show an example of a variation of a universal attachment module for affixing a strength module according to the invention, which is fundamentally very similar to the exemplary embodiment according to FIGS. 42 to 46, wherein in the present variant according to FIGS. 62 to 66 a bracket provided there is designed with a tapered base section;

FIGS. 67 to 69: show two perspective views and a side view of a universal attachment module, a cover plate and the strength straining module;

FIGS. 70 to 73: show the representation of a housing for the strength module according to the invention, wherein the housing for the attachment to a bar of FIGS. 40 to 41 is converted into a different type of adapter by affixing component 113;

FIG. 74: shows a strength module according to the invention which is designed as a electricity-generating module;

FIG. 75: shows a variant of the exemplary embodiment according to FIG. 7 having a cover 102;

FIG. 75*a*: shows a side view of the exemplary embodiment according to FIG. 75;

FIGS. 76 and 77: show the illustration of a basic principle of a strength wrap that is attached to various body parts;

FIGS. 78 to 81: show the illustration of various types of so-called strength wraps or body wraps placed on various body parts;

FIGS. 82*a* to 82*e*: show front, side, rear, perspective and top views of a wall adapter;

FIGS. 83*a* to 83*e*: show perspective, side, front and top views of a wall adapter having an inserted/installed universal adapter;

FIGS. 84*a* to 84*d*: show rear, side, front and perspective views of an adapter on which, for example, a mobile communications device, a tablet, or other electronic devices or units can be placed and/or held;

FIGS. 85*a* to 85*f*: show rear, of a slightly modified adapter, likewise for holding and/or affixing mobile communication devices, tablets and so on, which rotates with the training device;

FIGS. 86*a* to 86*c*: show side, front and perspective illustrations, clarifying for example how three mobile communication device adapters can be attached to the strength machine and/or to an attachment device (wall adapter) holding the strength machine, by means of which the mentioned mobile communication devices, tablets and so on, can be held and even be viewed, operated and so on while working out on the strength machine;

FIGS. 87*a* to 87*d*: show side, top and perspective illustrations of a grip having a novel associated coupling, with which the pull strap can be connected to the grip (exploded view);

FIGS. 88*a* to 88*c*: show side and top illustrations of a grip having the mentioned coupling in a closed position;

FIGS. 89*a* to 89*c*: show illustrations corresponding to FIGS. 88*a* to 88*c* wherein the coupling is in its open position to thread in or release a pulling element end, particularly in the form of a belt end;

FIGS. 90*a* to 90*c*: show three illustrations of a modified strength machine according to the invention in a closed state in a side, frontal and perspective view, wherein the housing can be opened by means of radially separable modules;

FIGS. 91*a* to 91*c*: show perspective, side and top illustrations of a strength machine according to the invention having an open housing;

FIGS. 92*a* to 92*b*: show side and perspective illustrations of a strength machine according to the invention having an opened housing and an open upper lid of a storage space;

FIG. 93*a* To 93*b*: show perspective and side illustrations of a strength machine according to the invention having a visible inner structure;

FIGS. 94*a* and 94*b*: show perspective and side illustrations of a strength machine also having a visible inner structure as an exploded view drawing;

FIG. 95: shows the illustration of a strength machine according to the invention in a cross-section;

FIGS. 96*a* to 96*g*: show various illustrations of a modified exemplary embodiment using a simplified housing frame for the strength module;

FIGS. 97*a* and 97*b*: show perspective and side illustrations of the strength module designed with the aid of the preceding drawings;

FIGS. 98*a* to 98*d*: show additional views of a housing-half;

FIGS. 99*a* to 99*d*: show a simplified strength module design enclosed by an outer housing with associated anchoring section;

FIGS. 100*a* to 100*e*: show another modified exemplary embodiment having an assembled anchoring module/attachment adapter, as shown in FIGS. 12 to 16, which can be anchored to a post-like support when using one or more straps, belts and so on;

FIGS. 101*a* to 101*d*: show an exemplary embodiment modified in relation the aforementioned exemplary embodiments, wherein the attachment to a stationary support is achieved by two independent adapters;

FIGS. 102*a* to 102*d*: show an additional variation of an exemplary embodiment of a device having an outer housing, wherein a simple housing is provided with a bayonet-like coupling for example, which can be used for mounting additional couplings;

FIGS. 103*a* to 103*d*: show another variation of an exemplary embodiment of a training device without an outer housing, wherein the coupling for the attachment to a fixed support is placed on a "fork-like" structure outside of the flywheels;

FIGS. 103.1*a* to 103.1*d*: show a variation of an exemplary embodiment of a training device without an outer housing, wherein the coupling for the attachment to a fixed support is placed on a "fork-like" structure between the flywheels;

FIGS. 103.2*a* to 103.2*d*: show a variation of an exemplary embodiment (both the design variants according to FIGS. 103 and 103.1 can be equipped with or protected by a housing; in this way, the devices can look and/or function like the devices according to the exemplary embodiments pursuant to FIGS. 99 to 104 or FIGS. 1 to 4 or FIGS. 91 to 97; in these examples, neither the "fork-like" inner structures nor the housings are constructed in a solid manner, but at least in a partially modular manner);

FIGS. 104*a* to 104*e*: show an additional variant of an exemplary embodiment wherein a rigid (thus fixed), non-rotating adapter is mounted to an outer housing which is equipped with a preferably bayonet-like coupling.

FIGS. 105*a* to 105*g* show a novel attachment adapter which basically functions like the adapters shown for example in FIGS. 13 to 16*f*, with the difference that the generating cylindrical cams are not linear but round or circular;

FIGS. 106*a* to 106*g* show a novel attachment adapter as depicted in FIGS. 105*a* to 105*g*, with the difference that the rear support edges AF are discontinuous in the middle;

FIGS. 107*a* to 107*f* show a novel strength machine wherein the strength module is mounted to an attachment adapter as depicted in FIGS. 106*a* to 106*g*; the strength module can be pivoted laterally in this case; the housing of the depicted strength module has a "grip hook" GH, to which a hand grip as described previously is mounted.

The training or therapy device according to the invention is basically constructed of the following main modules: strength module (such as 1, or 99 to 104), with or without an outer housing, equipped with various couplings for mounting various adapters, such as 2 for example. The strength module has inside of it a supported shaft, such as 12.1, on which one or more flywheel weights, such as 13, are placed. Attached to the shaft in a preferably elastic/damping manner is a pulling element 3, which projects out of the strength module in the opposite direction relative to the coupling 2. On the other end of the pulling element 3, there is provided a firm or stiff (rigid) grip 4 or a grip 4 equipped with a coupling that can be detached/rolled up, etc., or a body wrap as depicted in FIGS. 76 to 81.

From FIGS. 1 to 4, one can see that the training device comprises an attachment module 2 in various construction variants, pulling elements 3 for strength exercises (for example in the form of a strap, a belt, a cord, etc.) and preferably an ergonomic hand grip 4, which may have a coupling between the pulling element and the hand grip for attachment and/or uncoupling purposes. Thus, the pulling element 3 is generally designed to be flexible and/or able to be rolled up, in other words strap- or belt-like in particular. Furthermore, a wrap adapter (or "body wrap") can also be provided, which is useful when other body parts are to be exercised or treated with the device according to the invention.

In a preferred variant, the strength module 1 basically includes the following structural elements (as seen in particular in FIGS. 5 to 10):

A shaft 12 supported preferably on ball bearings 16 in a housing 20, one or more flywheel weights 13, pulling element(s) 3, a possible brake system (not depicted), possibly a guide 7 sliding in the opening 24 of the housing 20, a "coupling" 5 (possible in multiple structural variants) for mounting the strength module to the hand grip 4 (also possible in multiple structural variants) for attaching the strength module to the hand grip 4 (also possible in multiple structural variants). The strength module 1 can be attached or positioned directly by means of a recess coupling 9.2 or another type of coupling such as 362 (FIG. 102*b*), or by means of an attachment module 2, to a stationary "support" 46.

The following elements (which however may be designed in a manner that diverges from the following description) are specific to the construction of the strength module. The training device according to the invention preferably comprises the following parts here:

- a housing which consists or is formed of two "double-symmetrical," and to that extent preferably identically designed, housing-halves 20.2,
- also provided is/are one or more flywheel weights 13,
- the specific construction of a shaft 12 or 12.1, which offers a very simple way to connect the pulling element using a pin 81,
- a joining of the two housing halves 20.2 preferably with very few attachment elements 21 (for example in the form of screws or magnets)
- a multifunctional "cover" 8 with a design element (wherein the cover 8 represents a cover flap for the screw 18; in FIG. 7, only the left cover flap 8 is fitted or mounted and the right cover flap 8 is not shown),
- wherein, furthermore, there is preferably the possibility that the strength module can be attached to a plurality of supports 46 directly or indirectly, for example using an attachment module, as shown in FIGS. 25 to 28.

Between the rotating shaft 12 and the static housing 20, there may also be installed a brake system (not shown) and a switch system, which automatically activates the brake if the user for example is no longer holding the grip 4 during operation and is used to protect against possible damage of the device. Attaching the pulling element 3 to the shaft 12 can be achieved in various ways, yet preferably in a very simple manner, as depicted in FIGS. 10*b* to 11*d*, and specifically as follows: the pulling element 3 is inserted into a through-hole 25 and the end is inserted back through again. A loop is thereby formed in which a pin or wedge 81 is placed, i.e., pushed in, for example (see also FIGS. 10*b* to 11*d*).

The housing 20 may have transparent walls or windows so that the rotating flywheel weights 13 are visible from the outside. In this case, the flywheel weights 13 may have a decorative element at least on one side, such as a logo, or "sparkly items" such as semi-crystals or LEDs, and so on.

Mounted on the strength module (including the housing 20) are preferably (Hall) sensors for measuring the rotational speed of the flywheel weights, sensors for force measurements, LCD displays or other types of (LCD or other types of) displays, LED lighting, and so on.

Attachment Possibilities

The special characteristic of this preferred design is its simple, modular construction and in particular for example the attachment possibilities for the strength machine 1 (see FIGS. 12 to 16 as well as 25 to 28).

To that end, the housing 20 provides the possibility in the "rearward region," with respect to the opening 24, of a direct attachment to a stationary "support" or column 46 (for example in the form of a partially shown pole)—such as for example using a tension belt 45 (which preferably runs through the recess 35 in the attachment module 2, which is placed around the support or the pole 46). The housing 20 has a "cylindrical region" having a round or for example also a polygonal cross-section when seen from above, which if needed can be extended "downward or upward" or can have other shapes (be with or without recesses), with the purpose of enabling the housing to be attached to a fixed support or to hold it in one's hands.

Another attachment possibility exists by using an attachment module 2, as shown in FIGS. 12 to 20, which is attached to the housing by means of a pin 6, which can be inserted through a through-hole 37 provided in the housing. The pin 6 is designed in an angular manner, wherein essentially only the angular projection 6' is visible from the outside, to grasp the pin and to insert its long side-piece into the hole 37, by means of which the housing 20 of the strength module 1 is connected to the attachment module 2. As a result, there is created between the elements 2, 20 and 6 a type of "hinge connection," which allows the preferably perpendicular pivoting, aligning, orienting of the strength module 1 (depending on the pulling direction on the pulling element 3) affixed to a support 46.

The attachment module may consist for example of two pairs of self-aligning adapters (as depicted in FIG. 101), which can be pivoted independently of each other and thus also relative to each other. Multiple pairs of "support feet" 33 and/or additional support feet 34 can thereby be provided. The recess 30 is used for the better placement of the tension belts 45, particularly on post- or column-shaped supports 46 for example, particularly when these have a small diameter. The tension belt 45 can preferably be wound through a recess 9 or across the "cylindrical region" 58 (FIG. 16). The recess 35 serves as an additional coupling for the insertion of various accessory parts 47 (in other words, in the form for example of supports, adapters or holders, for example for a mobile phone, a tablet, a laptop, for books) or for example of a mirror 48, loudspeakers, heating plates, and so on. On the attachment module 2, one can also attach other accessory parts, such as a spirit level 32, for precise adjustment, for example when using the recesses 32 (see also FIGS. 25 and 28).

As shown in FIG. 25 to 28 or 100, the strength machine is secured by one or more belts 45 etc., using the attachment module 2, to trees, poles 46, etc. in a preferably vertical orientation for exercise purposes. As mentioned, the housing 20 of the strength module 1 is mounted for example by means of the mentioned angular pin 6 to the attachment module 2, whereby the mentioned attachment module 2 with its support feet 33, 34 (which are oriented at an angle to each other when seen from above) can then be brought into contact with a pole-like anchoring and secured to said anchoring by wrapping around tension belts (45 or 360—one in the center or two at the ends).

Figures 16A, 16B, 16C, 16D, 16E, 16F:
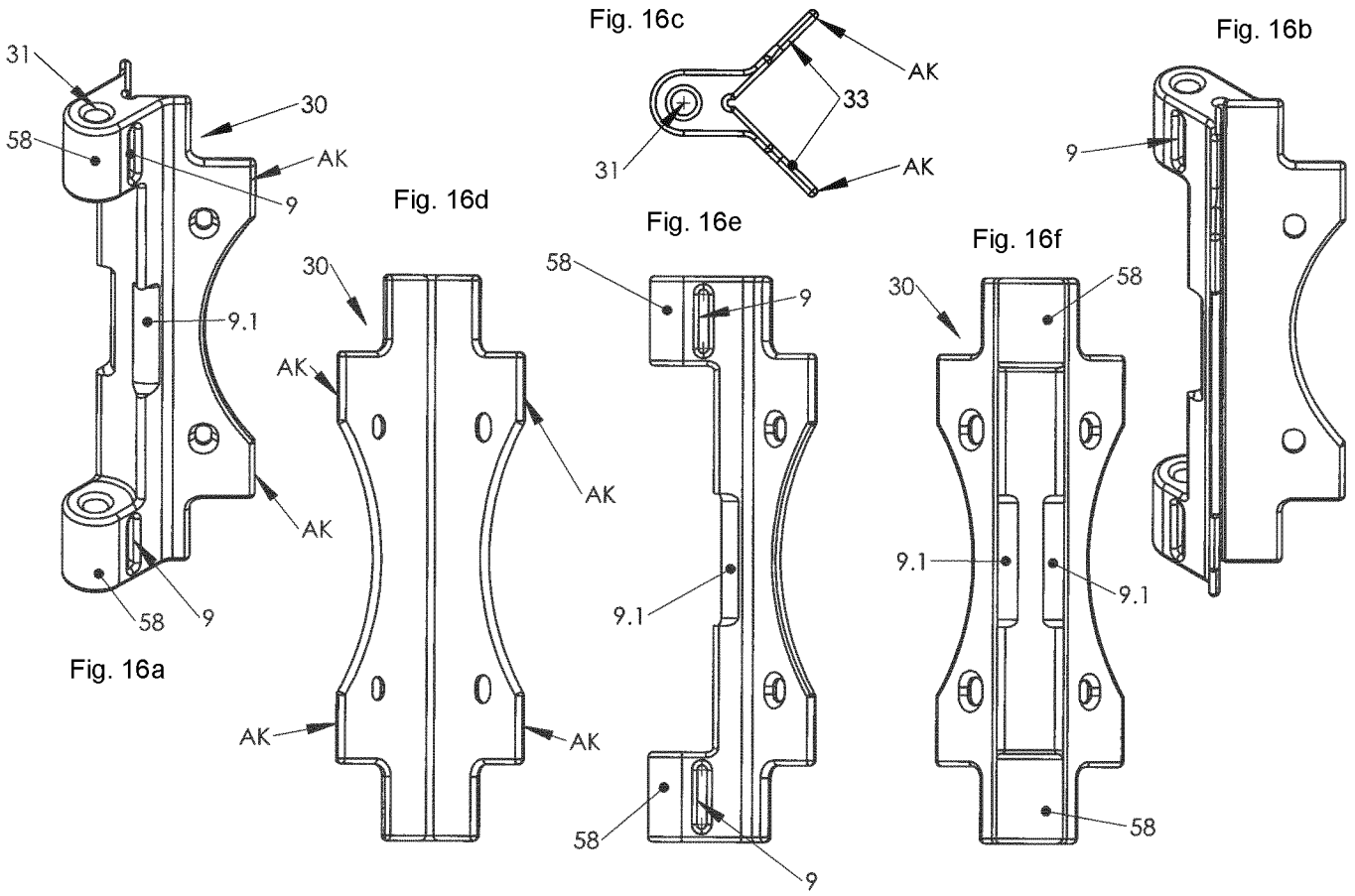
Figure 16H:
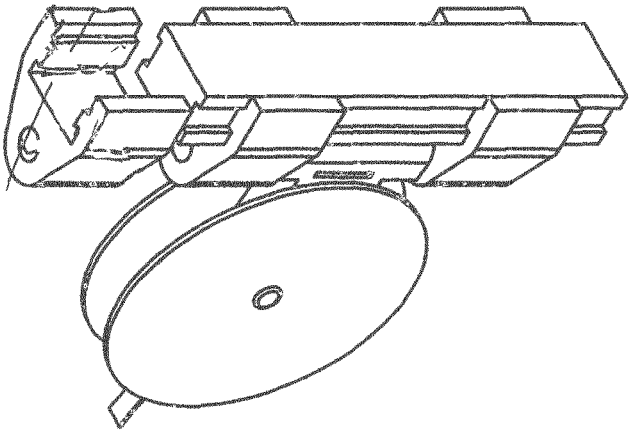
Figure 16I:
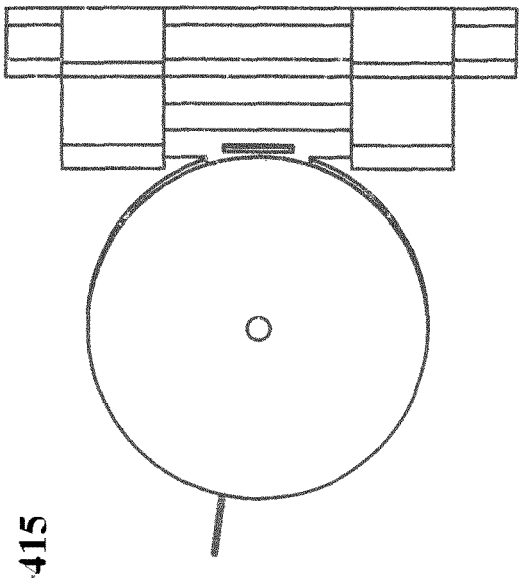
Figure 16J:
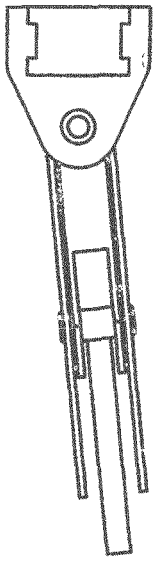
Figure 16G:
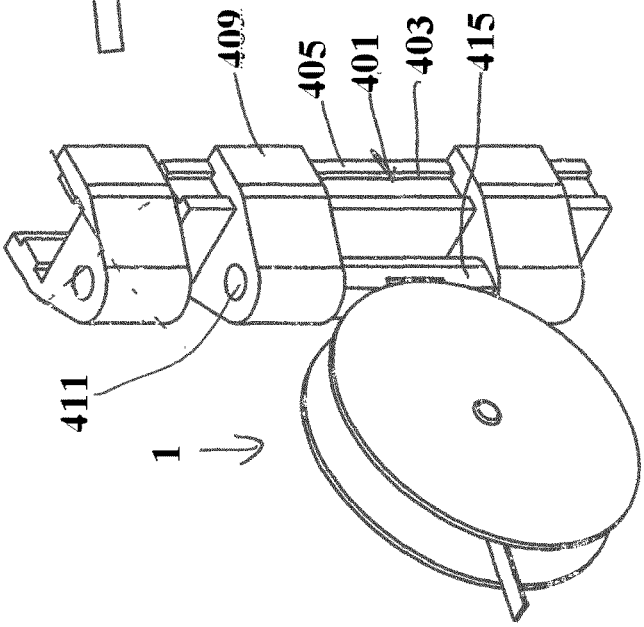

As mentioned, one variant of an attachment module 2 is shown in FIGS. 12 to 16. A variant slightly modified in relation to that is shown in FIGS. 16*a*, 16*b* in a perspective representation, in FIG. 16*c* in an overhead view and in FIGS. 16*d*, 16*e* and 16*f* in various side views.

One thing this variant has in common with the variant according to FIGS. 12 to 16 is that the attachment module 2 has a longitudinal extension, and thereby has, spaced apart in a longitudinal direction, a so-called cylindrical region or cylindrical anchoring region 58 in each case, which comprises on the one hand an axial hole 31, running in a longitudinal direction, positioned in each case at the top and bottom, into which the mentioned pin 6 can be inserted. As mentioned, the strength module 1 and/or the housing 20 of the strength module 1 is thereby connected in a hinge-like and thus articulated manner around the pivot axis formed by the longer side-piece of the pin 6. Provided parallel to the mentioned axial hole 31 and extending beyond the partial length is an additional axial hole 35, which serves as a recess for coupling elements (which may have for example a round or a different profile cross-section, which will be addressed later). The mentioned recess 32 (FIG. 16) serves for example as a recess for inserting or attaching a spirit level, sensors, lighting elements (LED), and so on. There are no limitations in this respect. The mentioned recess 30 is used for guiding around a belt to firmly mount the mentioned attachment module 2 to a (possibly thinner) pole.

In the variant according to FIGS. 16*a* to 16*d*, the outer support foot (which in an overhead view aligns with the support feet 34 located underneath it), which borders the recess 30 at the two opposite ends, has been omitted, which simplifies attaching belts for affixing the attachment module 2 to a pole or a pole-like structure. As mentioned, a belt (not further depicted in the drawings), for example, can be passed through the slot-like recess 9, wherein for fastening purposes preferably two belt straps are used, which are anchored around a pole 46 at an upper and a lower recess region 30 and run through the slots 9 in the upper and lower anchoring section 58. This and a variation will be addressed later, wherein the variation is possible to the extent that for example a middle belt strap can be guided around not only the attachment module 2, but also around a pole to which the attachment module 2 is also attached, to thereby secure the attachment module to a pole 46, for example.

The strength machine 1 can also be held by a person's hands for training purposes, so that two persons can simultaneously train with the same device, as follows: One holds the strength machine with the hands on the housing or on the hand grips 4*a* and 4*b*, and the other pulls on the grip 4. The load and thus the training effect are distributed identically to both individuals. An additional reason why two individuals would be able to train together is to boost the team spirit, fun factor and enthusiasm of both individuals.

In this case, an ergonomic adapter is attached to the device if desired, and preferably with two opposite hand grip sections by which the strength machine can be gripped and held. The other person can then operate the strength machine using the mentioned belt, wherein the occurring forces are sensed by both individuals according to the "action"="reaction" principle and both individuals must react to this.

The strength machine 1 can be fastened to a rail, for example a rail or a profile 401, on a wall for example. Such a rail 401 may comprise a profiling 403 which is designed in a groove-shaped manner for example and is designed at the two opposite transversely aligned side surfaces 405 of such a profile or such a rail 401, as represented for example in FIGS. 16*g*, 16*h* as well as FIGS. 16*i* and 16*j* in an overhead view. On this mounting rail, two corresponding screws, which are longitudinally movable on the rail 401 and not further depicted, can be anchored in their position by means of adapters 409, which are provided with a connection means 411 (labeled 35 in other examples) parallel to the rail 401, for example a hole-shaped recess, into which an anchoring pin can be inserted, which runs through both spaced-apart adapters 409. Between the thus spaced-apart adapters 409, one can anchor a corresponding holding body 48 and/or 415 or 358, preferably designed in an at least approximately elongated manner, which is firmly connected or attachable to the housing 20 or anchoring region 358 of the strength module, said holding body being connected in a rigid or articulatable manner to the housing 20 of the strength module 1. Preferably, the strength module 1 can be connected to the adapter arrangement 411 in an articulated manner via the holding body 415 and can be pivoted in relation to said adapter arrangement, in other words about an axis running parallel to the profile 401. The mounting rail 401 itself can then be mounted on any stationary support, for example a wall. The mentioned adapters 409 grasp the profile 401 or the mounting rail 401 preferably not on its rear side, so that the profile rail can be fastened directly to a wall, for example, without additional spacers.

The strength machine 1 can also be placed in an open shelf or a cabinet 50 (with non-depicted doors) or 155 to 158, which is firmly attached to a wall or using a detachable coupling on the wall, as illustrated in FIGS. 29 and 29*a* as well as FIGS. 30 and 30*a*. The cabinet 50 may have one drawer or multiple drawers provided to the side of and/or on top of one another (not depicted). Other strength or training machines or accessories such as belts, grips, gloves, holders, sportswear, drinking fluids, and so on can be placed in the other drawers.

The cabinet from FIGS. 30 and 30*a* can also be constructed in a modular manner, wherein for example the part 155 can be fixed to the wall and the assembly 157 and 158 is "detachable."

The cabinet 50 can also slide upward and downward and be fastened at a certain height on vertical slide guides/slide rails, which are provided on a support (not depicted) attached to the wall. A mirror can be placed between the two slide rails on the "attached support" so that users can look at themselves while training to get motivated.

The mentioned "cabinet" can be hung on the wall, and one or more of the interior compartments can be fitted with power cells. The training electric generator is placed inside the cabinet, and above the cabinet one could place a "cooking plate" or other cooking devices, which are operated with the electricity generated by the device. This creates a more complex, completely energy self-sufficient "cook set," which can be used in simpler households or when on the go, for expeditions or emergency situations, and so on.

For this purpose and others, the attachment module 2 was provided with the recesses 35 and 36, which serve as couplings for attaching, e.g., a support 47 for mobile phones/smartphones, "tablets," laptops, books, mirrors, speakers and so on.

All other surfaces and recesses of the attachment module 2 may be used as couplings for attaching various accessories.

The Pulling Element

The pulling element is basically flexible and firm (rigid), but if necessary it can also be slightly stretchable to absorb the shock when changing the direction of rotation of the flywheel weights (which is reached when arriving at the "dead point" when the pulling element is completely unwound from the shaft).

The at least one provided flywheel weight 13 or the two or more flywheel weights 13 are made to rotate by exerting a tangential tensile force on a section of the shaft. The force can be exerted by using a belt 3, a cord, a cable, a strap, a chain, and so on, which is attached to the shaft 12. Attaching the belt 3 to the shaft 12 can be accomplished in various ways; preferably however, the belt is inserted through a recess 25 that passes all the way through. The "thickened" end of the belt 3 (not depicted) will get stuck in the thicker recess 26. Preferably, however, the belt can be most easily attached as depicted in FIGS. 9 to 11*d*. (In this variant, a loop is formed with the belt end, into which a wedge/pin 81 is placed to create a simple connection of the pulling element 3 and the shaft 12.) In FIGS. 10.1*a* to 10.1*h*, the pin 81 is supported on two compression springs 135 axially placed in the shaft 12.1, which absorb the shock occurring at the dead point.

In other words, the aforementioned FIGS. 10.1*a* to 10.1*h* show that for anchoring the end of the pulling element 3, there may also be provided on the shaft 12 a spring-loaded damping device, which allows a damping motion of the pulling element required opposite the force of the force accumulator upon reaching the dead point position of the flywheel weight 13. To that end, the pin or wedge 81 is provided and pressure-loaded with the two depicted compression springs 136 by the spring force accumulator, which hold the pins actually holding the pulling element end against the pulling direction F in its starting position in a stop-limited manner. Upon initiating pulling forces F on the pulling element and placing the flywheel weight into rotation, upon reaching the dead point position, the pulling force F moves the described pin 81 or an equivalent device against the force of the spring of the spring force accumulator 135 in the arrow direction F, by means of which ultimately the "jolt" or "impact" generated upon reaching the dead point position is damped. FIGS. 10.2*a* to 10.2*d* show that the opposite ends of the shaft 12 can also be mounted by means of a bayonet connection, for example, to the housing or an inner support structure, and not by using nuts or screws which must be screwed into or on to the front sides.

In addition, this variant exhibits a wedge-shaped recess KA, which in the cross-sectional view according to FIG. 10.2*c* runs in pulling direction F in a wedge-shaped manner or with surfaces converging towards one another, into which the stop-limited pin or wedge 81 can be inserted, which is held in a compressed manner in this wedge-shaped recess when the pulling element, particularly in the form of a pull strap, is subjected to tension. Preferably, the pull cable end or the belt strap end is placed around this pin or wedge 81 in the form of a loop so that the loop is held in a compressed manner on the two opposite pressing sides of the recess having a wedge-shaped taper.

The drawings according to FIGS. 10.3*a* to 10.3*g* show a foldable wedge device 81.1 for attaching the pulling element 3 in the wedge-shaped recess KA in the shaft 12.2. As mentioned, the belt strap end for example is placed around this foldable wedge device 81.1, wherein the two legs of the foldable wedge device 81.1 project toward and into the tapering receiving space.

FIGS. 10.4*a* to 10.4*f* show the aforementioned foldable wedge device 81.1 with the surrounding belt strap end, which is inserted in the corresponding recess KA.

The Case

Figures 32B, 32C, 32D, 32E:
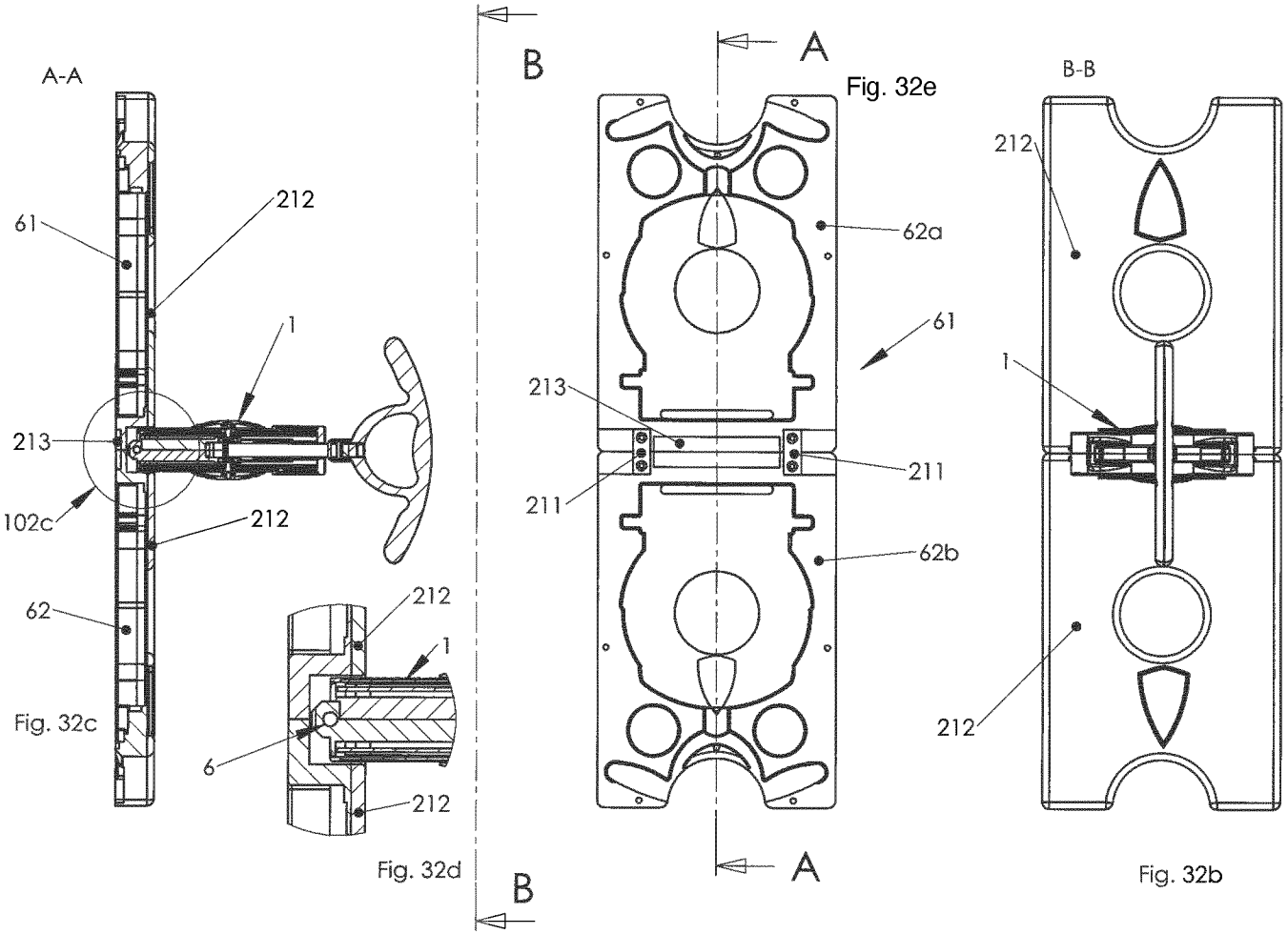

FIGS. 32*b*, 32*c* as well as 32*d* and 32 also describe how the case 61 described in the preceding figures can also be utilized with the two case halves 62*a* and 62*b*.

The illustration according to FIG. 32*b* shows the already-described case 61 with the two case halves 62*a*, 62*b* in open position, specifically showing its inner side, whereas FIG. 32*c* shows the open case with its two case halves 62*a*, 62*b*, specifically its upper and outer side in an overhead view.

FIG. 32*c* shows a cross-sectional illustration according to the line A-A of FIG. 32*e*. The section framed in a circular manner in FIG. 32*c* is shown in FIG. 32*d* in a magnified view.

These examples are meant to show that the opened case can be placed for example on a floor surface, and an anchoring section of the strength module Ican then be attached to its upper or outer side in its middle region. In other words, one can then place oneself on the two outer sides of the case halves 62*a*, 62*b*, by means of which the two case halves are held to the ground in a weighted and secure manner by one's own body weight. In addition, a stop limiter is provided so that when using the anchoring section, the two case halves are held in their open position.

Since the case 61, i.e., including the case halves 62*a* and 62*b*, is/are preferably made of plastic material or foam material, a provision is made for this situation that the outer surfaces 212*a* and 212*b* of the two case halves 62*a*, 62*b* are equipped with a corresponding force-absorbing hard plate (for example made of hard plastic or wood or metal, and so on) so that the case halves cannot be damaged in the depicted application when a person stands with both legs on the opened case halves in order to work out in the strength module 1.

The strength module is attached inside the opened hard plates 212 by means of reinforcing elements 211.

The Ergonomic Hand Grip

For a balanced, comfortable and ergonomic contact with the hand, the outer end of the pulling element 3 is connected to a unique hand grip which can be designed in a ring-shaped or linear (straight) manner, but also in a manner known from prior art. However, other types of hand grips are also possible. For this application, a hand grip is selected with the pulling element rolled up inside the hand grip, e.g., on a reel using a tensioned flat spiral/coil spring, to the desired length (see also FIGS. 21, 24). The depicted hand grip and/or the coupling described in this context as well as other parts of the hand grip may also be used in an entirely different manner, e.g., on entirely different sports or training equipment.

The belt is secured or loosened, e.g., by actuating a button or pivotable lever 5 which is mounted on the hand grip.

The hand grip functions similar to or can be a "belt-roller-leash," as described for example in U.S. Pat. No. 7,168,393, wherein the length of the belt can be adjusted in an infinitely variable manner.

On the hand grip, one can place control switches or buttons or potentiometers for adjusting the rotation energy, the lighting or the sound (display for all training data). The control information takes place remotely or via electric lines placed in the pulling elements.

To enable optimal use of the device, a special grip is preferably used, as shown in FIGS. 21 and 22 or FIG. 21 to 24 or 86 to 88. Such a hand grip 4 enables one to use the strength machine with one or both hands, whereby the tensile/training force is always induced in a "centered" manner. The grip 4 has two side grips 40, a middle grip/central grip 41 and a "middle arc" 44, which forms the connection to the pulling element 3. The connection of the grip 4 to the pulling element 3 is created by means of a coupling 5. To optimize ergonomics, the recesses 42 and 43 were made, which allow a better fit for the index and middle fingers.

Another construction of this novel grip, with applications in many other areas, is shown in FIGS. 23 to 24. It represents a "modular" construction of the grip and also has a reel 59 for winding up a pulling element to change its length.

Naturally, one can also create unique hand grips by combining various depicted and described elements, such as by the placement of the coupling depicted in FIGS. 87 to 89 on the middle grip 41 (FIG. 23) and by using the grip from FIGS. 23 and 23*a* in the opposite direction, and so on.

FIGS. 23 to 24 thus show a modularly constructed hand grip in a partial perspective view. In this exemplary embodiment, the side grips 40 are placed on a tube 93. The tube 93 can rotate inside a guide in the middle arc 44 and can be prevented from rotating by means of pins or similar to thereby set the length of the pulling element 3. The pulling element 3 rolls itself up inside the reel 92.

FIGS. 24*a* to 24*c* show a simplified or only schematically illustrated housing 20 for the strength module 1 having an anchoring section 358 preferably rearward to the pull opening for the pulling element 3. As shown in FIGS. 70, 71, 72, 72*a* and 73, this anchoring section 358 can for example be used ultimately by forming a vertical pivot axis, for example, for mounting to an adapter, which in turn can be fastened to a stationary wall, pole or similar.

FIGS. 24*a* to 24*c* now show in a simplified illustration a strength module 1 with an associated anchoring section 358 or 58 (which may consist for example of a hollow cylinder as in FIG. 73). As described, ultimately the strength module can also be mounted using an attachment module 2 to a wide range of locations in a stationary manner in particular, or if applicable in a pivotable stationary manner. By contrast, in the variant according to FIGS. 24*a* to 24*c*, the hand grip sections 4*a* and 4*b* are inserted and/or fastened to the two opposite front sides, for example also by means of a screw engagement. It is thereby possible that for example two individuals can jointly work out with such a device, whereby the one person, using both hand grips 4*a*, 4*b*, holds the strength module, which can be pivoted about a central axis running between the two hand grips 4*a*, 4*b* through the preferably hollow cylinder-shaped anchoring section 358 or 58, while the second person places the flywheel weights into corresponding rotation as usual on a hand grip attached to the end of the pulling element 3.

The Case

The strength machine 1 with the associated hand grip 4 can be stowed in a particularly advantageous and favorable manner in a case specifically adapted for the training device, as shown in FIGS. 31 and 32 as well as 31*a* and 31*b*, wherein the hand grip 4 in the packed state serves simultaneously as a hand grip for the entire unit consisting of the strength machine and packaging. This case 61 can be cut/cast/pressed/carved out of foam, Styrofoam, cardboard, wood and so on, wherein the half-parts or case halves (or case box and case lid) 62*a* and 62*b* can even be designed identically. In this respect, there are no fundamental restrictions with regard to the materials used or the shape. A particular characteristic of the depicted embodiment is that the case itself preferably does not have its own "hand grip"; instead, the hand grip of the device serves simultaneously as the hand grip for the entire case. In other words, the inserted hand grip 4, which projects and protrudes outwardly with its middle grip 41, takes on the carrying function of the packed device. A particular characteristic of the design is also the recess (the hole 60), by means of which the cover 8 is visible. This recess could also be formed by a transparent window or by a continuous, preferably transparent wall section of the case material.

—Strength Wraps (Body Wraps) for Various Body Parts

The exertion of force during training is often exerted almost exclusively by the hands.

Most strength machines are provided with weights which are moved or lifted using hand grips or levers, cords or belts. The only contact surface between the human body and the loaded weights is usually the inner surface of the hand. All other body parts are indirectly subjected to loads only "from the inside" by the contractions of muscle, tendon and bone joints and pathways.

The invention enables all other body parts to also be subjected to direct loads, wherein the training force is directly transmitted by the "strength wraps," as we call them, to various body parts (as depicted in FIGS. 76 to 81).

When using the training device according to the invention, the following steps or method steps developed by the inventor can preferably also be taken into consideration, specifically:

Applying organic cream on the skin or on the wrap, and massaging it into the skin by means of kinetic movements.

Observation: The inside of the hand/palm gets no/hardly any wrinkles into old age in contrast to the outer side of the hand (outer hand/back of the hand), which gets wrinkles very early on. The soles of the feet also do not get wrinkles in contrast to the tops of the feet. A frequently performable rubbing-in with our invention would prevent the mentioned body parts (including the face and neckline) from getting wrinkles, or delay the formation of wrinkles (ageing areas) and diseases (skin, cardiovascular system and so on).

Furthermore, it may be noted that cancer hardly occurs on the inside of the hand/palm or on the sole of the feet (when subjected to loads, rubbing, etc., the blood circulation in the body parts is improved, the skin becomes cleaner and more elastic due to sweating into old age).

The strength wraps (or body wraps) 200 depicted in the drawings according to FIGS. 76 to 81 consist preferably of textile-like fabrications, which are possibly padded with other materials, such as foam or gel, and which can enclose various body parts (as shown for example in FIGS. 76 and 77) and are connected to a strength machine 1, e.g., by means of a hand grip 4 or directly by pulling elements 3 that can be removed preferably with the aid of couplings.

A strength wrap 200 preferably consists of a flexible but relatively firm and less elastic wrap 201, which can be applied to a body part 205, and which is attached or attachable preferably using a Velcro fastener connection 203.

By means of connection elements 204 firmly fixed to the wrap 201, the connection to the connection element/coupling 206 is created either according to prior art or by means of a coupling 5 as described. The connection element 206 (for example a clamp 5) creates the connection to the pulling element 3.

On the wrap 201, in the overlap region, there may be attached a scaled surface, where users can follow their progress, for example in regard to weight loss. Vibration motors, magnets or heating/cooling elements may also be installed in the wrap 201.

By turning the strength wrap around the body part 205, the user can determine the direction of the load. Particularly large-scale or asymmetrically combined strength wraps cannot be turned around, but have on their periphery multiple connectors 204 and 206, by means of which the tensile forces can engage at one location or at multiple locations simultaneously.

Exercising a body part using connected strength wraps 200 takes place by exerting a pulling force on the device 1. In this phase, a body part in question is pressed on a side opposite the tensile force. At the "dead point"=where the flywheels change their direction of rotation, no force is exerted for a brief period, as a result of which the body contact surface subjected to a load can rest.

During a first workout phase, pressure is preferably exerted on the body; the skin, muscles, nerves and lymphatic pathways are pressed in. The pressure on the vessels will act like a peristaltic pump, subject to the condition that a relief phase occurs after the pressure.

During the rest phase, the body parts under load have the load relieved so that one can say that "pulsing cycles similar to sinusoidal load cycles" occur. They have a very positive effect on the body because more blood can pulse to the smallest blood vessels. The lower skin layers are also supplied with blood and become elastic and wrinkle-free (like those of the palm of the hand) due to the rhythmically cyclical loads.

The continuous natural load is also the reason that the palm remains wrinkle-free and smooth until old age, in contrast to the outside of the hand for example, which is hardly exposed to loads and thus becomes wrinkly even at a younger age. Body parts that are rarely subjected to loads become fatty, pimply as well as inelastic and wrinkled. For example: the (double) chin, the backside of the hand, the backside of the upper arms, the upper inside of the thighs, the upper chest area, and so on.

By using the strength wraps and the pulsing strength training, body parts can be styled in a targeted manner.

The strength wraps can be warmed preferably with built-in and/or sewn-in electricity-conducting textiles.

Vibration elements, e.g., motors with weights mounted eccentrically on the rotor or current-conducting electrodes, can also be attached in the strength wraps for stimulation current therapy or training. The current may also originate from built-in rechargeable energy storage cells or batteries, as well as from applied current leads.

FIGS. 78 to 81 depict various body parts on which a strength wrap can be used or can engage. From these, one can see that strength wraps can be made and used for individual muscle or body segments, e.g., thighs, upper arms, knees, as well as for combinations of larger regions, such as the upper arm-shoulder-chest or abdomen-butt-thigh, for example.

In this respect, reference is explicitly made to the attached drawings, and as shown in the drawings, the individual parts, design, attachment positions of individual parts or relation of parts to each other, including the shape, circumference and position of the strength wraps, which clearly indicate how the parts are formed, arranged or exist with respect to and/or in relation to each other. In this regard, a written description will be at least partially skipped.

Additional load-inducing components can also be attached to body parts by using lateral couplings 207. These loads may also be "vibrations," generated for example by the oscillation of an eccentric shaft.

Sensors, Accessories, Electronics, Controller

In or on the device, there may be installed a plurality of sensors in a simultaneous or selectable manner: a rotational speed sensor (such as a Hall sensor) and/or a force sensor for measuring the tensile force exerted on the pulling element 3. The force sensor may be installed for example on one end of the pull strap or in the grip 4.

Here is the list of the sensors in or on the device, as needed (distributed as required, if necessary, on all components and/or modules):

Accelerometer or acceleration sensor (for measuring the acceleration/deceleration of the wheel (plates)), fingerprint sensor, gyro sensor, geomagnetic sensor, Hall sensor (for measuring the rotational speed of the flywheel 13), light sensor, RGB light sensor, loudspeaker, "Siri" or other voice identification software, touch ID fingerprint sensor, barometer, proximity sensor, GPS sensor/position locator, thermometer, motion sensor, infrared sensor.

Additional Functions

Furthermore, additional functions can also be implemented within the scope of the invention, which will be briefly listed below as follows:

Anti-theft sensor/locator, pulse monitor, blood pressure monitor, individual display for the controller, emergency signal transmitter at the touch of a button (geolocation+ standard message to defined recipients in an emergency), "screen mirroring" function=sharing the screen of your device with another device, mobile hotspot=connecting with another device that has internet access to thereby get internet access oneself, data exchange with other device, alarm system which makes a loud sound in an emergency.

The device can also be connected to the internet so that users can connect via their devices which are mounted to the device (or in the vicinity of the device) to train together, livestream, and so on. These include internet cable connection, mobile box, USB stick, stationary box, Bluetooth sensor, payment service connection.

A rechargeable energy storage cell is connected to the device, and/or a power source connection is provided.

Accessories for the Strength Machine

Heating plate, reheating device for liquids, fan heater, hair dryer, juice press/juice extractor, mixer, grinder, shredder, heating element, water pump, air pump, air fan, basically all electronic and/or non-electronic devices that are needed in a household.

For the do-it-yourself (DIY) realm: sander, drill, with elastic power cable, for engraving for example.

It is known that light having a daylight wavelength interrupts the release of the depressant hormone melatonin. Our device contains illuminated or illuminating parts or surfaces, which have a motivating effect for training and a positive psychological effect.

The electronically analyzed sensor signals can be perceived for example as light pillars on the housing or as a sound, via loudspeakers, which are installed in/mounted on the housing 20.

The housing may be covered with electroluminescent film (EL film for short), also referred to as luminous film, light film or condenser luminous film. The EL film is a technical application of electroluminescence for converting electrical energy into light.

The energy for the EL film can come from an external source or from an electric generator mounted in the housing, or a battery, energy storage unit, and so on.

Using a processor, the mass moment of inertia can be evaluated and automatically adjusted depending on the indicated body weight or for a pre-set training plan. Entering the data and controlling the device are done via displays that are mounted directly on the housing 20 or on the attachment module 2 via various depicted couplings. Control of the device is preferably via a so-called app=software application for smartphones or "tablets," and the users of the devices are connected via the internet. In this way, they can work out together, follow training sessions and presentations, and so on.

One possible application for the strength machine according to the invention is for use as a training device for astronauts in space, whose muscles have a tendency to atrophy due to weightlessness.

By contrast, training using traditionally constructed training devices, in which the muscles must be actuated by weights subjected to gravitational forces, seems less sensible and effective because the weights have no mass in a zero-gravity environment. Hauling umpteen-kilogram weights into space would be an extremely costly endeavor, where every gram is very precisely weighed for useful cargo, such as research equipment and material. Our solution is very simple: The device with its housing, shaft and so on is to be produced of very lightweight materials. Not even the flywheel weights 13 need to be heavy: they can be constructed of hollow shells/disks with separate interior spaces, which are later filled in space with liquid waste, such as urine, and then sealed off. Our device would function in space just as it does on earth, and have the same effect on the body as on the earth!

Electric Generator

FIGS. 33, 34 and 35 show various images of the strength module 1 in a partly disassembled view, said module being equipped with a generator device by means of which electricity can be generated. Additional details can be seen in FIGS. 36 and 37. Basically, the structure is of the type such that an electric generator, for example a radial electric generator 52, is mounted on or to the housing 20, in other words affixed to it or is part of the housing, which can then be set into rotation using the flywheel weights and/or the shaft 12 and is set into rotation during training. The reference sign 53 refers here to the housing of the electric generator 52. Furthermore, an energy storage unit or rechargeable energy storage cell is provided, which is indicated in the drawings using reference sign 54 (or the housing of such an energy storage unit or rechargeable energy storage cell).

FIG. 36 thereby shows the strength machine according to the invention, which is constructed and functions like a "pancake" or a "sandwich" generator. The (neodymium) magnets of a "rotor" are installed on a flywheel weight 13 and the wound-up coils 64 of a "stator" are installed on the housing 20.

FIG. 37 shows the strength machine according to the invention from a different perspective from that in FIG. 36.

The training device or the device in general can also function and/or be used as an electric generator by having one or more flywheel weights 13 repurposed as the "rotor" of an electric generator by the placement of (preferably neodymium) permanent magnets. The "stator" of the generator is mounted to the non-movable housing, specifically by installing corresponding "coils" 64. However, the generator can also be placed inside the strength machine, i.e., inside the housing, as shown in FIGS. 38 and 39. The electricity, which results as "waste" from the training, may be used for a large variety of purposes!

FIGS. 38 and 38*a* and 38*b* depict a different construction of the device wherein an emphasis was placed on electricity generation. It is very relevant that the flywheel weight(s) 13, which are secured on the shaft 12, can rotate specifically in only one direction and can be operated by the pulling force exerted via the pulling element 3 at an almost constant rotational speed. This is made possible by the installation of the element 94 (one-way free-running bearing) on the shaft 12, which functions like a ball bearing but can only rotate in one direction. It is immovable in the opposite direction and can transmit a torque.

This element (sometimes labeled with reference sign 65 and sometimes with reference sign 94) can naturally be replaced by a different element which can transmit a torque in only one direction (such as the rear wheel/drive wheel of a bicycle); in this case, the construction will be designed differently, particularly in a more voluminous manner. The element 65, i.e., the ball bearing shown in the drawings, allows a free rotation in one direction, whereas given a rotation in the opposite direction, the flywheel weights are entrained and driven due to the drive connection. It is also possible to provide a so-called freewheel bearing (for example, a "sprag clutch bearing") on the element 94, by means of which a rotation movement is freely possible in one direction, and a rotation movement of the bearing in the other direction then exerts a torque on the flywheel. In that case, a special reel 66 (see FIG. 74) is also installed wherein the pulling element 3 is wound up in the "upper" part, said pulling element being attached in a suitable manner for example at the location 67. The coil or the spring band 68 and/or 96 is installed under the reel 66. As one can also see in FIG. 74, the coil spring 68/69 is secured on its one end to the reel at position 69 (secured inside the reel and on the other end to the housing 20 stationary relative to said reel, specifically on the projecting "tongue" 71). An additional purpose of the tongue 71 is to maintain a clearance to the special freewheel bearing 65. Due to the fact that the inner ring of the special ball bearing 65 rotates and the housing/tongue 71 is stationary and also that a certain pressure contact is necessary for stabilizing the position of the special ball bearing 65 that carries the reel construct 66 and 68, friction heat develops in the contact region, said heat potentially causing the housing 20/71 to melt for example (if constructed of plastic). To prevent this, there are installed between 71 and 65 one or more special intermediate disks 72, which allow contact between the parts having reference signs 65 and 71 and simultaneously represent a "thermal barrier" for the heat transfer in direction 71. They are "special" because they are constructed of a thermo-resistant but simultaneously low-friction material, such as (polytetrafluoroethylene) PTFE/Teflon.

Furthermore, the "rotor" of the generator, which simultaneously serves as a flywheel weight, is secured to the shaft 12. Even though an additional flywheel weight in an electric generator would seem to be a disadvantage at first glance—the entire device becomes heavier for example due to the successive/alternative/irregular manual operation—this flywheel weight becomes a rotational speed regulator: the greater the flywheel weight, the more stable the rotational speed. This rotational speed is precisely measured for example by installing a (Hall) sensor, shown on a display, and the training/electricity-generating person can dispense his or her (pulling) force to reach a certain rotational speed, which can simultaneously be converted into a certain current intensity or to achieve a certain objective (for example charging a current accumulator for illumination, sending an emergency call signal, preparing food by cooking, frying, mincing, etc.).

In FIG. 38, the "rotor" is constructed as a coherent "ensemble" out of the flywheel 13 and the magnet mount 73 (such as a resin-like mixture, into which the magnets are secured or cast) and by the (neodymium) permanent magnets 63 and/or 74. Technologically, the ensemble becomes simpler by constructing the magnets 74 in a mount that looks like the parts 13 and 73 (out of non-magnetic materials). This ensemble will work as well, because the magnets 74 have a high density and function overall like a "flywheel weight."

In FIG. 38, the "coil" of the electric generator is installed in the housing 20 or in the lid 20.1, wherein in FIG. 38, multiple coils 64 are provided, which may be cast, adhesively bonded, and so on.

As shown in FIGS. 38 and 39, the shaft 12 can provide coupling 76 on one (or both) ends, for the coupling of the existing one to another "generator." In this way, multiple individuals can train and generate electricity at the same time, and the generated electricity can be connected "in parallel" or "in series" to achieve a certain objective.

The coupling 76 may have the appearance according to prior art or as depicted in FIG. 38, wherein it has a central recess 78, in which (if coupling to additional devices is to be undertaken) a centering pin 79 can be inserted to fasten multiple coupled devices to one another by their shafts 12, in other words to connect them to each other, specifically by creating a centering of the individual shafts to each other.

In other words, FIG. 38 thus shows a different construction of the device according to the invention, wherein a special characteristic is that the flywheel weight(s) 13 cannot rotate back and forth, in other words alternately in both directions (like a yo-yo), but only in one direction at an almost constant rotational speed. This is possible using a mechanism which is installed on the shaft 12 and functions as follows: the strength training element 1 is constructed as before with the difference that the pulling force is not transmitted directly to the shaft 12 but to a reel 95, which is seated on a one-way bearing 94. At the same time, the reel is attached on the outer diameter of the coil spring 96. The inner end of the coil spring 96 is secured to the housing 20. By pulling the pulling element 3 in one direction, first the reel, then the freewheel bearing 94, then the shaft 12 and subsequently the flywheel weight(s) 13 (having the neodymium magnets=rotor of a "pancake electric generator") are brought into rotation. The large weights 13 ensure an almost constant rotation speed. The coils 64 of the stator are mounted on the stationary housing 20. Electricity is induced by the rotation.

In regard to the construction as shown in FIG. 38, it shall be noted that the housing 20 is constructed differently than in the other shown exemplary embodiments, wherein an "inner part of the housing" encases the reel 95. This construction can be applied to both "conventional" strength modules 1 as well as to strength modules for electric generators, and is illustrated in greater detail in FIG. 39.

Lastly, FIG. 39 shows the strength module according to the invention with the housing 20, which is arranged to extend around the reel 97.

Furthermore, reference is made to FIG. 40, which shows a variant for mounting the strength machine 1 according to the invention to a pole 82 (specifically in a side view).

FIG. 41 depicts the strength machine 1 mounted to a pole 82 in a perspective view. In both variants, the pole is inserted inside the cylindrical holding region 58 of the half-housing 20.2. The height is adjusted using for example a ring-like stopper 83, which can be attached with a fixing screw 84.

FIGS. 42 to 46 show a variant for attaching the strength machine 1 according to the invention by means of a mounting adapter 85, which can be mounted on door frames or wall ends (this mounting adapter 85 is shown in various perspectives in FIGS. 42 to 46). The strength module 1 is attached to a door frame or a free wall end using the adapter 85, as shown in FIGS. 47 to 50. The mounting adapter 85, like the attachment module 2, has a plurality of coupling possibilities, which were not depicted in these drawings, however.

FIGS. 47 to 50 show the attachment of the strength module 1 on a door frame 89 or on a free wall end. Using mounting holes 111, an adapter can be mounted directly to a wall, e.g., using screws.

FIGS. 51 to 55 show the mounting of the strength module 1 according to the invention to a wall using an assembly having a board 99, wherein the support or the board 99 is mounted to a wall for example preferably using screws. The strength module 1 is mounted to the board 99 by means of the mounting adapters 101. The mounting adapter 101 (which can be constructed similarly or identically to the previously-described adapter 85) also has, just like the attachment module 2, a plurality of coupling possibilities.

FIGS. 56 to 61 depict the guide cover 102, which represents a further development of the guide cover 7. A key aspect in that respect is the more solid construction, which inhibits vibrations and reduces noise. In addition, the pulling element 3 ensures a smooth wind-up between the guide walls 105 without contacting the flywheel weights 13, secures the two half-housings 20.2 using the guide pins 103 and the magnets 104, has a protective function by preventing finger access to the rotating flywheel weights 13, and has a design function.

FIGS. 62 to 66 represent a further developed variant of the mounting adapter 85, which allows a more versatile implementability, as shown in various perspectives. In other words, a variant is thus discussed below which pertains to the universal attachment module with which the strength module 1 can be attached or mounted either to a wall (as shown in FIGS. 51 to 55) as well as to a door frame (as shown in FIGS. 57 to 60), and can thus generally be supported. The elements discussed below are particularly significant here:

- the support surface 86 is provided with a possibly removable anti-slip and/or anti-vibration layer 107, which can be raised in the force application region 87 (necessary for mounting) as well as 108,
- a key factor here is that this results in a universal attachment module, which is suited for mounting the strength module 1 on a wall, as shown in FIGS. 51 to 55, as well as for mounting on a door frame, as shown in FIGS. 47 to 50.
- it increases the pivoting capability of the strength module, by the tapering 110 in the holding mount 88, the mounting holes 111 allow the preferably direct attachment to a wall/support.

This mounting adapter 109, like the attachment module 2 and 85, has a plurality of coupling possibilities, which were not depicted in these drawings, however.

In the event that the adapter 109 is used for a preferably direct and thus fixed (by screwing) wall mounting, the unused region 87 is covered by the cover 112. This cover 112 also has a plurality of coupling possibilities, which were not depicted in their entirety in these drawings, however.

FIGS. 67 to 69 depict the universal attachment module 109, the masking cover 112 and the strength module 1 in various perspectives.

A housing is illustrated in FIGS. 70 to 73 wherein the cylindrical segment 58 is hollow inside. This allows for mounting and fastening to a pole, as shown in FIGS. 40 and 41. The cover plug 113 was designed to configure this housing in a more universal manner, said cover plug being attached to the cylindrical region 58 by means of its own coupling (such as bayonet, thread, etc.). In addition, this plug 113, like the attachment module 2, 85 and 106, has a plurality of coupling possibilities, which however were not depicted or only partially depicted in these drawings.

FIG. 74 shows a strength module converted into an electricity-generating module. The design is very similar to the embodiments described with reference to FIGS. 33 to 39, yet with the difference that it uses the housing 20, which has been described so far and is thus simpler. The operation is similar to what is described in FIG. 38. In FIG. 74, one can better see the zone "under" the coil spring 96, where the extension/tongue 71 of the non-rotating housing 20 (necessary for mounting to the coil spring) contacts the rotating inner diameter of the one-way freewheel bearing 94. Rotation produces friction and heat. To prevent melting or damaging the housing, one or more thermo- and friction-resistant disks 114 were installed here (between 20 and 94). This design can be bypassed by replacing the tube-shaped extension/tongue of the housing 20, which is necessary for attaching the coil spring 96 to it, with an actual, preferably separate, tube (which again is friction- and thermo-resistant).

FIG. 75 is similar to FIG. 7, with the difference that the guide element 7 was replaced by the guide cover 102.

FIG. 76 depicts the fundamental principle of a strength wrap 200. A strength wrap is made of a flexible but difficult-to-stretch material, such as a textile material for example, which is also "breathable." The body wrap 201 envelops the body part in question and overlaps it in the region 202. This overlap is preferably equipped with a "Velcro closure" 203 to attach the wrap to the body part 205. Instead of a "Velcro closure," one can naturally use another coupling option. The force application on the strength wrap occurs via a "connecting wrap" 204, which is firmly bound to the body wrap 201 (if necessary along its entire "height"). The (preferably two separate) lateral connection wraps are attached to a coupling 206, which in turn is connected to the pulling element 3. By exerting a traction force F, the body part that is placed opposite the exerting force is subjected to a load.

Figure 80:
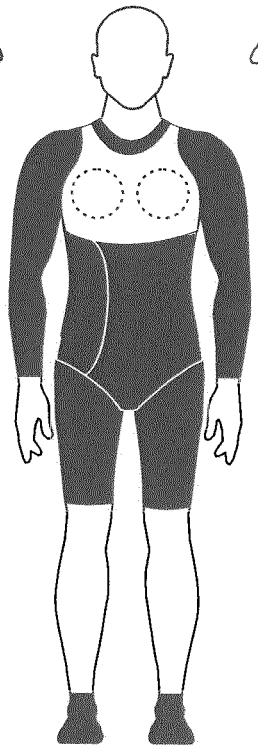
Figure 81:
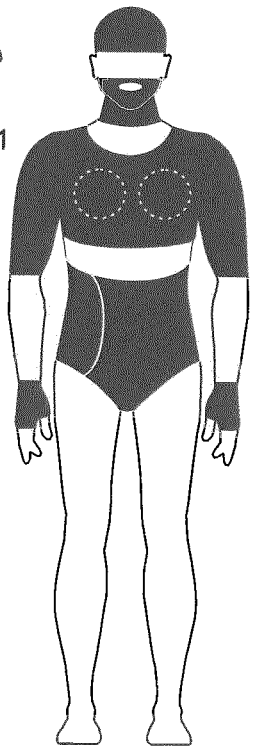
Figures 82A, 82B, 82C, 82D, 82E:
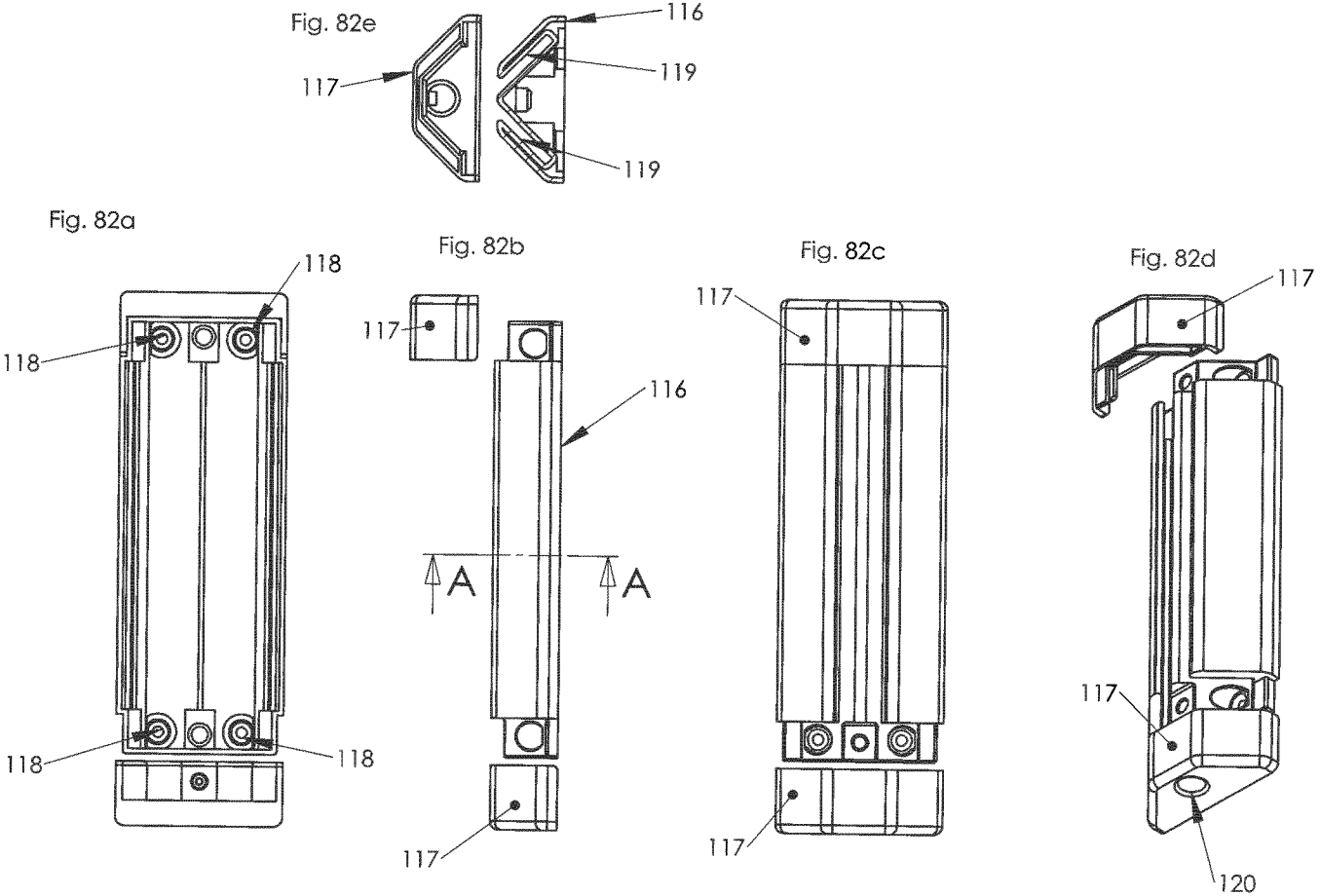
Figures 83A, 83B, 83C, 83D, 83E:
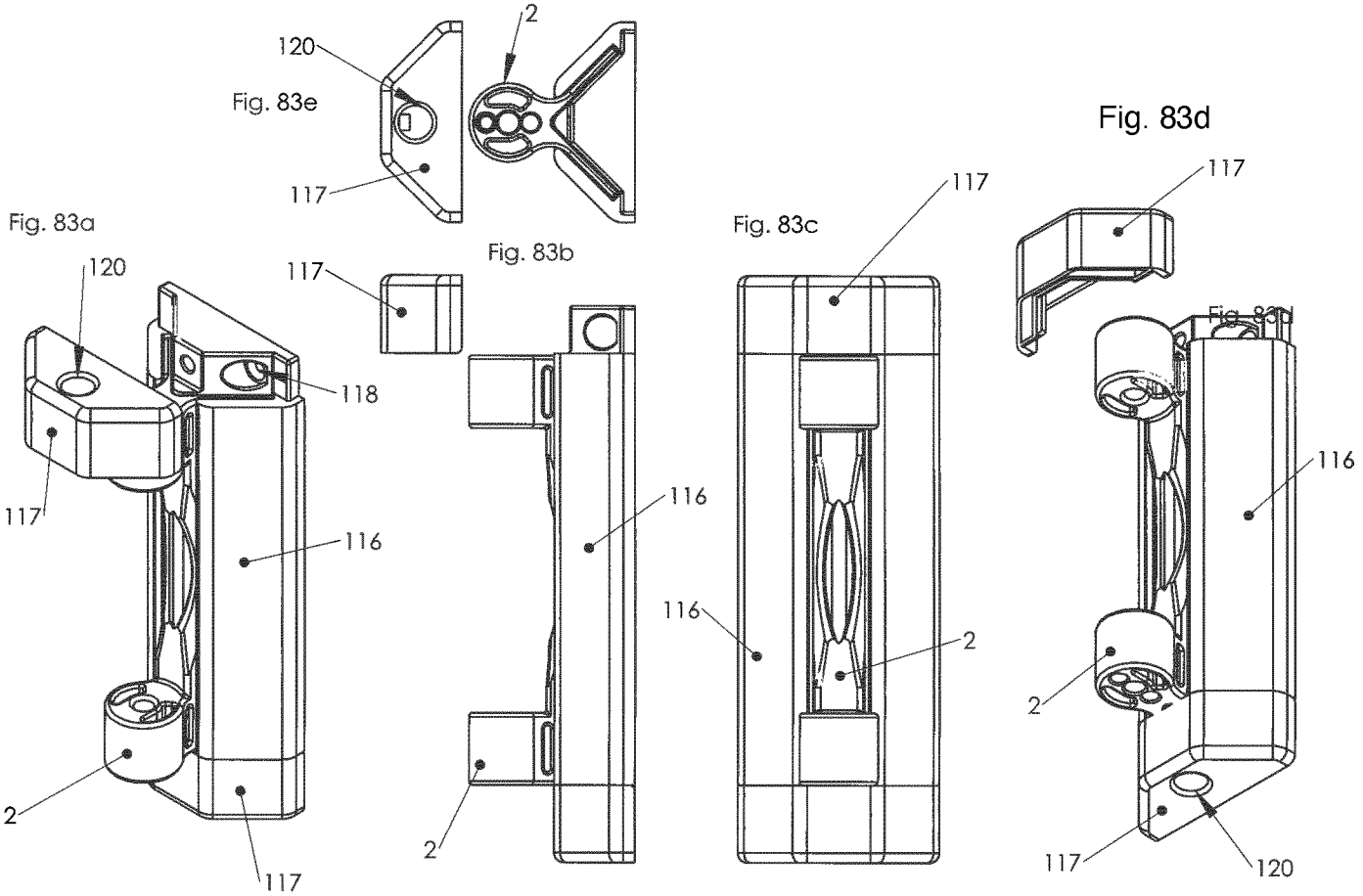
Figures 84A, 84B, 84C, 84D:
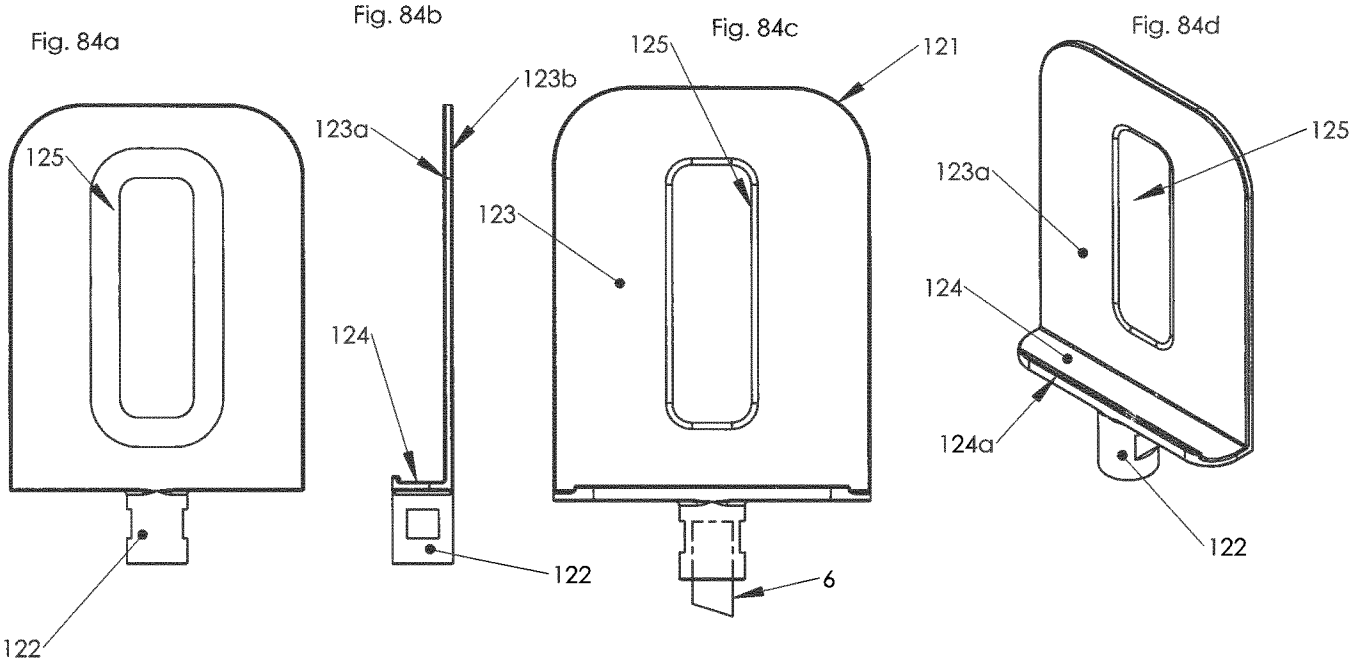
Figures 85A, 85B, 85C, 85D, 85E, 85F:
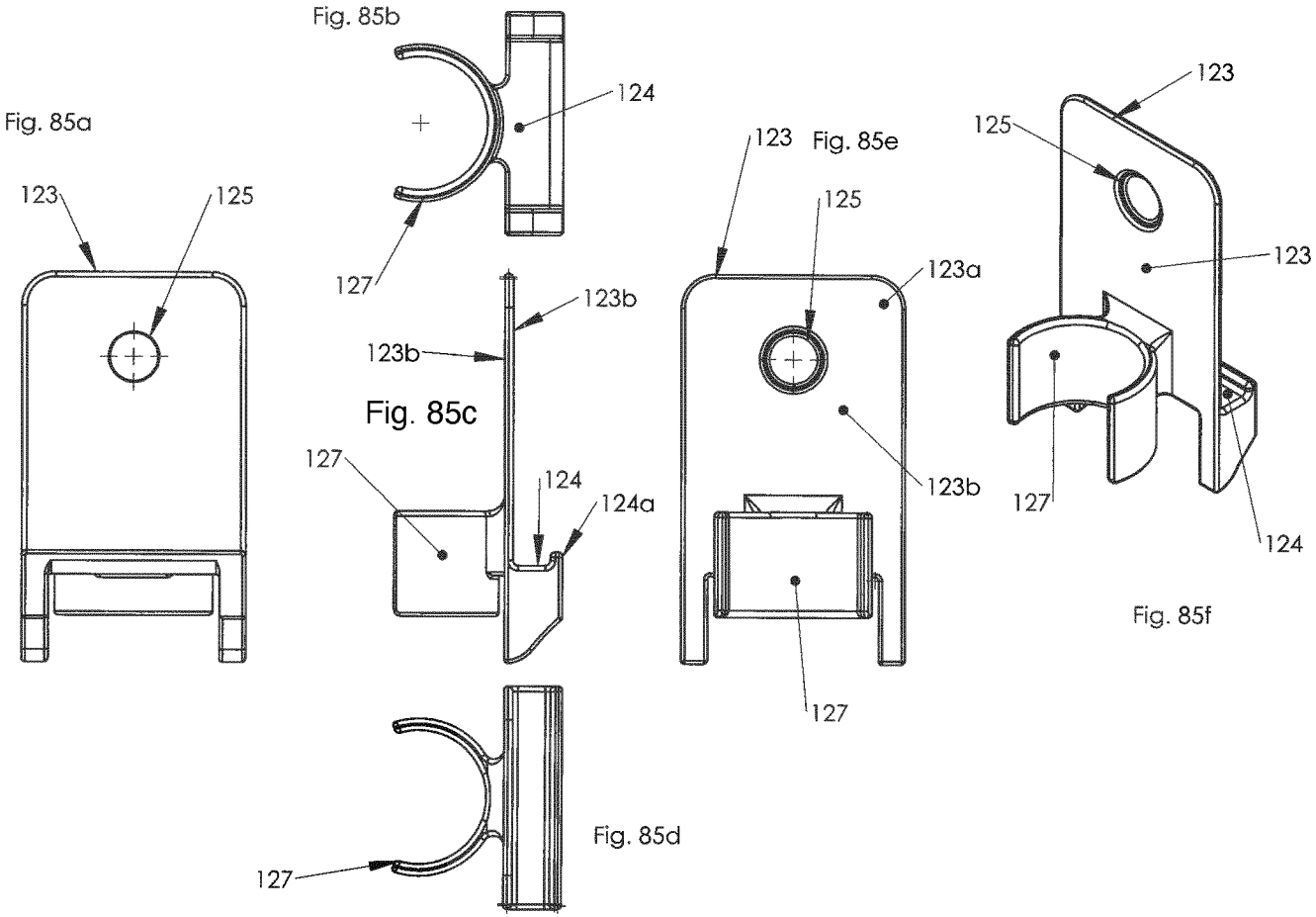

FIGS. 78 to 81 depict (in areas colored in black) different types of strength wraps, which cover individual body parts (FIGS. 78 to 79), such as the forehead, chin, chest, upper arm, forearm, waist belt, hand, thigh, calves, feet, neck, shoulder, elbow joint, abdomen, knee joint, ankle joint or larger body surfaces (as depicted in FIGS. 80 and 81).

FIGS. 82, 82*a* to 82*d* show a wall adapter for mounting the strength machine according to the invention. The wall adapter 116 can be mounted on its upper and lower end to a wall by means of screws, for example, for which corresponding holes 118 are formed. These holes provided on the upper and lower end region of the adapter 116 can be plugged by attachable wall adapter covers 117 so that the screws then used for mounting are not visible.

FIGS. 83 and 83*a* to 83*d* show a wall adapter with the attachment module, already shown and described in FIGS. 13 to 16, in the form of a universal adapter in various perspectives. Hereinafter, reference will be made to FIGS. 84*a* to 84*d*, which show an adapter 121, e.g., having a bracket 123, which can be installed on the strength machine preferably at different locations.

The bracket 123 is hereinafter also referred to in this connection as a rear bracket 123, which comprises a rear wall 123' as well as a base, base support or base bracket 124, which is preferably provided with a border 124*a*, projecting upward and spaced apart from the rear wall 123' on at least part of its length. The front side of the rear wall 123' is labeled with the reference sign 123*a* and the rear side of the rear wall 123' is labeled with reference sign 123*b*.

This bracket 123 is preferably provided with a downward-projecting coupling part 122, by means of which this bracket can be installed for example by means of a pin or hinge coupling 6 to the housing 20 or the housing frame 141 of the strength module 1.

For example, a mobile communications device, a smartphone or, e.g., a tablet 121*b* can be placed on this bracket so that in this way one has the ability, when using the strength module 1 and via the switched-on mobile communications device, to simultaneously also have telephone conversations and/or look at photos, select and listen to music, view photos and/or movies, or record current videos and/or transmit or store them.

Furthermore, a recess 125 provided in the rear wall 123' also preferably has a position and/or size such that a camera is unobstructed there and can take pictures.

FIGS. 84*a* to 84*d* show the bracket 123 in various side illustrations and once in a perspective view.

FIGS. 85*a* to 85*f* depict a comparable bracket 123, which is also used to place down and secure a mobile communications device, for example, particularly a mobile phone or a tablet 124*b*, etc., in such a manner that this mobile communications device or tablet can also be used while the strength module 1 is being utilized.

The bracket 123 shown in FIGS. 85*a* to 85*f* in various illustrations is distinguished by a different coupling part, which has, instead of a somewhat tube-shaped coupling part 122 provided on the lower region of the bracket 123 in the preceding figures, a coupling part 127 formed on the rear side 123*b* of the rear wall 123', said coupling part being designed in a more than semicircular manner from an overhead view, and thus able to be fitted in a snap- or latch-like manner on a corresponding spar-like section of the housing or housing frame of the strength module.

The variant according to FIGS. 85*a* to 85*f* thus involves a bracket 123, which can also be referred to as a "rotatable adapter" or "rotatable or twistable or pivotable bracket." The rotation results because the side walls of the element 124 embrace the housing 20 of the strength module, as one can see in FIG. 86, and is thereby entrained by its rotational movement.

Reference will also be made below to FIGS. 86*a* to 86*c*, which show an exemplary embodiment of the strength module 1 according to the invention, having a wall adapter 116 shown by way of example and associated wall adapter end piece 117 (which are shown here only for illustrative purposes and which may also be designed in an entirely different manner), wherein three mobile communication devices 121 are depicted which are indirectly attached at various points using the described coupling parts on the strength module 1 to be pivotable with it or using the described coupling part 127 on the stationarily mounted wall adapter 116 or wall adapter end piece 117 and are thus also partially pivoted along with the module that pivots about the pivot axis of the strength module; thus, its orientation is kept in accordance with the wall adapter 116/117.

In other words, FIGS. 86*a* to 86*c* show three brackets 123, which are designed differently and which at various locations are mounted to the strength module 1 to be movable with it or pivotable with it or are detachably mounted to the stationarily attached adapter part and when pivoted, the strength modules 1 are partly pivoted along also. Shown only for illustrative purposes are different mobile communication devices and/or tablets 121 etc., which are placed in and held by the various brackets. This illustration serves only as an example to clarify the different variants.

Figures 87A, 87B, 87C, 87D:
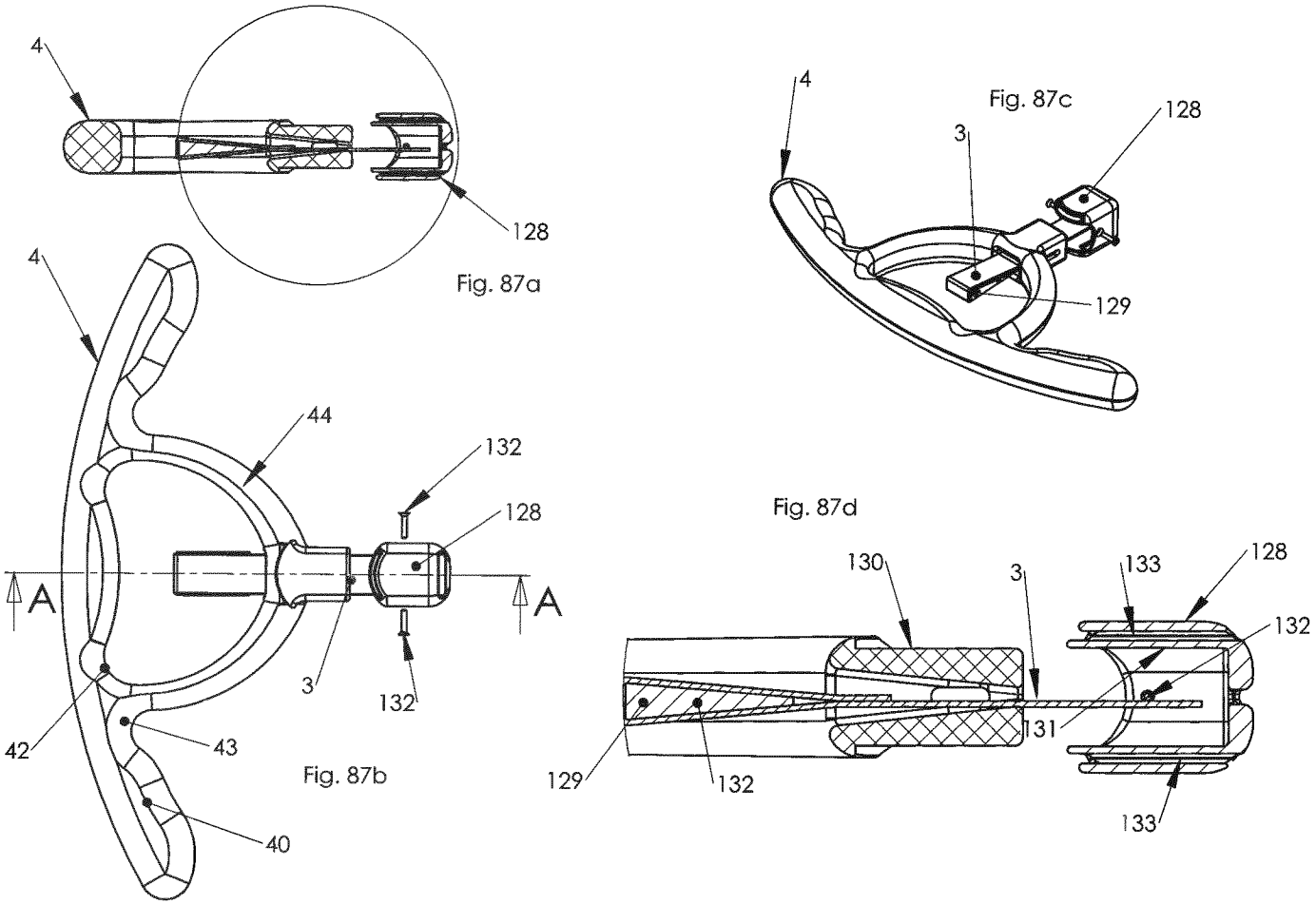

FIGS. 87*a* to 87*d* will be addressed below, wherein FIG. 87*d* represents the circular section shown in FIG. 87*a* in a magnified illustration.

These drawings show a coupling by means of which the pulling element 3 (particularly a strap or a belt 3) in question can be correspondingly fixed, i.e., attached.

This attachment is used to attach the belt 3 for example to the hand grip 4, particularly to its middle or central arc 44. In regard to the structure of a corresponding hand grip, reference is made to the preceding drawings, which show various variants of such a hand grip in detail.

The exemplary embodiments explained below by means of drawings for attaching a pulling element or belt are of significance in themselves and may also be used as an innovative solution within the scope of entirely different devices or applications.

Within the scope of the invention, the belt 3 is preferably attached using a stopper 129, which is preferably designed as a wedge 129.

This stopper 129 or wedge 129 is used to removably attach the pulling element end 3', in particular a belt end 3', using the mentioned stopper or wedge 129 on the hand grip.

Additional reference is made here in particular to FIGS. 88*a* to 88*c*, which represent the details in enlarged form.

The entire structure can be seen in FIG. 88*c*.

To this end, the coupling device comprises an inner body 130 having an outer contact surface 130*a* and having a recess 130*b* adapted, preferably at least sectionally, to the stopper or wedge 129; ultimately the stopper or wedge 129 is pulled further into said recess when the pulling element 3 is placed under load in pulling direction F, and thereby ultimately in a press fit compresses the belt end 3' between the outer surface 129*a* of the stopper or wedge 129 and the inner surface 130*b* of the inner body 130. The compression results from the fact that the diameter of the stopper or wedge 129 ultimately has a diameter or a thickness dimension which does not further permit additional retraction into the clearance space, which tapers in pulling direction F in the shown exemplary embodiment, for receiving the stopper or wedge 129.

FIGS. 88*a* to 88*c* show the belt end 3' in the secured position.

To adjust and/or thread or remove the pulling element end 3', the coupling outer wrap 128 would have to be adjusted corresponding to the arrow 128*a* with respect to the inner body 130 until the coupling outer wrap 128 is adjusted from the position shown in FIG. 88*c* to the open position shown in FIG. 89*c*.

In other words, a clearance space AR is designed in the secured position between the front side 130*a* of the inner body 130 and the opposite front side 128*b* of the coupling outer wrap 128. To open the coupling via the mentioned coupling outer wrap 128, the latter may be adjusted corresponding to the arrow 128*a* with respect to the inner body 130 until the inner front side 128*b* of the coupling outer wrap 128 abuts the front side 130*c* of the inner body 130, and the clearance space AR no longer exists.

It is important here that the mentioned coupling outer wrap 128 is connected/adjusted via a screw or a bolt or another entrainment member 132 with the stopper 129 preferably in the form of a wedge 129, which tapers in the pulling direction F with respect to the inner body 130, so that spacing surfaces between the stopper 129, particularly in the form of the wedge 129, and the inner contact surfaces of the inner body 130 thereby have a greater clearance.

In this way, the pulling element end, preferably in the form of a belt strap end 3', thus lies in a pressure-free manner in this clearance space. The belt strap end can now be easily pulled out or a corresponding pulling element end can be inserted via a through-hole 134 with which the inner front side of the front wall 128*b* is provided.

If a belt strap end 3' is passed through the through-hole 134, specifically so far that the belt strap end 3' is placed around the loose stopper or wedge 129 and projects outward again via the hole 134, and then based on this open position according to FIG. 88*c*, the coupling outer wrap 128 is adjusted, in the pulling direction F of the pulling element 3, then the stopper 129 or the wedge is thereby also moved from the open position shown in FIG. 88*c* into the closed position shown in FIG. 89*c* so that the clearance as shown in FIG. 89*c* between the contact or pressure surfaces between the stopper or wedge outer surfaces and the inner surfaces of the inner body 130 is overcome and the pulling element end is held in a pressed-in manner between these surfaces.

To execute the adjustment of the coupling outer part or the coupling outer wrap 128 with respect to the coupling inner body 130, the outer contact surface 130*a* on the inner body and the therewith interacting inner surface 133*c* of the coupling wrap 128 is aligned in an axially extending manner and thus form-congruent, for example flat, cylindrical, etc., so that the coupling outer side 128 can be displaced on the inner body 130 in a sled-like manner in the longitudinal direction through a guide 131 formed in this manner relative to said guide.

As depicted, the cross-sectional image of the stopper 129 is preferably designed here in the form of a wedge tapering in pulling direction F, with the corresponding receiving space for the stopper or wedge 129 also adapted correspondingly to the cross-sectional shape of this stopper.

This allows, therefore, a simple and convenient attaching and/or replacing of a corresponding pulling element using the corresponding coupling.

Reference is made below to first to FIGS. 90*a* and 90*c* and to FIGS. 91*a* to 91*c*.

These examples show that the strength module 1 may have a housing that comprises two housing halves 20.2, wherein these housing halves 20.2 are also referred to as housing frames 141.

This housing 20 is preferably separated in a dividing plane TE running perpendicular to the axis of rotation, i.e., to the shaft 12, in the depicted exemplary embodiment preferably by a middle plane TE running perpendicular to the shaft 12.

These housing halves 20.2 can be pivoted on their rearward adapter side (in other words preferably opposite to their opening, through which the pulling element passes), in each case about a pivot axis 141' from their closed position shown in FIGS. 90*a* to 90*c* to their open position shown in FIGS. 91*a* to 91*c*, in which the two housing halves 20.2 are each individually pivoted away from each other. In this pivot position, the at least one inner flywheel disk is situated with the associated outer cover 8 holding the flywheel disk in a sandwich-like manner.

In the depicted exemplary embodiments, the strength module is mounted, as repeatedly described, to an attachment module 2 by means of a pin 6, by means of which preferably a vertical pivot axis is created for the strength module 1 with respect to an attachment module 2. Furthermore, one can also see in FIG. 91*a* the mentioned housing frame 141, which may be provided in a flange-like manner with at least a slightly angled cross-section, in which there is formed inside not only a housing side wall 142, but there may be inserted said housing side wall consisting of a different material, which is designed to be transparent for example. The preferably transparent housing side wall 142 can also be designed graphically, as is also indicated in the figures.

The attachment module 2 shown in the figures corresponds to the attachment module depicted in FIGS. 16*a* to 16*f* and corresponds largely to the embodiment according to FIGS. 13 to 16 except for the differently-designed recess 30.

As an extension of the aforementioned embodiment, FIGS. 92*a* and 92*b* show that regions of the strength module 1 inside the housing arrangement can also be used as storage space 143.

In the open position according to FIGS. 92*a* and 92*b*, one can see that between the two flywheel disks 13 used there, one or more storage spaces 143 can be provided positioned in an offset manner in the depicted clearance space in the peripheral direction of the flywheels. This is possible because the actual pulling element requires only a small receiving space around the shaft 12, even if the pulling element is completely wound up around the shaft 12. In other words, an external radial space 143 is left, which lies unused. This storage space 143 can be opened and closed by means of a lid 140 for example (in particular when housing halves 20.2 are folded open), so that various utensils can be accommodated (such as identification cards, wallets, keys, etc.) here, too. There are no limitations in this respect.

The structure of the storage space is also further described first by means of the additional FIGS. 93*a* and 93*b* as well as FIGS. 94*a* and 94*b*.

The storage space can thereby be defined or formed by a segment-like insertable storage space housing or a storage space chamber 143', which can be opened or closed by means of the shown lid or pivot lid 140 running in a peripheral direction and pointing radially outward.

In the described variants, an upper and a lower storage space 143 are provided offset in the transverse direction transversely to the strap guide 144 (by means of which the pull strap is guided into and out of the housing) and thus in a parallel direction to the pivot axis (which is defined by the longitudinal direction of the pin 6 in the attachment module 2), said upper and lower storage space each having a storage space housing 143'.

FIG. 95 shows once again the corresponding design having the two storage spaces 143 in a cross-sectional view lengthwise through the shaft 12. In the cross-sectional view according to FIG. 95, one can also thereby see a strap guide 144 comprising two disk- or plate-shaped elements, wherein the disk- or plate-shaped strap guide elements are offset to each other in the direction of the axis of rotation and are connected with respect to the shaft 12 by a spacer-strap guide 150 in a radially outward offset manner.

FIGS. 96*a* to 96*g* will be addressed below in conjunction with FIGS. 97*a* and 97*b*.

In this embodiment, an upper and a lower storage space 143 are also provided again as was described by means of the preceding exemplary embodiments.

In the variants depicted in FIGS. 96*a* to 96*g* and 97*a* and 97*b*, the special characteristic consists of the fact that the individual elements shown by means of the other preceding exemplary embodiments, namely the two partial ring-shaped strap guide sections 144*a* oriented in a spaced-apart and parallel manner in the direction of the shaft 12 as well as the inner support structure 145, the so-called base of the inner structure 147, and the spacers 148 (for the housing frame 141) are designed in a quasi one-piece manner. This results in an inner housing 210 having two identical inner housing sections or inner housing halves 210*a*, which are arranged spaced apart from each other in the direction of the shaft 12 and are attached to each other on their side opposite the pull guide.

At the same time, these inner housing halves 210*a* have an inner heart-like recess 208, in which the central section about the shaft 12 becomes visible at least in a partial peripheral region (when outer housing halves 20.2 are folded open), from which the mentioned pulling element 3 extends away.

This allows direct access to the central shaft 12 when the housing halves 20.2 are opened without a major disassembly of major components of the strength module 1, for example to attach a new pull strap 3 on said shaft. One can see this in a particularly clear manner from the perspective view according to 97*a*.

Figures 96A, 96B, 96C, 96D, 96E, 96F, 96G:
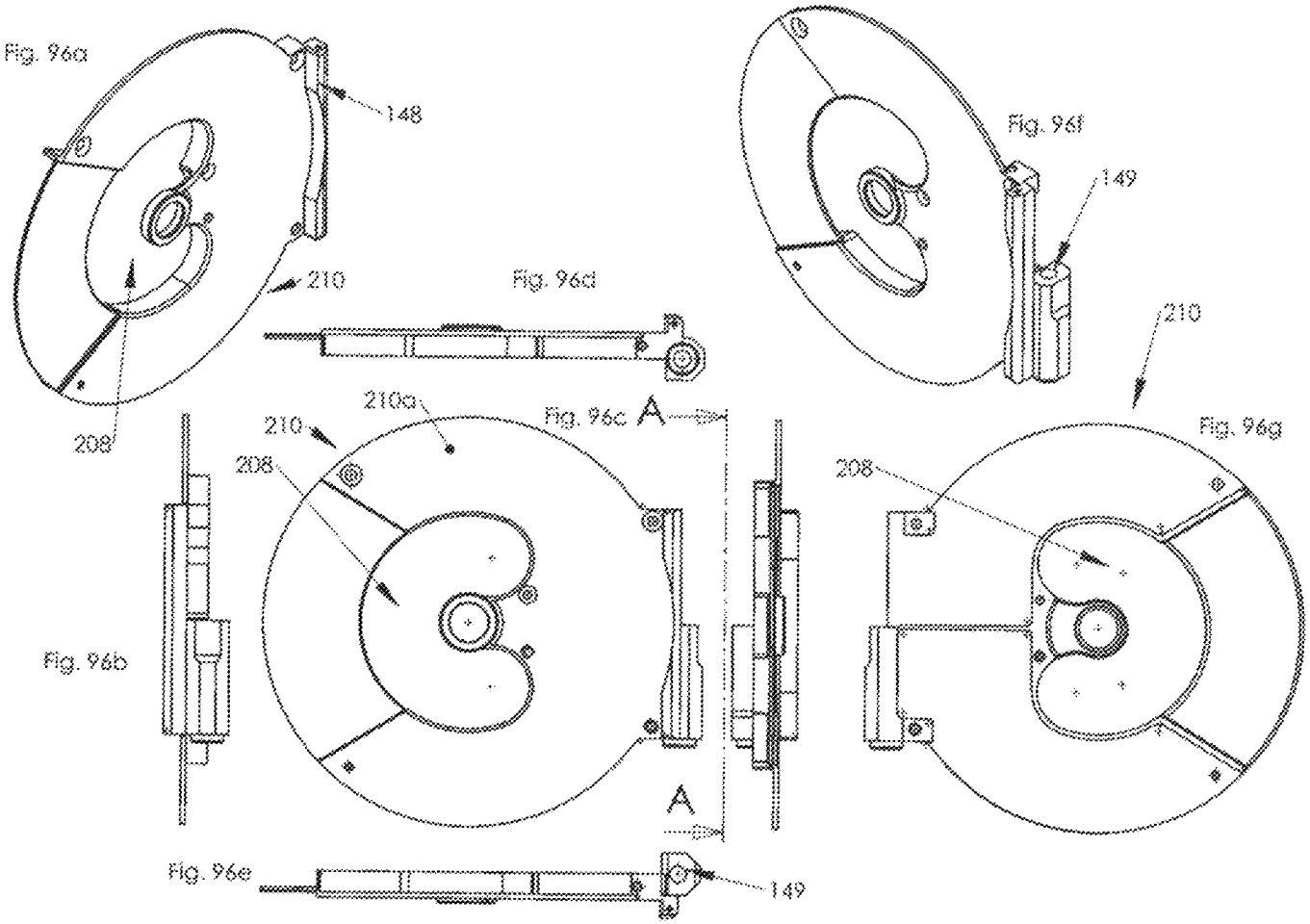

For a better view, the perspective representation according to FIGS. 96*a* and 96*f* shows in each case only one of the two inner housing halves 210*a* as they are attached to the rearward spacer 148 (identical to the anchoring region 358). It is important that the two housing halves 210 as well as the two housing frames 141 are identical.

FIGS. 98*a* to 98*d* will be addressed below to clarify in an individual illustration how the two housing halves 20.2 can be designed.

With 141, the figures show the housing frame, with 153 the opening for the pulling element 3, and with 152 a hinge for the housing frame 141 to pivot the thus-formed housing half 20.2, which as shown is also referred to as housing frame or housing frame halves 142, with respect to the rearward holding mount in the closed or open position.

FIG. 98*c* shows a cross-sectional view according to the line B-B from FIG. 98*a*.

In other words, FIGS. 98*a* to 98*d* show only one of the two housing halves 20.2. 154 represents a logo holding mount 154, which can be mounted on the outside of the at least one housing half 20.2.

A few simplified variants of the solution according to the invention are described below.

FIGS. 99*a* to 99*d* depict a simplified housing having an exit opening for the pulling element 3, which is provided on the opposite side with an anchoring section 358, as explained by means of other exemplary embodiments. This anchoring section 358 is firmly connected to the housing or is a one-piece component of the housing 20. It is preferably provided with two opposing holes 37 to—as already explained by means of other exemplary embodiments—mount the strength module 1 to corresponding adapters or attachment modules.

FIGS. 100*a* to 100*e* show how the strength module can ultimately be attached to a pole, tree and so on by using an attachment module 2. The attachment module 2 is connected to the strength module 1 using corresponding pins 6, which are inserted in the mentioned holes of the anchoring section 358 to form a pivot axis. The shown attachment module 2 can then be attached with corresponding attachment straps 360 to the mentioned attachment poles.

As shown, two separate attachment straps 360 or 45, arranged in a spaced-apart manner in the direction of the pivot axis and thus offset to each other, can be used. Additionally or alternatively, it is also possible to use only one preferably middle attachment strap 360 or 45.

In one variant according to FIGS. 101*a* to 101*d*, a continuous attachment module 2 extending in a longer manner in the direction of the pivot axis is not provided; instead two attachment module parts 2' spaced apart in the longitudinal direction of the pivot axis are used, which are designed in an approximately angular manner and comprise two side-piece sections, which can be oriented at almost any desired angle to each other (for example between 45° and 135°). The two mentioned attachment modules are in turn, as explained, connected in an articulated manner to the anchoring section 358 of the housing 20 of the strength module 1, wherein the two mentioned attachment straps 360 or 45 can be used in a peripheral manner to enable attachment to a pole 46, for example.

The variant according to FIGS. 102*a* to 102*d* shows a housing 20 whose two opposite housing sides are provided with an assembly section 362, which may be created for example in a recessed manner in the housing surface, but is not required to be.

One can then place in it, for example, an optionally interchangeable anchoring section 358, as shown in FIGS. 102*a* to 102*d*. The anchoring section 358 seen there has two fork-shaped projecting anchoring regions 358*a*, with which thus-formed anchoring sections 358 can be fit on the housing 20 of the strength module 1. The size and shape of these anchoring sections 358 can be adapted to the deepest assembly section 362. The connection can be of a latch or clip element type to in itself ensure a sufficient hold. For removal, one would then have to bend the at least slightly elastic anchoring sections away from each other to be pulled off the housing again as needed. However, the anchoring regions 358*a* preferably have another hole 360, through which a screw can be turned into a threaded hole 363 in the respective underlying section of the housing 20 there. In this way, a firm connection between the thus-formed anchoring section 358 and the actual housing 20 of the strength module 1 can be created. Mounting a corresponding attachment module 2 takes place as explained by other exemplary embodiments.

In the variant according to FIGS. 103*a* to 103*d* (contrary to exemplary embodiments described further above), the mentioned anchoring regions 358*a* are designed longer than in the aforementioned exemplary embodiment and are not anchored for example by means of a clip or latch connection to an assembly section 362 to the outer surface of the housing 20 of the strength module 1; instead they are designed that long and provided for example with a recess 368, into which a section or a projecting anchoring section engages, which is ultimately centrically connected to the housing 20 and/or the rotation shaft, and so on. The anchoring section 358 can thus be braced directly by the housing and/or the shaft, particularly when one or more flywheels are to be held by it in a free-running manner. The anchoring section 358 with the protruding anchoring regions 358*a* would thus also act as a sort of housing frame.

Instead of the exposed flywheel weights 13 shown in the figures, a corresponding housing—as in the other exemplary embodiments—could be used with a corresponding belt opening in precisely the same way, and simultaneously have the corresponding attachment mechanism, as is shown by FIGS. 103*a* to 103*d*.

The variant according to FIGS. 103.1*a* to 103.1*d* exhibits another variation of the exemplary embodiment of a training device without an outer housing, wherein the coupling 358 for mounting to a solid support is placed on a fork-like structure outside of the flywheels.

Finally, contrary to the aforementioned FIGS. 103.1*a* to 103.1*d*, another variant is shown according to FIGS. 103.2*a* to 103.2*d*, in which the strength module is implemented without a housing, wherein however instead of a fork-like support structure externally encompassing the two flywheel disks, a support structure is now shown that internally carries the flywheel weights that are offset axially along the shaft 12, with the flywheel disks thus being fully visible from the outside. As another example, this variant-which may also be implemented in other exemplary embodiments-provides that only one rearward rigid anchoring section is connected to the inner support structure to thus bring the module in contact with a pole, for example, to which said module can be attached using an encircling belt, which can be passed through the shown slit-shaped opening 9.2 in the anchoring section 369.

The variant according to FIGS. 104*a* to 104*e* shows a modification with respect to the preceding exemplary embodiments 102*a* to 102*d* to the extent that the anchoring regions 358*a* are simultaneously also provided with corresponding contact faces while forming an attachment module 2.

The strength module 1 is held here by attaching a corresponding stationary component, albeit not in a pivot axis running perpendicular to the axis of rotation in this case.

Lastly, a few preferred and/or critical aspects of the invention shall be summarized once more.

A strength machine according to the invention preferably has the following features, for example, individually and/or in combination with one or another additional feature or with all other features:

A shaft 12, which is seated on a housing 20 or on a housing frame 141, wherein this shaft may also be seated on the so-called strap guide 144, a so-called inner support structure 145 and/or the so-called spacer-strap guide 150.

At least one (or more) rotating flywheel weights 13, which are mounted on the shaft 12 and are secured against radial slippage using a spring or a ball 14 or a cylindrical pin, or only by axial pressure, exerted by tightening a screw such as 18 or 98.

A flexible pulling element 3 which is attached to the shaft 12, so that by exerting a tangential pulling force (first on the pulling element 3 wrapped around the shaft 12), the pulling element 3 unwinds and then winds up again (on the shaft 12) by the inertial force of the shaft and the disk 13 mounted on the shaft 12.

The Strength Module

The housing can be constructed in the following variants, for example (most clearly depicted in FIGS. 99 to 104 and described previously):

Having a shaft 12 and, for example, two flywheel weights mounted on the shaft and a pulling element between the disks, which are preferably mounted directly on the shaft. A flywheel weight 3 can also be seated and/or mounted here on one side of the shaft.

The pulling element 3 is preferably directly attached to the shaft 12 or by means of compression springs, as described and/or depicted in FIGS. 10*a* to 11*d*.

As depicted in FIGS. 5 to 7 and/or in FIGS. 17 to 20, the housing consists preferably of two identical half-housings 20.2. The flywheel weights 13 are placed in the direct vicinity (possibly separated only with one disk) of the pulling element and the bearings 16 are placed outside of the flywheel weights 13.

The attachment of the pulling element to a reel, preferably a reel 97, which is in turn firmly mounted to the shaft 12.

The attachment of the pulling element 3 to the grip 4, preferably using a coupling as depicted in FIGS. 87 to 89.

A housing as depicted and described in FIG. 38 or 39, wherein the bearing 16 (preferably symmetrical) is in the vicinity of the reel 95 or 97. In this case, the flywheel weight(s) is/are placed outside of the bearings 16. The strength module is closed using lids 20.1 (e.g., housing halves).

The housing 20 has one or more recesses 10 or other couplings, which enable the device to be preferably attachable directly to a support 46.

The housing has a hollow cylindrical recess (various polygonal profiles also possible), such as inside a preferably cylindrical region (58), which ensures that the device can be attached preferably directly to a cylindrical pole, as depicted in FIGS. 40 and 41.

A strength machine 1 wherein the housing (20 or also in another design for example by means of a housing frame 141) is secured to a support 46 for example using an attachment module 2 and a "pin" 6 together, so that they jointly form a hinge coupling.

A housing as depicted and described in FIGS. 70 to 73, which basically has a hollow cylindrical coupling inside a region 58 as well as an adapter, for example corresponding to the adapter 113.

A strength machine 1 which has an enlarged (approx.) 90° opening 24 in the housing, which serves as an exit for the pulling element 3.

A strength machine 1 wherein there is provided a slide guide 7 for the pulling element 3 in the housing 20 along the opening 24.

A strength machine 1 is provided with a guide cover 102 (as shown for example in FIGS. 56 to 61) which encircles the opening 24. The functionality of this cover may be designed as a fixed component of the housing.

For the pulling element 3, there may be mounted on the housing opening 24 a guide 7, by means of which the pulling element 3 is guided through a profile opening (or through two elastically mounted rollers).

The aforementioned guide may have a suspension, which generates a tendency for the pulling element 3 in such a way that the pulling element 3 always remains oriented in the middle or perpendicular to it.

A strength machine 1 having covers 8 placed laterally on the housing 20 (as repeatedly depicted and described).

A strength machine whose flywheel weight 13 forms a multi-chambered hollow body having a closed or closable hollow space, which can be filled as needed with various liquid and/or solid or viscous media, for example with a liquid, a granulate-like composition, such as sand, gravel, metal particles, and so on. Such a flywheel weight 13, designed as a hollow body, can be refilled again at any time or emptied again after use.

Furthermore, multiple "sensors" may be provided on the strength machine, as was described.

Lastly, the device such as 1 can be mounted to various accessory parts, and/or various accessory parts can be added, in particular attached or mounted, to the strength machine 1, or can operate in a corresponding functional connection with the strength machine 1.

Lastly, the device according to the invention may also have a (safety) brake as described.

Attachment Modules

The attachment modules may also be designed in diverse ways as outlined in the invention. They may, for example, have the following features individually or in combination with another feature:

the module 2 (primarily as depicted and described in FIGS. 13 to 16) may be used with a preferably hinge-like coupling; the module 2 can be used here for attaching other devices or objects (for example, also used for a vibration device, which comprises an eccentric motor axis having massage belts). Furthermore, an attachment adapter 85 and/or 109 can also be used.

A universal attachment module 109 can, as described and depicted, be used, particularly as depicted and discussed in FIGS. 62 to 66. Without the holes 111 provided there and without the tapered portions 110 described there, it may be used for example with an attachment adapter for door frames.

The strength module may be housed in a shelf- and/or cabinet-like setup, in which it can also be attached, as shown for example in FIGS. 29 to 32*a*.

Attachments

The strength module 1 is preferably attachable to a cylindrical and/or vertical support 46, preferably using an attachment adapter/module; in addition, the strength module can be attached preferably using elastic straps, such as strap 45 for example, to a cylindrical support (as shown for example in FIGS. 25 to 28).

- the attachment of the strength module 1 (etc.) can be mounted to a wall, for example using a mounting adapter for door frames or for example a universal attachment module 109 to or on a support 99 for example, or be designed together with it;
- as shown in FIGS. 42 to 46 and 67 to 69, the attachment of the strength module 1 can be screwed firmly to a support (wall, etc.) or be mounted temporarily to it, namely for example using "attachment clamps" of all types, as described and shown for example in FIGS. 47 to 50;
- furthermore, the attachment of a strength module 1 may also be performed on a "crossbeam" which can slide upward or downward on two vertical pillars. A mirror or a monitor may be placed in the background between the pillars.

Hand Grip

The free end of the pulling element 3 is conventionally connected to a hand grip 4 so that the pulling element winds up on a mounted reel inside the hand grip by the tensile effect of a spring or unwinds by the exertion of a tensile force, which results in a length adjustment of the pulling element (as with a "dog leash"). Securing the adjusted length will take place by blocking the reel, or the direct blocking of the pulling element in the hand grip.

An ergonomically constructed hand grip may be constructed as shown in the depicted FIGS. 21, 22 and 87 to 89.

Case

A case, as depicted and described in FIGS. 31 and 32, can preferably be used to accommodate inside of it the strength module according to the invention; the hand grip of the strength module can project out of the case when the case is closed and serve as a unique carrying handle for the entire unit consisting of case and strength module.

Illumination, Sensors,

The strength module housing according to the invention and/or the described individual components of the strength module may also have integrated lighting means which shine and/or illuminate at least parts of the device itself or which are provided preferably with light-conducting plastic materials; preferably electroluminescent materials can be considered, i.e., particularly plastic materials and/or films, which produce light effects when using daylight-light sources (in other words having daylight frequency) or which are correspondingly colored or are provided with different colors. The intensity of light and/or the colors can preferably be individually adjustable and/or pre-selectable here;

- the device according to the invention may preferably comprise a microprocessor, including associated hardware, software as well as external elements (which may be installed), with which for example the mass moment of inertia can be adjusted depending on the body weight or training model; likewise, with these, one can also automatically or interactively control the lighting and all other electrical and electronic processes;
- the device according to the invention can preferably also be provided with loudspeakers, sensors, rechargeable energy storage cells, etc., which may be installed for example in the housing or in the lid and/or the cover 8;
- the strength machine 1 according to the invention preferably comprises a combination of the actual device along with the housing and/or shaft and/or a pulling element 3 and/or a hand grip 4 and/or an attachment module 2 and/or all accessory parts mentioned and/or described in the present application; preferably, the device according to the invention may be fitted/provided with all precedingly described "sensors" individually or in any combination.

Electric Generator

A device according to the invention preferably has between the rotating shaft 12 (or a rotating part of the assembly) and a fixed part, such as a housing 20, an electric generator, which is correspondingly installed, as is shown for example in FIG. 38 or FIG. 74 and described in this context.

- pursuant to a variant, a device according to the invention preferably comprises a shaft 12 having a flywheel 13, not oscillating like a "yo-yo" but drivable with a continual rotating motion, which can be compared to the drive wheel of a bicycle, as is shown and described in particular in connection with FIGS. 38 and 74;
- the device according to the invention can preferably be designed as a training device and an electric generator, as depicted and shown in FIGS. 33 to 37;

Accessories

The device according to the invention may be used preferably with the following accessories, which may be mounted or are mountable on the device according to the invention: current output terminal, graphics monitor (TFT, LED, etc.), radio receiver, TV receiver, audio loudspeaker, audio amplifier, the device according to the invention can thereby be provided with one or more of the "accessory parts" described above.

Strength Wraps (Body Wraps)

Preferably, strength wraps may be provided or used for applying a force to the body (as described above). These wraps may also be used in connection with other devices (such as "vibration devices"); The design of the strength machine is such that the training force is exerted via a strength wrap, which is connected directly to the pulling element or via a coupling.

The (flexible) strength wraps are constructed, congruent with various body parts or combinations of multiple body parts, out of flexible materials and material combinations and are preferably attached to the body using Velcro fasteners. On the strength wrap, a scaled surface may be attached where users can follow their progress, e.g., for weight loss. The strength wraps may be warmed up preferably with built-in/sewn-in current-conducting textiles. Vibration elements, such as motors having weights mounted eccentrically on the rotor or current-conducting electrodes for stimulation current therapy (which activate the muscles by current pulses) or stimulation current training, can be attached in the strength wraps. The current can originate from built-in rechargeable energy storage cells or batteries, or from attached power lines.

The strength wraps can also be coated with waterproof layers or applied "films." In this way, the body can be made to sweat in the region in question more quickly.

A device according to one of the claims or out of combinations of the previous claims, wherein it is operated or provided with the "strength wraps" mentioned and/or described in this patent.

The strength machine according to the invention is constructed in a modular manner and can comprise the following individual modules (which also have inventive features when taken by themselves and can generally be used together with other components or other devices):

- Strength module with or without housing
- Pulling element, fixed on a supported shaft
- Special grip coupling for attaching the pulling element to a hand grip or a body wrap
- A special hand grip as described
- Anchoring coupling, placed in the direction opposite the force application on a special structure with a supported shaft 12 and flywheels 13 and 358, 363, 92, etc., as depicted in FIG. 103 to 103.2 or directly on the housing, such as 9.2, 358 or 363, as shown in FIGS. 99 to 102 and 104
- Anchoring adapters
- Body wraps
- Special case
- Electric generator Lastly, the most critical components of the device according to the invention are listed once again individually, wherein all or any parts of these components are suited for a promising and advantageous implementation of the invention. However, these modules or components mentioned below also have, when taken by themselves, innovative details, which when taken by themselves offer significant advantages.

The following individual aspects, parts and/or modules for example are thereby involved:

- A strength module:
  - with or without a housing
  - with a supported shaft such as 12 and one or more flywheels
  - with an exit opening for the pulling element,
  - with an anchoring region placed in the opposite direction to the exit opening, with the ability to place various anchoring couplings there An anchoring coupling (anchoring element):
with the ability to attach the strength module in a vertically pivotable or fixed manner to a stable (in the hands) or stationary support
which is mounted on a fork-like structure, namely between the flywheels and/or outside of the flywheels (FIGS. 103, 103.1 and 103.2)
which is mounted directly on the housing, e.g., in the form of a preferably elongated recess 9.2 or for example in the form of a (bayonet-like) recess 363 (see FIGS. 99 to 102 and 104);
which is mounted on a rearward, cylindrical anchoring section 358, on a housing or directly on a fork-like or fork-shaped support structure
the anchoring type of the strength module may be pivotable/hinge-like or rigid (in other words, fixed) (as depicted and described in FIG. 103.2 or FIG. 24);
A certain housing type:
Simply constructed, preferably of two identical, rigidly attached half-housing parts such as 20, depicted in FIGS. 18 to 20 constructed based on a special, fork-like inner structure as depicted in FIGS. 103 to 103.2, with fixed (not depicted) or pivotable outer walls such as 141, as depicted for example in FIGS. 91 to 94
with non-transparent or transparent walls
with modularly constructed walls like 141+142 in FIG. 91
A multifunctional hand grip also usable on other devices
with a conventional or innovative COUPLING
with conventional or
innovative ergonomics, for one or two hands
may be constructed in a compact manner, as in FIG. 22 for example, or a modular manner, as in FIG. 23 for example
a novel, ergonomic hand grip 4.1 as depicted in FIGS. 23.1*a* and 23.1*b*, which offers the ability to connect it, in the region of the middle arc/central arc 44, using "ring-shaped coupling," such as a ring, carabiner, etc. (not depicted) to a pulling element, such as 3, in a permanent or detachable manner.
a novel ergonomic hand grip having an integrated coupling, as described before and depicted in FIGS. 21 to 23
Strap coupling:
implementable with conventional solution, e.g., using a carabiner, etc.
having a convenient attachment which is in itself inventive, as in FIGS. 87 to 89 for example
having novel ergonomics and having an additional convenient attachment as illustrated in FIG. 21
having novel ergonomics, a convenient attachment and an advantageous reel system as shown in FIG. 22;
Shaft type:
a shaft 12 having a simple attachment of the pulling element using a pin
a shaft 12.1, which comprises an attachment having integrated damping using two axially placed springs,
a shaft, which is provided with a wedge-shaped recess and a device for securing the pulling element;
The shaft bearing:
in various positions with respect to the flywheels 13 and the housing walls or the inner structure
Pulling element:
strap-like
cord-like
V-belt, chains, etc
Anchoring adapters
for pole-like supports
to hold the strength module in the hands as in 4*a* and 4*b*
for door frames or wall ends
for walls
The case
wherein the hand grip of the device serves as a carrying handle for the device packed in the case;
wherein the opened case can also be converted into a standing base for training.
Additional innovations:
A novel attachment adapter, like 109.1, described in FIG. 50.1*a* to 50.1*b*
A novel connection between pulling element 3 and shaft 12.1, having a damping/anti-shock effect at the dead point
A novel connection capability between strap end and shaft 12.1, as described in FIGS. 10.2 to 10.4
Novel attachment wedge, which is injection-molded in the original mold as a "flat part" and then folded, as depicted in FIGS. 10.2 to 10.4
Novel attachment adapter 2.1, as depicted in FIGS. 105*a* to 105*g*, which basically functions like the adapters 2, with the difference that the generating cylinder curves are round or circular instead of linear.
Novel attachment adapter 2.2, as depicted in FIGS. 106*a* to 106*g*, very similar to 2.1, with the difference that the rear support edges AF are discontinuous in the middle.

LIST OF REFERENCE SIGNS

1 Training device/strength module
2 Attachment module
2.1 Independent attachment modules; attachment
2.2 Attachment adapter like 2.1, having a centrally discontinuous support edge AF
AK Support edges
HR Hollow space
GH Grip hook for attaching a hand grip as depicted in FIGS. 21 to 23*b*. It may also contain a magnet or be magnetic. In this case, one or more magnets are mounted on the relevant hand grips. Such a hand grip can be affixed on all described housing-types mentioned in this document;
3 Pulling element (strap/belt, cord, etc.)
3' Belt end (or end of pulling element 3)
4 Hand grip
4 Hand grip with integrated coupling
4.1 Simple hand grip without coupling
F Weakened fold lines on the foldable wedge device 81.1
5 Coupling between 3 and 4
6 Pin=>hinge coupling between 1 and 2 Can be bent on the upper end, as in FIGS. 27 and 28 or straight, with coupling function, as in FIGS. 90 to 94
7 Guide for pulling element
8 Multifunctional cover with design element in/on this cover, sensors, loudspeakers, power storage units such as batteries, etc. can be attached
9 Recesses (top and bottom) for guiding a lashing belt or cord 45, which is used for attaching the module 2 to a fixed support/base
9.1 Central recess for guiding a lashing belt 45 for attaching the module 2 to a stationary support. This recess can also be designed as an elongated hole-like (like 9) recess (not depicted).
9.2 Central recess in the housing for guiding a lashing belt for the SECURE/direct attachment to a stationary support
10 Recess for attaching the training device directly to a fixed support/base 46
11 Spirit level

12 Shaft, simple
12.1 Shaft for shock-damping system
12*a* (see FIG. 7)
13 Flywheel weight
14 Ball or wedge as anti-slip coupling between 12 and 13
15 Spacer
16 Ball bearing
17 Attachment disk
18 Screw
19 Magnet
20 Housing, including half-housing or housing-half
20.1 Lid housing or lid
20.2 Housing halves
21 Attachment element (screw) between the two housing halves
22 Rib (spring)
23 Groove
24 Opening for pulling element 3 guide into the housing 20
25 Through-hole for the pulling element
26 Enlarged recess for the wedge attachment of the thickened end of the pulling element
27 Recess/groove for 14
28 Threaded hole
29 Shaft with axial coupling
30 Recess for lashing belt/cord 45
31 Through-hole (which results in a hinge joint, along with elements 6 and 2
32 Recess for spirit level, sensors, illumination element (LED), etc.
33 Support foot, outside
34 Support foot, inside (could be eliminated)
35 Recess (with round or other profile) as coupling element
36 Recesses as coupling elements
37 Through-hole or hole on the housing 20 (as in FIG. 19) or on the anchoring section 358. This together with the element 6 (*pin*) and for example 2 (adapter) forms a hinge joint. This "through-hole" may be a simple hole or a threaded hole or a bayonet, basically any type of coupling, where an "adapter" for attaching the strength module to a stable "hand grip" such as 4*a* and 4*b* or any other type of "adapter" can be attached.
38 Recess for attachment element 21
39 Recess for ball bearing 16
40 Side grips
41 Middle grip/central grip
42 Ergonomic recesses for index finger
43 Ergonomic recesses for middle finger
44 Middle arc/central arc
45 Lashing belt, lashing cord
46 Support/base (tree, mast, post, etc.); preferably, a vertical cylinder with round or polygonal or irregular cross-section.
47 Pad/adapter for mobile phone, tablet, laptop, books, mirror, etc.
48 Lamp, light emitter, as additional accessories
49 Support for attaching to a wall or the back side of a cabinet
50 Walls of a cabinet/box
51 Hole for attaching elements
52 Radial electric generator secured to the housing and driven via the shaft using an axial coupling 29
53 The housing of 52
54 Housing for a power storage unit/rechargeable energy storage cell
55 Hand grip having the same functionality as 4, but constructed in a modular manner
56 Attachment module like 2, having a different construction
57 Pin for attaching the pulling element into the recess 26
58 "Cylindrical region," which can also be extended "downward or upward"
59 Reel for winding up the pulling element 3
60 Window in the packaging to make the cover 8 with the logo visible
61 Case (including half-packaging)
62*a* A case-half (half-packaging)
62*b* Other case-half (other half-packaging)
63 The (preferably neodymium) magnets of a "rotor," mounted on/instead of a flywheel weight 13
64 The "coils" of a "stator" (of a generator), secured on the housing 20
65 Special ball bearing, which can only rotate in one direction. It is rigid in the opposite direction and can transmit a torque!
66 Special reel
67 Attachment pulling element 3 on the reel 66
68 Coil spring strip
69 Attachment spring strip 68 on the reel 66
70 Attachment spring strip 68 on the fixed housing 20
71 Tongue in the housing 20 for fixing 68 and as spacer for the special ball bearing
72 Special intermediate disks that are constructed of low-friction and temperature-resistant material (such as PTFE/Teflon)
73 Magnet holder
74 (Preferably neodymium) permanent magnets
75 Current output leads
76 Coupling at the end of a shaft 12
77 Through-bolt
78 Central recess
79 Centering pin
80 Coupling teeth
81 Pin/wedge
81.1 Foldable wedge device for attaching the pulling element 3 in the wedge-shaped recess KA in the shaft 12.2
81.2 Wedge-shaped inner part on which the strap end wraps around. Serves to simplify the connection between shaft and strap end.
KA Wedge-shaped recess in the shaft 12.2
BJ Bayonet-like couplings
82 Bar
83 Stopper
84 Fixing screw
85 Attachment adapter for door frames or wall ends
86 Lying surface
87 Attachment base
88 Holding mount
89 Door frame
90 Attachment clamp (or any other attachment variant, for example with a thread, etc.)
91 Wound-up pulling element
92 Reel
93 Pipe or bar
94 One-way freewheel bearing (such as a "sprag-clutch bearing"). The bearing runs freely in one direction and can transmit a torque in the other direction.
95 Reel, is supported on 94 and on the coil spring 96, which is attached in the center on the housing 20.
96 Coil spring
97 Reel for winding up pulling element 3
98 Screw nut
99 Support/board, etc.
100 Screw holes
101 Attachment adapter
102 Guide cover

103 Guide pins
104 Attachment elements (standard=screws, etc. but preferably neodymium magnets)
105 Guide walls (but also have a safety function, in which finger access to the rotating flywheel weights 13 is made impossible).
106 Logo, lighting, etc.
107 Anti-slip material (foam, rubber, etc.)
108 Increased anti-slip region
109 Universal attachment module for mounting the strength module 1 as illustrated in FIGS. 67 to 69,
109.1 Novel attachment adapter for door frames or wall ends
109.2 Support foot, which is possibly provided with a damping and/or anti-slip insert in the contact region with the support 89
110 Tapering
111 Attachment holes
112 Masking cover
113 Covering plug with coupling elements
114 Thermo- and friction-resistant disks (made of PTFE/Teflon or similar material) and forms the screw 18
115 Spacer tube between flywheel weight 13 and ball bearing 16
116 Wall adapter
117 Wall adapter end piece
118 Holes
119 Rail (recess)
120 Recess as coupling for smartphone adapter
121 Adapter for mobile communications device (including smartphone), tablet, etc.—adapter
122 Coupling part (also tubular)
123 Bracket (also referred to as rear bracket)
123' Rear wall of the bracket 123
123*a* Front side of the bracket 123
123*b* Rear side of the bracket 123
124 Base bracket
124*a* Upward-projecting edge on the base bracket 124
124*b* Mobile communications device, smartphone, tablet or similar
125 Recess
126 Rotatable adapter
127 Coupling part for 2
128 Coupling wrap or coupling outer wrap and/or coupling outer casing
128*a* Arrow
128*b* Inner front side of the coupling outer sleeve
129 Stopper or wedge
129*a* Outer surface of the stopper 129
130 Coupling inner body (which has an outer contact surface, which is form-congruent with the inner surface of the coupling outer sleeve; the coupling inner body can thereby be designed in a flat, cylindrical, wedge-shaped or conical manner)
130*a* Outer contact surface on the inner element 130
130*b* Inner recess in the element 130
130*c* Front side on inner element 130
131 Guide (above inner contact surface on the coupling outer wrap 128 in interaction with the outer contact surface and coupling on the inner element
130)
132 Screw/bolt (can also be absent) and fixed 129 on 128
A Clearance
AR Space
F Pulling direction
IG Inner fork, placed BETWEEN the flywheel weights 13, fixed on the shaft 12 or 12.1 and comprises the pulling element 3
133 Guides for 3
134 Through-hole for 3
135 Compression spring
140 Lid
141 Housing frame
142 Housing side wall-transparent or opaque—with individual logo, etc.
143 Storage space
144 Strap guide
144*a* Strap guide sections
145 Inner support structure, which forms an inner fork IG as in FIG. 103.1*c*
146 Hinge for lid 140
147 Base inner structure
148 Spacer for 141
149 Coupling
150 Spacer, strap guide
151 Magnet coupling or magnetic coupling, which implements the connection between the cover 8
152 Hinge for housing frame 141
153 Opening for pulling element 3
154 Logo holding mount
155 Inner cabinet
156 Closable cabinet door
157 Outer cabinet can be constructed as removable module for accessories, such as water bottle, loudspeaker, etc.
158 Cover, outer cabinet
200 Strength wrap
201 Body wrap
202 Overlap
203 Velcro fastener
204 Connecting wrap/connecting element
205 Body
206 Coupling
207 Lateral couplings
210 Inner housing
211 Reinforcing element, which is attached inside the opened hard plates 212.
In the middle, the 211, in parallel with the hinges of the case, each have one through-hole, into which the strength module 1 is mounted using a bar 6.
Short, rigid, non-rotating adapter 357
Rearward anchoring section 358
358*a* Anchoring region
360 Attachment straps/lashing belts (also labeled 45)
362 Mounting section/anchoring region in the form of a bayonet coupling or other type of coupling
363 Threaded hole
368 Recess
369 Rearward, rigid anchoring section
K Coupling=hole or threaded hole, bayonet, etc., for adapters, hand grips such as 4*a*, 4*b*, multimedia, etc.
401 Rail or profile
403 Profiling or groove
405 Side surface of the rail or the profile 401
409 Adapter
411 Connection possibility
415 Holding body/rearward anchoring section such as 358

The invention claimed is:

1. A strength training machine comprising:

a housing having at least two openable or detachable housing shells;

a support structure coupled to the housing and having two inner housing sections arranged spaced apart from each other and rotatably supporting a shaft on opposite sides of the shaft;

a rotatable flywheel mounted on the shaft supported by the support structure, the rotatable flywheel being situated between the at least two housing shells, the rotatable flywheel changing its direction of rotation while in operation, wherein the rotatable flywheel comprises at least two mutually-parallel plates mounted on the shaft, wherein the support structure extends between the at least two mutually-parallel plates;

a strap-shaped or belt-shaped flexible pulling element attached to the shaft and located between the housing sections of the support structure a hand grip which forms part of or is attached to the flexible pulling element; and an attachment module coupled to the housing, for securing the strength training machine to an external support.

2. The strength training machine of claim 1, wherein each of the at least two housing shells has a protruding, curved shape.

3. The strength training machine of claim 1, wherein at least one of the housing shells is pivotably mounted on the support structure.

4. The strength training machine of claim 1, wherein the support structure includes an opening allowing user access to a location of attachment of the flexible pulling element to the shaft, to allow a user to attach/detach the flexible pulling element to the shaft without disassembling the strength training machine.

5. The strength training machine of claim 1, wherein the flexible pulling element extends between the at least two mutually-parallel plates and extends through an opening defined in the housing.

6. The strength training machine of claim 1, wherein the housing is removably-attachable to the attachment module through a hinge joint situated opposite an opening defined in the housing, the hinge joint including a removable pin.

7. The strength training machine of claim 6, wherein the attachment module comprises at least two support feet oriented to be attached to angled surfaces of the external support.

8. The strength training machine of claim 7, wherein the attachment module comprises a tension belt or tension cord configured to be placed around a rounded surface of the external support.

9. The strength training machine of claim 1, wherein the at least two housing shells are divided by a separation plane perpendicular to the shaft.

10. The strength training machine of claim 1, wherein each of the at least two housing shells is attached via a hinge to the support structure.

11. The strength training machine of claim 1, wherein an end of the flexible pulling element attached to the shaft forms a loop penetrated by a pin, wedge or bar, wherein the pin, wedge or bar rests in a recess defined in the shaft when the pulling element is subject to a load.

12. The strength training machine of claim 1, wherein at least one of the housing and the attachment module includes or is coupled to one or more brackets sized to support mobile communication devices or tablets, and wherein the strength training machine is connected to at least one of a network interface allowing an internet connection and a transmission device allowing a wireless connection.

13. The strength training machine of claim 1, wherein the hand grip comprises a middle section having a middle or central arc to which the flexible pulling element is coupled.

14. The strength training machine of claim 1, wherein the flywheel is positioned between two multifunctional covers supporting at least one of a sensor, loudspeaker, and energy storage unit.

15. The strength training machine of claim 1, further comprising magnets serving as attachment elements for the at least two housing shells.

* * * * *